US012628895B2

(12) United States Patent
Lebel

(10) Patent No.: US 12,628,895 B2
(45) Date of Patent: May 19, 2026

(54) ACCESSORY ATTACHMENT SYSTEM FOR A HELMET

(71) Applicant: GALVION LTD., Portsmouth, NH (US)

(72) Inventor: Stéphane Lebel, Sainte-Tite-des-Caps (CA)

(73) Assignee: GALVION LTD., Portsmouth, NH (US)

( * ) Notice: Subject to any disclaimer, the term of this patent is extended or adjusted under 35 U.S.C. 154(b) by 0 days.

(21) Appl. No.: 19/184,618

(22) Filed: Apr. 21, 2025

(65) Prior Publication Data

US 2025/0241396 A1 Jul. 31, 2025

Related U.S. Application Data

(63) Continuation of application No. PCT/US2023/077642, filed on Oct. 24, 2023.

(60) Provisional application No. 63/419,192, filed on Oct. 25, 2022.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/04; A42B 3/10
USPC ..... 2/2.5
See application file for complete search history.

(56) References Cited

U.S. PATENT DOCUMENTS

| | | | |
|---|---|---|---|
| 3,018,210 | A | 1/1962 | Frieder et al. |
| 4,023,209 | A | 5/1977 | Frieder, Jr. et al. |
| 5,416,922 | A | 5/1995 | Horvat et al. |
| 6,804,829 | B2 | 10/2004 | Clark et al. |
| 8,001,623 | B2 | 8/2011 | Gertsch et al. |
| 8,020,220 | B2 | 9/2011 | Mcelroy et al. |
| 8,225,419 | B2 | 7/2012 | Hersick et al. |
| 8,826,463 | B2 | 9/2014 | Teetzel et al. |
| 8,908,389 | B2 | 12/2014 | Teetzel et al. |
| 8,984,665 | B2 | 3/2015 | Celona et al. |
| 9,101,175 | B2 | 8/2015 | Redpath et al. |
| 9,247,779 | B1 | 2/2016 | Aloumanis et al. |

(Continued)

FOREIGN PATENT DOCUMENTS

| | | | |
|---|---|---|---|
| CN | 109923500 A | 6/2019 | |
| EP | 3508087 A1 * | 7/2019 | ..... A42B 3/0433 |

(Continued)

OTHER PUBLICATIONS

International Search Report and Written Opinion corresponding to Application No. PCT/US2023/077642, dated Feb. 28, 2024, 19 pages.

(Continued)

*Primary Examiner* — Tajash D Patel
(74) *Attorney, Agent, or Firm* — DAY PITNEY LLP; George N. Chaclas

(57) ABSTRACT

A helmet system comprising one or more accessory attachment structures for receiving one or more accessories. An accessory attachment structure includes at least one accessory interface that includes mechanical interface features for attaching and locking an accessory onto the accessory attachment structure. Some accessory interfaces include an electrical interface for electrically connecting with a corresponding electrical interface of a powered accessory device.

21 Claims, 33 Drawing Sheets

(56) References Cited

U.S. PATENT DOCUMENTS

| | | | | |
|---|---|---|---|---|
| 9,357,809 | B2 | 6/2016 | Basson | |
| 9,486,027 | B2 | 11/2016 | Dey et al. | |
| 9,622,529 | B2 | 4/2017 | Teetzel et al. | |
| 9,787,892 | B2 | 10/2017 | Henn | |
| 9,788,587 | B2 | 10/2017 | Auranen et al. | |
| 10,039,336 | B2 | 8/2018 | Lombard | |
| 10,079,488 | B2 | 9/2018 | Challancin | |
| 10,165,817 | B2 | 1/2019 | Redpath et al. | |
| 10,324,290 | B2 | 6/2019 | Weller et al. | |
| 10,484,652 | B2 | 11/2019 | Hobby et al. | |
| D900,407 | S | 10/2020 | Hanudel et al. | |
| 10,928,163 | B2 | 2/2021 | Zimmer | |
| 11,274,905 | B2 | 3/2022 | White et al. | |
| 11,353,159 | B2 | 6/2022 | Roth | |
| 11,406,152 | B2 | 8/2022 | Rao | |
| 11,419,382 | B2 | 8/2022 | Teetzel et al. | |
| 11,452,328 | B2 | 9/2022 | Franzino et al. | |
| 11,612,207 | B2 | 3/2023 | Teetzel et al. | |
| 11,758,962 | B2 | 9/2023 | Havola | |
| 11,771,163 | B2 | 10/2023 | Abdollahi et al. | |
| 11,797,078 | B2 | 10/2023 | Rabinovich et al. | |
| 11,930,879 | B2 | 3/2024 | Franzino et al. | |
| 12,235,451 | B2 | 2/2025 | Woods et al. | |
| 12,429,990 | B2 * | 9/2025 | Hautson | G06F 3/04162 |
| 2003/0070200 | A1 * | 4/2003 | Crye | A42B 3/10 2/6.6 |
| 2006/0007562 | A1 | 1/2006 | Willey | |
| 2006/0101556 | A1 | 5/2006 | Goldsborough | |
| 2007/0083967 | A1 | 4/2007 | Crossman et al. | |
| 2008/0263752 | A1 | 10/2008 | Solinsky et al. | |
| 2010/0083413 | A1 | 4/2010 | Mcgovern | |
| 2011/0072548 | A1 | 3/2011 | Hersick et al. | |
| 2012/0002046 | A1 | 1/2012 | Rapoport et al. | |
| 2012/0011631 | A1 | 1/2012 | Crossman et al. | |
| 2012/0224356 | A1 | 9/2012 | Fischer et al. | |
| 2013/0086722 | A1 * | 4/2013 | Teetzel | A42B 3/04 2/2.5 |
| 2013/0191967 | A1 | 8/2013 | Harris | |
| 2014/0020159 | A1 * | 1/2014 | Teetzel | A42B 3/04 2/422 |
| 2014/0123360 | A1 * | 5/2014 | Cohen | F41H 1/04 2/6.6 |
| 2014/0196198 | A1 * | 7/2014 | Cohen | A42B 3/063 2/414 |
| 2015/0157079 | A1 | 6/2015 | Auranen et al. | |
| 2016/0075338 | A1 | 3/2016 | Henn | |
| 2016/0295948 | A1 | 10/2016 | Dowd et al. | |
| 2017/0269460 | A1 | 9/2017 | Fagerkvist | |
| 2018/0003989 | A1 | 1/2018 | Terada et al. | |
| 2018/0199653 | A1 * | 7/2018 | Paige, Sr. | A42B 3/125 |
| 2018/0235304 | A1 | 8/2018 | Fischer et al. | |
| 2018/0308397 | A1 | 10/2018 | Sugimoto et al. | |
| 2018/0353176 | A1 | 12/2018 | Shelton et al. | |
| 2020/0019236 | A1 | 1/2020 | Parkinson et al. | |
| 2021/0037905 | A1 | 2/2021 | Ward et al. | |
| 2021/0247618 | A1 | 8/2021 | Moore et al. | |
| 2021/0293513 | A1 * | 9/2021 | Zimmer | A42B 3/166 |
| 2021/0315314 | A1 | 10/2021 | Teetzel et al. | |
| 2023/0046229 | A1 | 2/2023 | Moore et al. | |
| 2023/0251063 | A1 | 8/2023 | Zimmer | |
| 2024/0008581 | A1 | 1/2024 | Franzino et al. | |
| 2024/0315372 | A1 * | 9/2024 | Teetzel | A42B 3/04 |

FOREIGN PATENT DOCUMENTS

| | | | | |
|---|---|---|---|---|
| WO | 2016016445 | A2 | 2/2016 | |
| WO | WO-2017062945 | A1 * | 4/2017 | A42B 3/04 |
| WO | 2018173313 | A1 | 9/2018 | |
| WO | 2020109887 | A1 | 6/2020 | |
| WO | WO-2020237189 | A1 * | 11/2020 | A42B 3/0406 |
| WO | WO-2022125311 | A2 * | 6/2022 | F16F 7/121 |

OTHER PUBLICATIONS

EP Extended Search Report corresponding to Application No. 22209825.3, dated Apr. 13, 2023, 4 pages.

International Search Report and Written Opinion corresponding to Application No. PCT/US2023/061745, dated Jul. 28, 2023, 19 pages.

EP Extended Search Report corresponding to Application No. 21770744.7, dated Mar. 7, 2024, 7 pages.

International Search Report and Written Opinion corresponding to Application No. PCT/US2021/016807, dated Dec. 28, 2021,12 pages.

* cited by examiner

ACCESSORY ATTACHMENT SYSTEM FOR A HELMET

1 CROSS-REFERENCE TO RELATED APPLICATIONS

This present application is a continuation of International Application No. PCT/US2023/077642 filed Oct. 24, 2023 and published on May 2, 2024 as WO2024/091942A1, which claims the benefit and priority of U.S. Provisional Application No. 63/419,192 filed on Oct. 25, 2022, each of which is incorporated herein by references in its entirety for any purpose whatsoever.

2 COPYRIGHT NOTICE

A portion of the disclosure of this patent document may contain material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice shall apply to this document: Copyright © 2025 Galvion LTD.

3 BACKGROUND OF THE DISCLOSURE

3.1 Field of the Disclosure

The exemplary, illustrative, technology herein relates to systems and methods for head protection devices and systems.

3.2 The Related Art

Known helmet systems include rails for attaching accessories to a helmet. Known rails are attached to a helmet, accessory devices are each configured with one or more connectors designed to interface with the rails, and one or more accessories are in turn attached to the rails.

4 SUMMARY OF THE DISCLOSURE

The inventors have recognized a need for a helmet system that includes improved accessory attachment structures that allow a user to add and remove accessories to a helmet. The inventors have created exemplary embodiments of a helmet system that solve this need. In some exemplary embodiments, a helmet is provided that includes an outer shell. The outer shell includes mounting and connecting features that allow accessories to be mounted on the outer shell.

In a particular exemplary embodiment, the helmet system includes at least an outer shell: for example, a rigid outer shell that can function as a bump shell. In some embodiments, the helmet system includes one or more ballistic layers, i.e. one or more ballistic protection or ballistic-resistant layers The outer shell can be formed by a molding process and one or more features—for example, one or more of ridges, fasteners, and housings—can be formed as part of the outer shell.

One or more accessory attachment structures each can be formed as a portion of the outer shell or can be formed separately and attached to the outer shell in an assembly operation. Each accessory attachment structure can include one or more mechanical or electro-mechanical accessory attachment interfaces for at least mechanically attaching an accessory to the helmet. An electro-mechanical accessory attachment interface can include at least one electrical contact for power and/or communications with an accessory.

Accessories are provided with attachment features that mechanically connect with an accessory attachment interface on a helmet.

Attachment features of an accessory can be formed to interface with a specific accessory attachment interface or with a specific type of accessory attachment interface. For example, an accessory that requires power can be provided with attachment features that are designed to be connectable only with mechanical interface features of an electro-mechanical accessory attachment interface.

A user can attach an accessory to a helmet by manipulating the accessory to fit attachment features of the accessory into mating mechanical interface features on the helmet that are specific for connecting with the accessory. In this manner, accessory interfaces allow a user to add and remove an accessory from a helmet with one hand and by feel.

Accessory attachment features further include at least one release mechanism that enables a user to easily remove an accessory from a helmet: for example, a release clip that can be actuated by a thumb or finger. In some embodiments, an accessory attachment feature is provided that breaks away from an accessory attachment interface when the accessory is subjected to a load greater than a threshold value. This allows a user to remove an accessory quickly without the need to actuate a release clip. This further allows an accessory to be disengaged from the helmet when the accessory is subjected to a load force without transferring greater than a threshold amount of the loading force to the helmet. For example, if an accessory becomes snagged on an object in the user's surroundings, the accessory may be dislodged from the helmet rather than transferring force to the helmet, or slowing or immobilizing the user.

The helmet system can include a rear control module that provides power to some accessories attached to the helmet and that can communicate with accessories that include a communication interface. Power and/or data cables connect the rear control module with electrical interface components of electro-mechanical accessory attachment interfaces of the accessory attachment structures and with other electrical interfaces of the helmet system. In some embodiments, the cables are routed through cavities under ridges formed in the outer shell of the helmet. In other embodiments, at least some cables are routed over an outer surface of the helmet or through one or more cable runs attached to the outer surface.

A first example embodiment according to the technology disclosed herein includes an accessory attachment system. The accessory attachment system includes a helmet having an outer shell. The outer shell has an outer surface, an inner surface, and a concave cavity formed within an interior of the outer shell. A first ballistic layer is disposed interior to the outer shell, within the concave cavity. The accessory attachment system further includes a helmet electrical conductor disposed between the outer shell and the ballistic layer and a structure for attaching an accessory to the helmet. The structure may be mounted on the outer surface or may be accessible through the outer surface. The structure includes a first accessory interface for attaching a first accessory to the structure. The first accessory interface includes an accessory engagement surface for interfacing with the first accessory, at least one mechanical interface for interfacing with a corresponding engagement feature of the first accessory, a first electrical interface disposed on the accessory interface surface for electrically connecting with a second electrical interface of the first accessory, and one or more electrical connectors passing through the structure, the one or more electrical connectors for electrically connecting the helmet electrical conductor to the first electrical interface.

In at least one embodiment, the helmet electrical conductor is attached to the inner surface of the outer shell and is not attached to the ballistic layer.

In at least one embodiment, the outer shell forms at least one ridge including a ridge cavity disposed between the inner surface of the outer shell and the ballistic layer, the structure is disposed on a portion of the outer surface that includes the ridge, and the helmet electrical conductor is disposed within the ridge cavity.

In at least one embodiment, the structure includes a cavity enclosed by the structure between the outer surface of the outer shell and the first electrical interface. The one or more electrical connectors extend from the helmet electrical conductor, through the cavity, and to the first electrical interface to provide electrical power to the first electrical interface.

In at least one embodiment, the accessory engagement feature faces outward from the helmet outer surface and the outer structure includes a first side wall depending from the accessory engagement surface toward the outer surface of the helmet and a second side wall depending from the accessory engagement surface toward the outer surface of the helmet, the second side wall opposing the first side wall across a width of the structure. Further, the at least one mechanical interface includes a first interface cavity disposed on the first side wall and a second interface cavity disposed on the second side wall. The first interface cavity includes a first interface surface opposing the structure outer surface for interfacing with a first engagement feature of the first accessory and the second interface cavity includes a second interface surface opposing the structure outer surface for interfacing with a second engagement feature of the first accessory.

In at least one embodiment, the first accessory interface includes a first accessory attachment features and first accessory includes first connection features for engaging with corresponding first accessory attachment features of an accessory attachment that is suitable for the first accessory.

In at least one embodiment, the helmet electrical conductor includes a flexible circuit structure.

In at least one embodiment, the structure is overmolded on the helmet electrical conductor.

In some embodiments, the helmet includes a control module which includes a control module electrical interface and one or more of a power source and a processor. The outer shell includes a control module aperture passing between the outer surface and the inner surface and the helmet electrical conductor is electrically interfaced with the control module electrical interface through the control module aperture. The helmet electrical conductor is configured to exchange one or more of power and communication signals between the control module and the first electrical interface.

In some embodiments, the structure includes a second accessory interface for attaching a second accessory device to the structure, the first accessory interface is adapted to exclusively interface with the first accessory, and the second accessory interface is adapted to exclusively interface with the second accessory.

In some embodiments, the outer shell includes a cutout opening between the inner surface and the outer surface and the first accessory attachment structure is assembled into the cutout opening to expose the at least one mechanical interface and the first electrical interface on the outer surface of the outer shell.

In a second example embodiment according to the technology disclosed herein, an accessory attachment system includes a helmet that includes an outer shell with an outer surface, an inner surface, a concave cavity formed within an interior of the outer shell, and a ballistic layer disposed within the concave cavity. The outer shell includes a ridge formed thereupon, the ridge defining a ridge cavity disposed between the inner surface and the ballistic layer. The helmet includes a helmet electrical conductor disposed within the ridge cavity. The helmet also includes an accessory attachment structure mounted on or accessible through the outer surface, The accessory attachment structure includes a first accessory interface which includes a first electrical interface for electrically connecting with a first powered accessory device, the first electrical interface electrically connected to the helmet electrical conductor through the accessory attachment structure and a first mechanical interface configured to interface with the first powered accessory device.

In at least one embodiment, the first mechanical interface is configured to exclusively interface with the first powered accessory device.

In at least one embodiment, the accessory attachment structure further includes a second electrical interface for providing electrical and communication connections.

In at least one embodiment, the accessory attachment structure further includes a second accessory interface, wherein the second accessory interface includes a second mechanical interface configured to interface with a second accessory device. In at least one further embodiment, the second mechanical interface is configured to exclusively interface with the second accessory device.

In at least one embodiment, the first accessory interface comprises first and second accessory interface locating features having a first distance therebetween, the second accessory interface includes third and fourth accessory interface locating features having a second distance therebetween; wherein the first distance is different from the second distance, the first powered accessory device includes first and second accessory device locating features having a third distance therebetween, and the third distance corresponds to the first distance.

In at least one embodiment, the first mechanical interface includes locating grooves disposed on an outer surface of the accessory attachment structure, the locating grooves adapted to interface with corresponding locating ribs of the first powered accessory device.

In at least one embodiment, the accessory attachment structure further includes an accessory attachment outer surface facing outward from the helmet outer surface for interfacing with an accessory device, a first sidewall depending from the accessory attachment outer surface toward the helmet outer surface, a second wall depending from the accessory attachment outer surface toward the helmet outer surface, the second sidewall opposing the first sidewall across a width of the accessory attachment structure, wherein the first mechanical interface includes two or more first openings in the first sidewall and two or more second opening in the second sidewall, the first and second openings for engaging with mechanical connection features of the first powered accessory device to locate and attach the first powered accessory to the accessory attachment structure.

In at least one embodiment, the outer shell is formed from a material including carbon fiber.

A third example embodiment according to the technology disclosed herein includes an accessory attachment system that includes an accessory attachment structure configured to be mounted on an outer surface of a helmet. The accessory attachment structure includes an accessory attachment interface. The accessory attachment interface includes an accessory engagement surface for interfacing with an accessory and a first mechanical interface having a first interface cavity that includes a first interface surface for interfacing with a first engagement feature of the accessory, wherein the first interface surface opposes the accessory engagement surface. The accessory attachment interface includes also a second mechanical interface comprising a second interface cavity comprising a second interface surface for interfacing with a second engagement feature of the accessory, the first interface surface opposing the accessory engagement surface.

In some embodiments, the first mechanical interface comprises a first motion limiting surface and a second motion limiting surface. The first and second motion limiting surface are for limiting motion of the accessory along a length of the accessory attachment structure. In some embodiments, each of the first and second motion limiting surfaces depend from the first interface surface toward the outer surface of the helmet.

In some embodiments, the accessory attachment system includes a first accessory with a first attachment feature configured to interface with the first interface cavity and a second attachment feature configured to interface with the second interface cavity. In some further embodiments, the second attachment feature includes an engaged configuration for locking the accessory onto the accessory attachment structure and a disengaged configuration for removing the accessory from the accessory attachment structure.

In some further additional embodiments, the second attachment feature includes an interface feature having an engagement surface, and the engaged configuration includes the engagement surface interfacing with an interface surface of the first mechanical interface for attaching the accessory to the accessory attachment structure. The engagement surface may include a non-planar surface for enabling a break away connection between the accessory attachment structure and the first accessory.

In some embodiments, each of the first accessory and the accessory attachment structure includes a first electrical interface, the accessory includes a second electrical interface, and engaged configuration is for electrically connecting the first electrical interface with the second electrical interface.

In some embodiments, the accessory attachment system further includes a second non-powered accessory and the accessory attachment interface is configured to prevent the second non-powered accessory from attaching to the accessory interface structure.

In some embodiments, the accessory attachment structure includes a second accessory attachment interface and the second accessory attachment interface includes at least one mechanical interface configured for attaching the non-powered accessory to the accessory attachment structure.

A fourth example embodiment according to the technology disclosed herein includes a helmet with an outer shell having an outer surface and an inner surface and at least one helmet layer disposed interior to the outer shell, a helmet electrical conductor disposed between the outer shell and the at one helmet layer, and an accessory attachment structure mounted on an outer surface.

The accessory attachment structure includes an accessory attachment interface and the accessory attachment interface includes an accessory engagement surface for interfacing with an accessory, a first mechanical interface for interfacing with a first engagement feature of the accessory, and a second mechanical interface for interfacing with a second engagement feature of the accessory. The accessory attachment structure also includes a first electrical interface disposed on the accessory engagement surface for electrically connecting with a second electrical interface of the accessory. The first electrical interface is electrically connected to the helmet electrical conductor.

In some further embodiments, the at least one helmet layer comprises a ballistic layer and wherein the helmet electrical conductor is attached to the inner surface of the outer shell.

In some further embodiments, the outer shell forms at least one ridge comprising a ridge cavity disposed between the outer shell inner surface and the at least one helmet layer, further wherein the accessory attachment is disposed on a portion of the outer surface comprising the ridge and the helmet electrical conductor is disposed within the ridge cavity.

In some further embodiments, at least one electrical connector extends from the helmet electrical conductor, through the accessory attachment structure, to the electrical interface to provide electrical power to the electrical interface.

In some further embodiments, the first mechanical interface includes a first interface cavity comprising a first interface surface for interfacing with a first engagement feature of the accessory, the first interface surface opposing the accessory engagement surface, and the second mechanical interface includes a second interface cavity comprising a second interface surface for interfacing with a second engagement feature of the accessory, the first interface surface opposing the accessory engagement surface.

In some further embodiments, the helmet electrical conductor comprises a plurality of individual electrical conductors.

In some further embodiments, the helmet electrical conductor includes a flexible circuit structure that is attached to the inner surface of the outer shell.

In some further embodiments, the helmet further includes a control module. The control module includes a power source and a processor and the helmet electrical conductor is configured to exchange power and communication signals between the control module and first electrical interface.

A fifth example embodiment according to the technology disclosed herein includes an accessory attachment system. The accessory attachment system includes a helmet with an outer shell having an outer surface and an inner surface. A ballistic layer is disposed in contact with inner surface of the outer shell.

The outer shell includes a ridge formed thereupon, the ridge defining a ridge cavity disposed between the inner surface and the ballistic layer. A helmet electrical conductor is disposed within the ridge cavity and is attached to the inner surface of the outer shell.

An accessory attachment structure is mounted on the outer surface of the outer shell, the accessory attachment structure comprising a first accessory attachment interface, and a second accessory attachment interface wherein only the first accessory attachment interface of the first and second accessory attachment interfaces is electrically connected to the helmet electrical conductor, wherein the first accessory interface includes a first mechanical interface configured to exclusively interface with a powered accessory device and the second accessory interface includes a second mechanical interface configured to exclusively interface with a non-powered accessory device.

In some embodiments, the first accessory interface includes first and second accessory interface locating features having a first distance therebetween, the second accessory includes third and fourth locating accessory interface locating features having a second distance therebetween and the first distance is different from the second spacing. The powered device includes first and second accessory device locating features having a third distance therebetween, the third distance corresponds to the first distance.

Embodiments of the helmet system include one or more of detachable side armor plates and a detachable mandible guard. A helmet can include features to mechanically interface with the side armor plates and with the mandible guard. In a particular embodiment, one or more accessory attachment structures include at least one cavity with which a tab of a side armor plate can interface. In this manner, the accessory attachment structures can be used to attach side armor as well as powered or non-powered accessories to the helmet system. In another embodiment, a mandible guard includes mandible attachment features that interface with corresponding mandible interfaces that are disposed on the left and right sides of a helmet. The mandible interfaces are formed with open cavities that face outward on the sides of the helmet and the mandible attachment features are assembled into the mandible interfaces from the sides of the helmet.

The above and other features of the exemplary technology described herein, including various novel details of construction and combinations of parts, and other advantages, will now be more particularly described with reference to the accompanying drawings and pointed out in the claims. It will be understood that the particular method and devices embodying the technology are shown by way of illustration and not as a limitation of the technology. The principles and features of this technology may be employed in various and numerous embodiments without departing from the scope of the technology described herein.

5 BRIEF DESCRIPTION OF THE DRAWINGS

In the accompanying drawings, reference characters refer to the same parts throughout the different views. The drawings are not necessarily to scale; emphasis has instead been placed upon illustrating the principles of the technology. The features of the present disclosure will best be understood from a detailed description of the disclosure and example embodiments thereof selected for the purposes of illustration and shown in the accompanying drawings in which.

FIGS. 3, 4A-C, and 5A-C depict an example powered accessory device, such as a camera or a light.

Figure 6A:
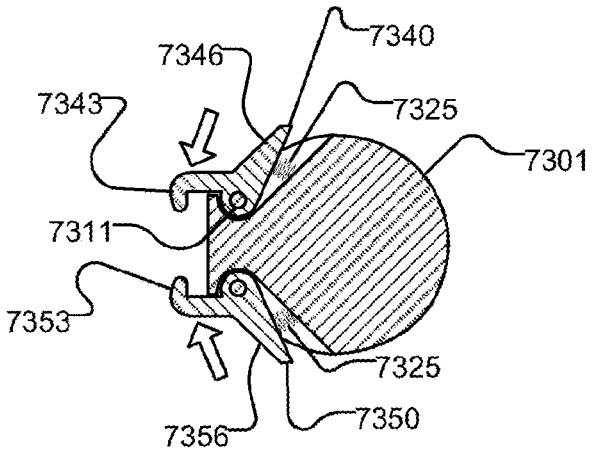
Figure 6B:
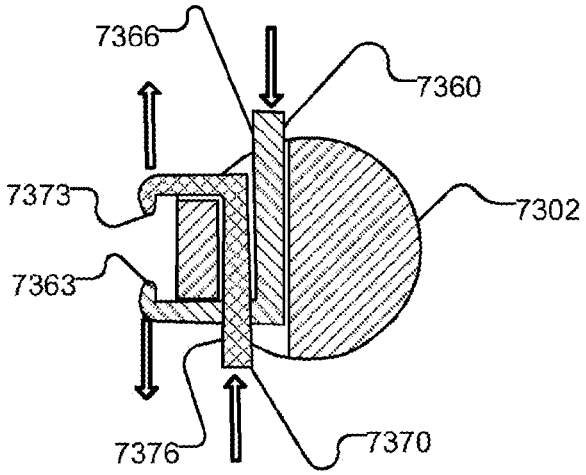

FIGS. 6A and 6B depict exemplary configurations of attachment clips.

FIGS. 7, 8, 9, and 10A-10D depict alternative arrangements for selectively mounting accessories of different device types on accessory attachments that correspond to the device types.

Figure 11:
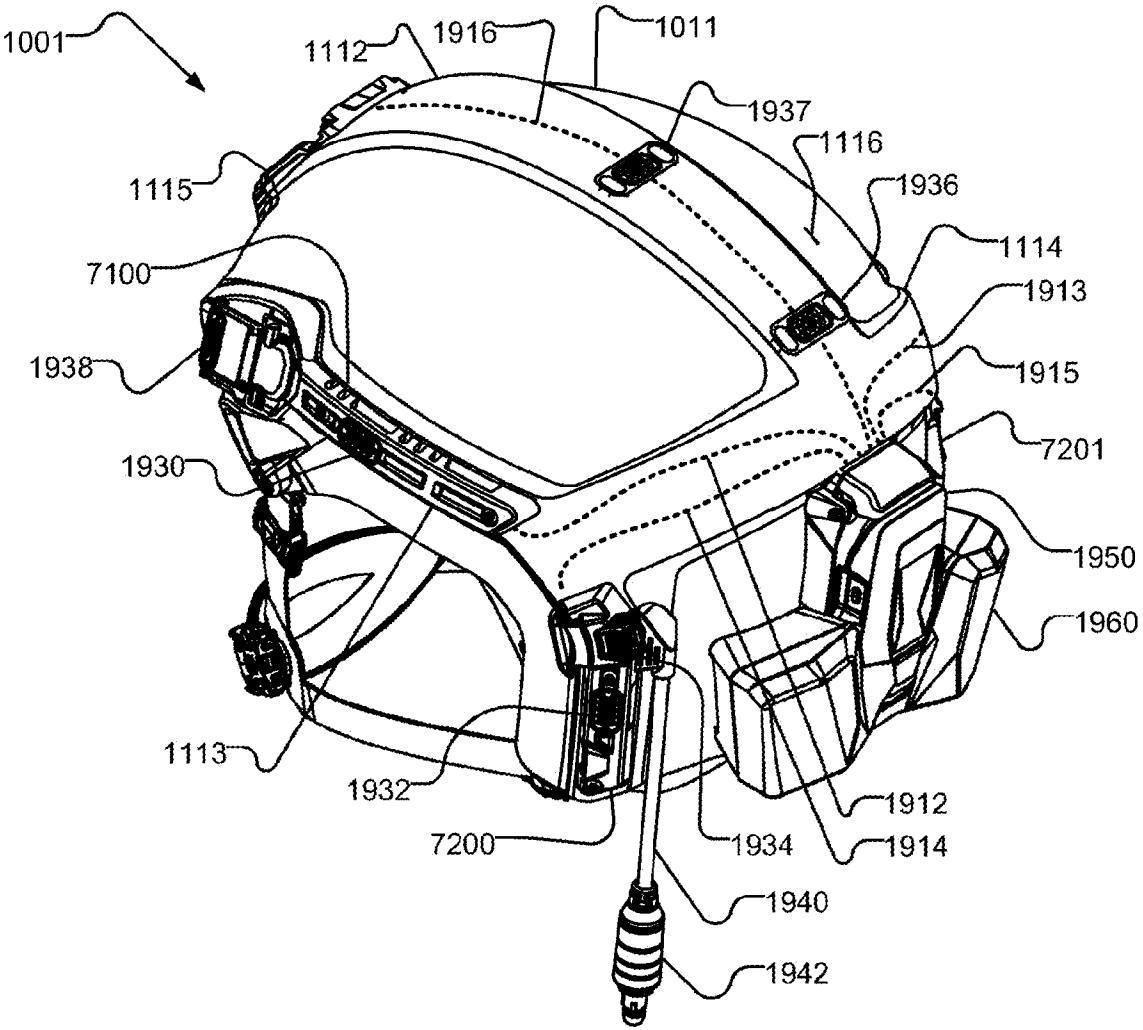

FIG. 11 depicts a rear perspective view of an exemplary embodiment of a helmet system.

Figure 12:
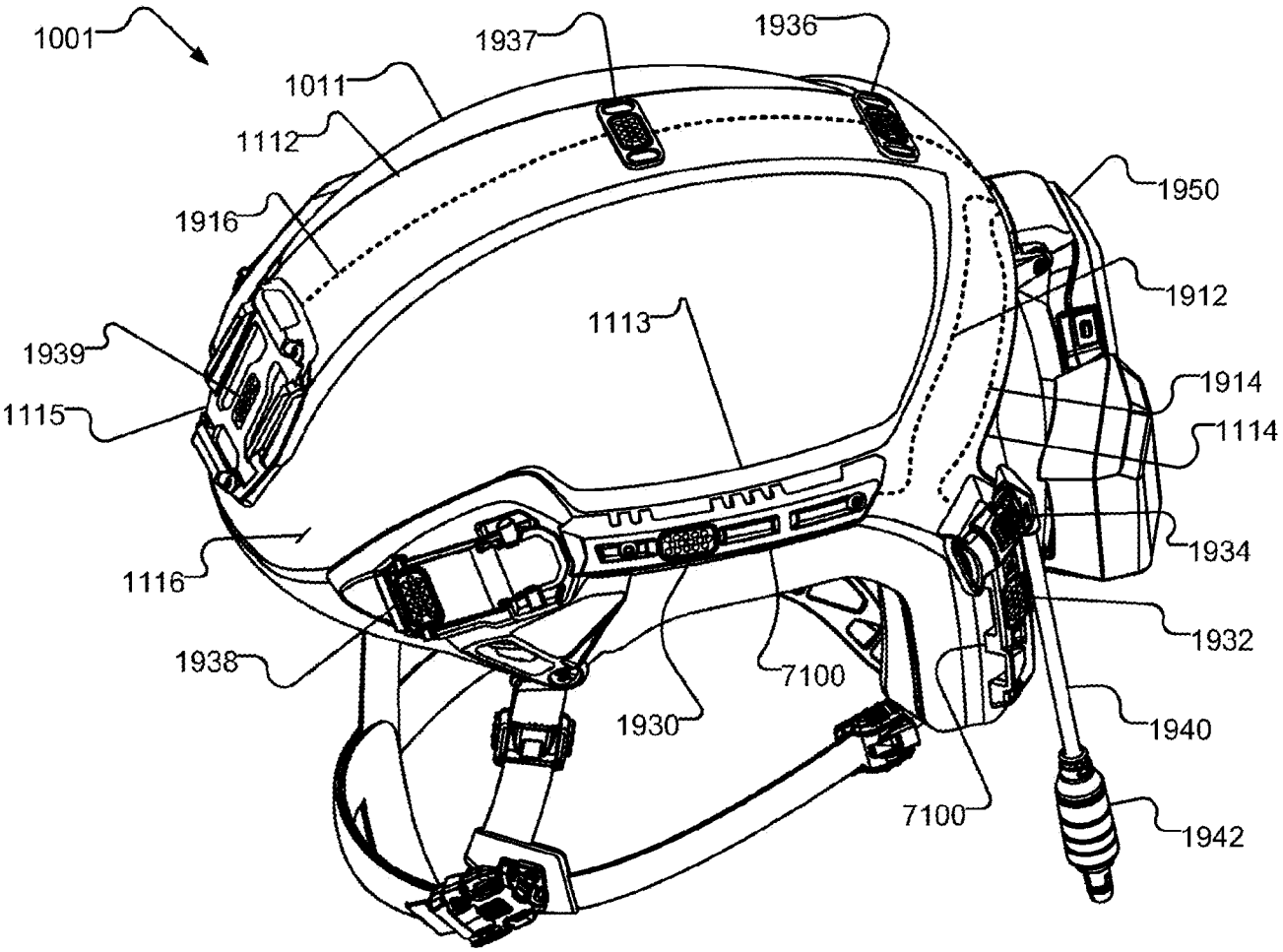

FIG. 12 depicts a top perspective view of the helmet system shown in FIG. 11 according to embodiments herein.

Figure 13:
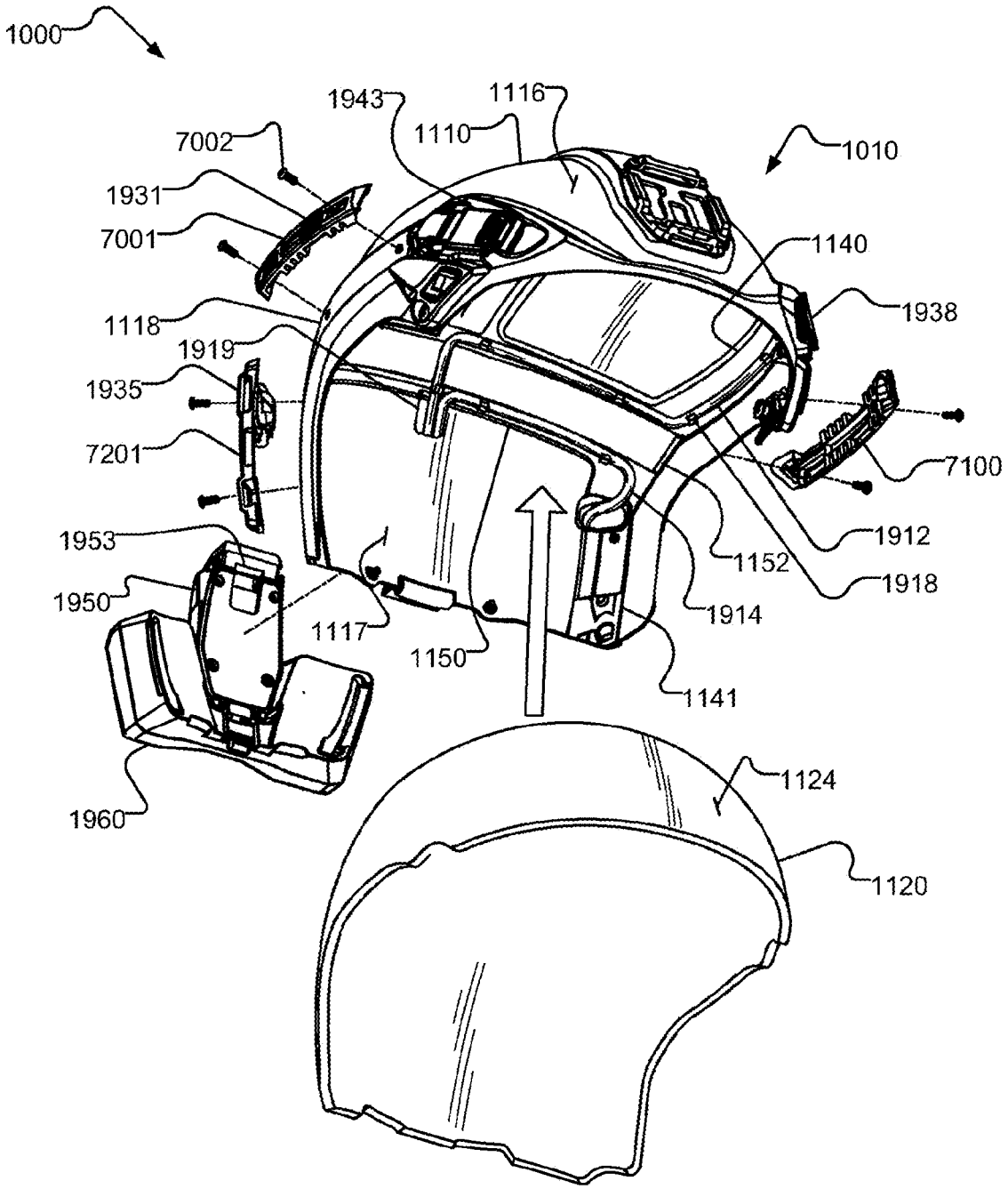

FIG. 13 depicts an exemplary method of assembling electronic components, including wires, accessory attachments, and a rear control module, of a helmet system according to the technology disclosed herein.

Figure 14A:
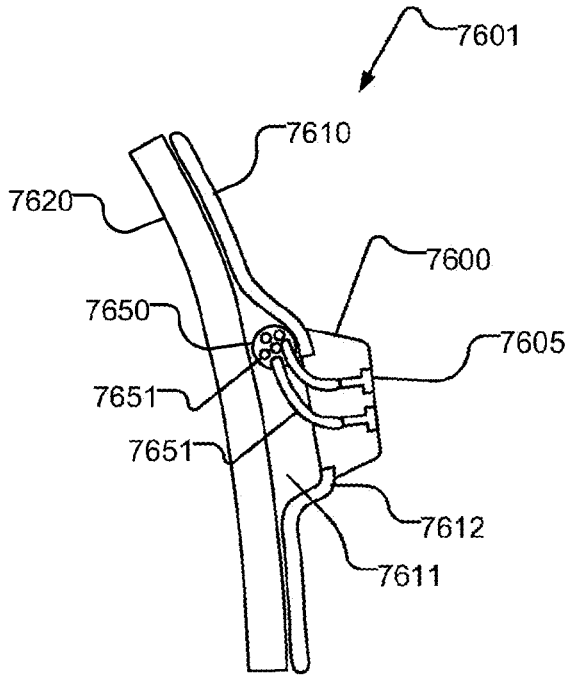
Figure 14B:
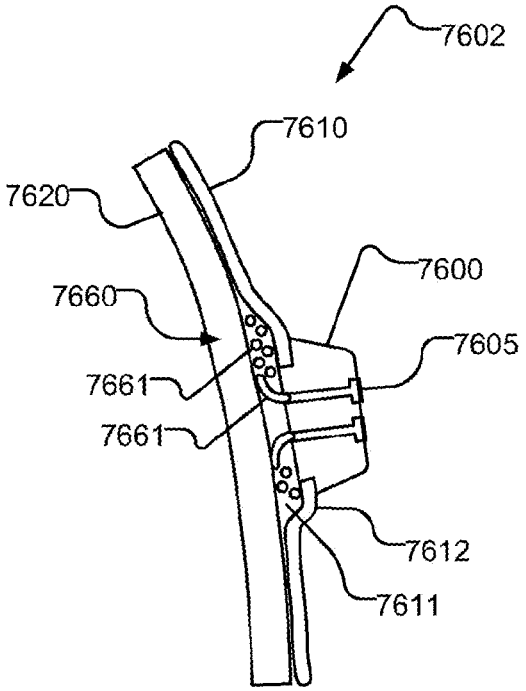
Figure 14C:
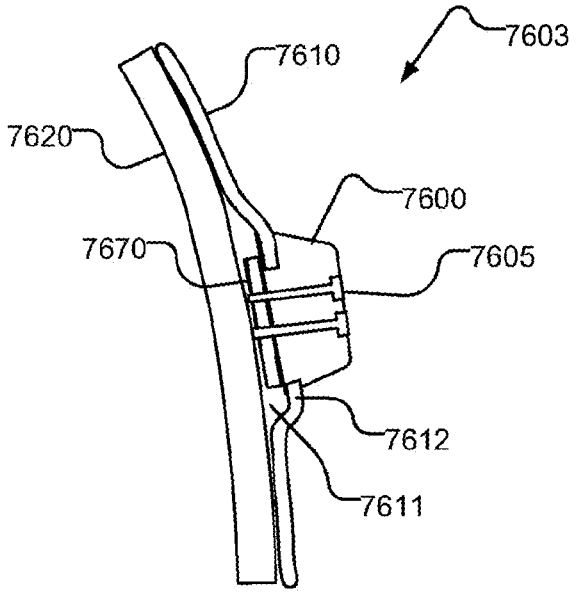

FIGS. 14A, 14B, and 14C depict, in schematic views, three exemplary arrangements of electrical connections between electrical conductors (e.g. cables) and an electrical interface.

FIGS. 15A-15E depict exemplary embodiments of overmolded accessory attachment structures.

Figure 16A:
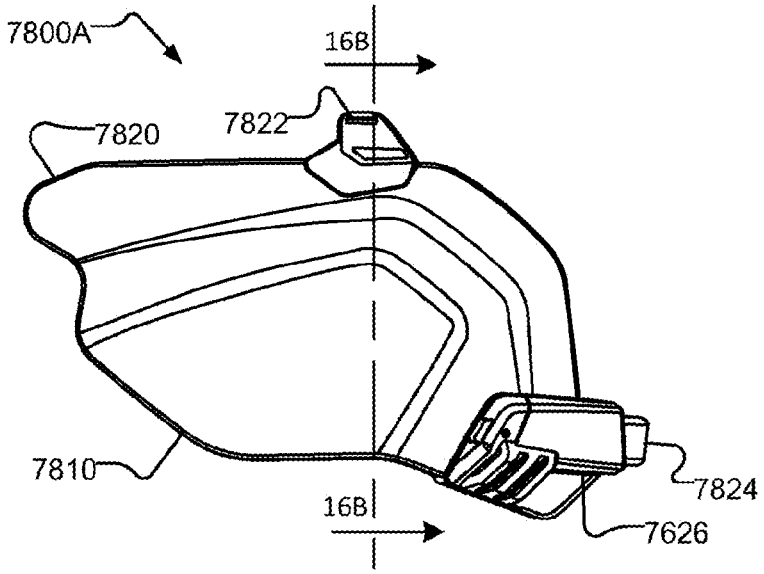
Figure 16B:
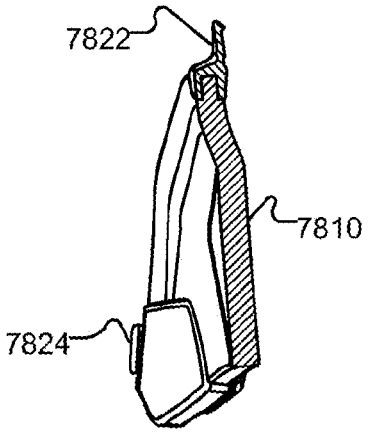

FIGS. 16A and 16B depict a side guard of the helmet system that provides L2 ballistic protection.

Figure 17A:
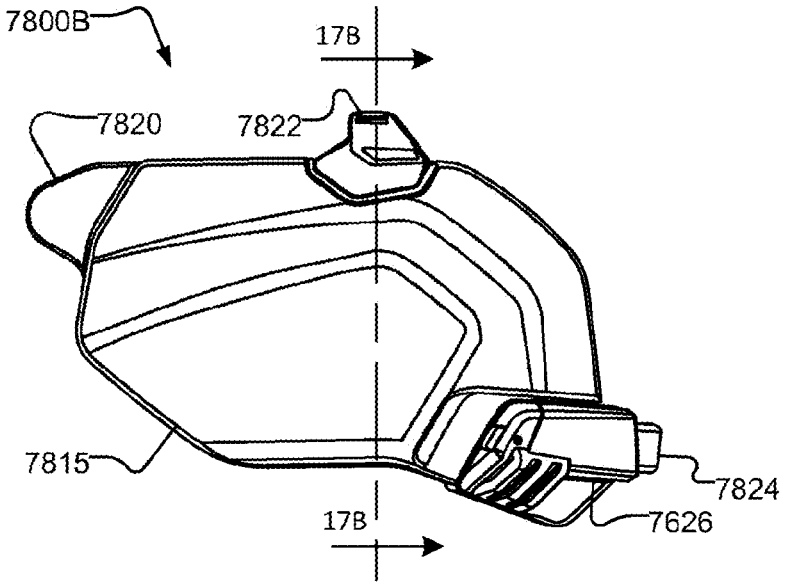
Figure 17B:
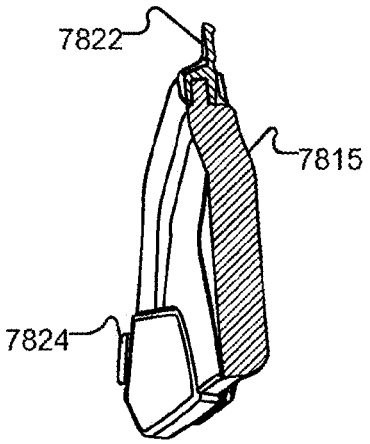

FIGS. 17A and 17B depict a side guard of the helmet system that provides L3 ballistic protection with a stepped construction to maintain a common mounting interface.

Figure 18A:
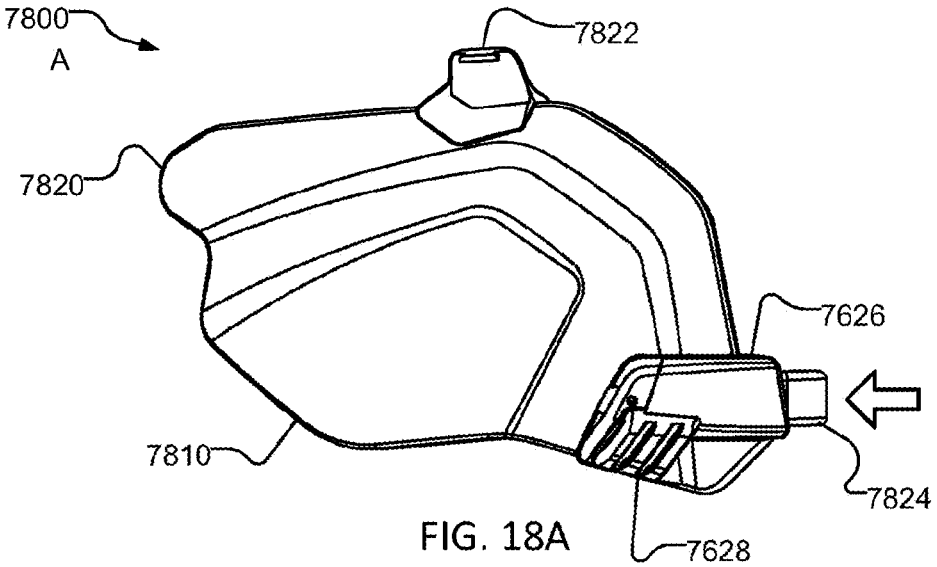
Figure 18B:
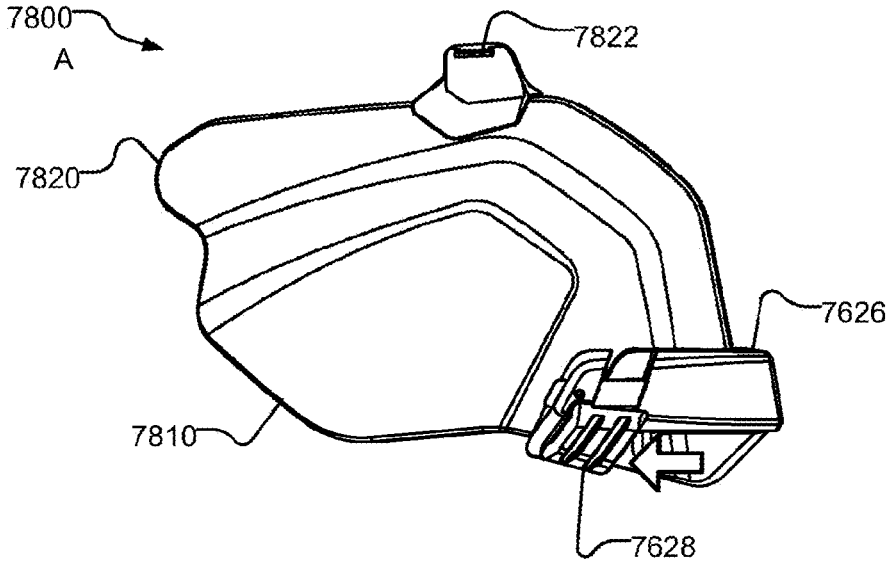

FIGS. 18A and 18B depict the operation of the rear locking tab of the side guard of the helmet system.

Figure 19A:
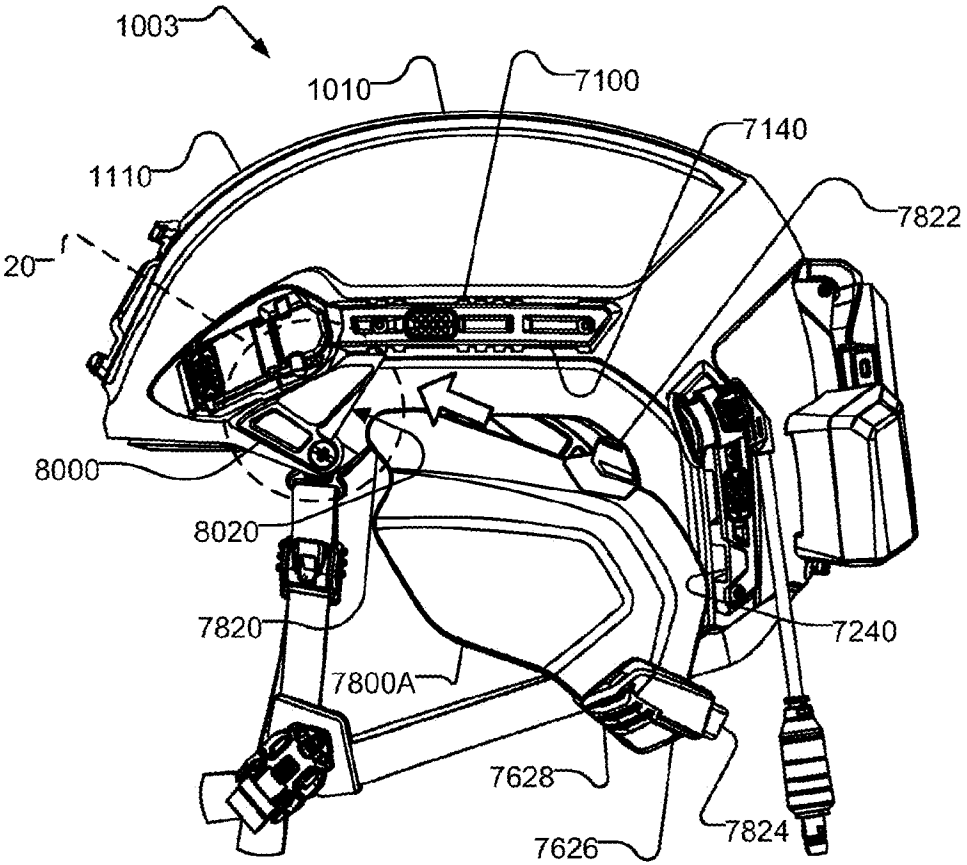
Figure 19B:
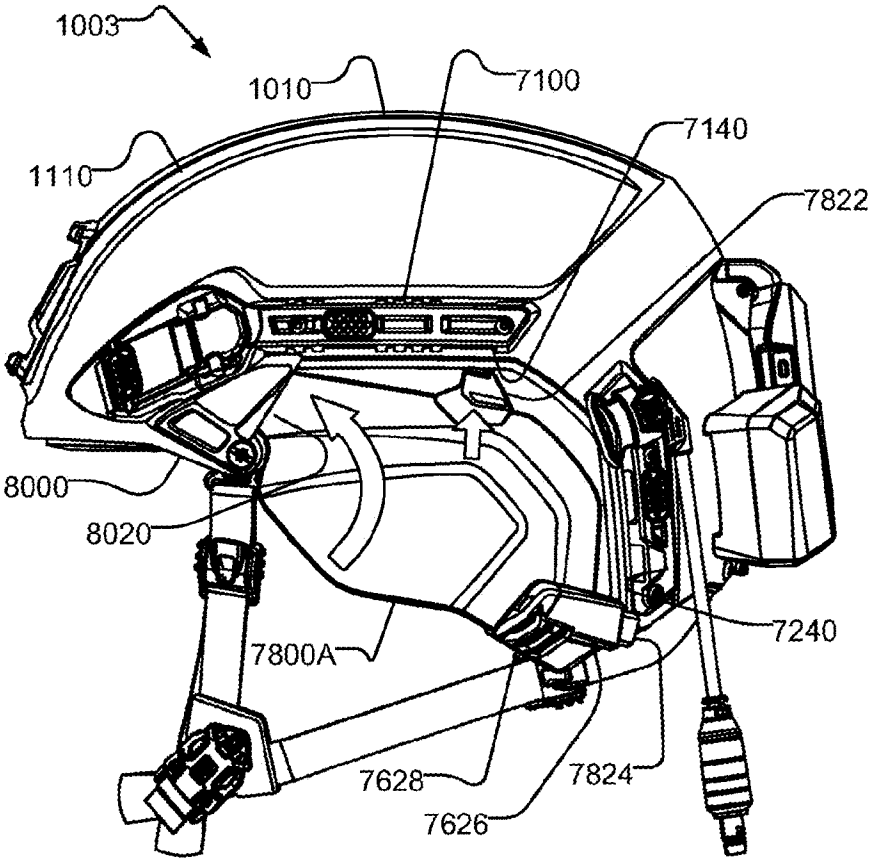
Figure 19C:
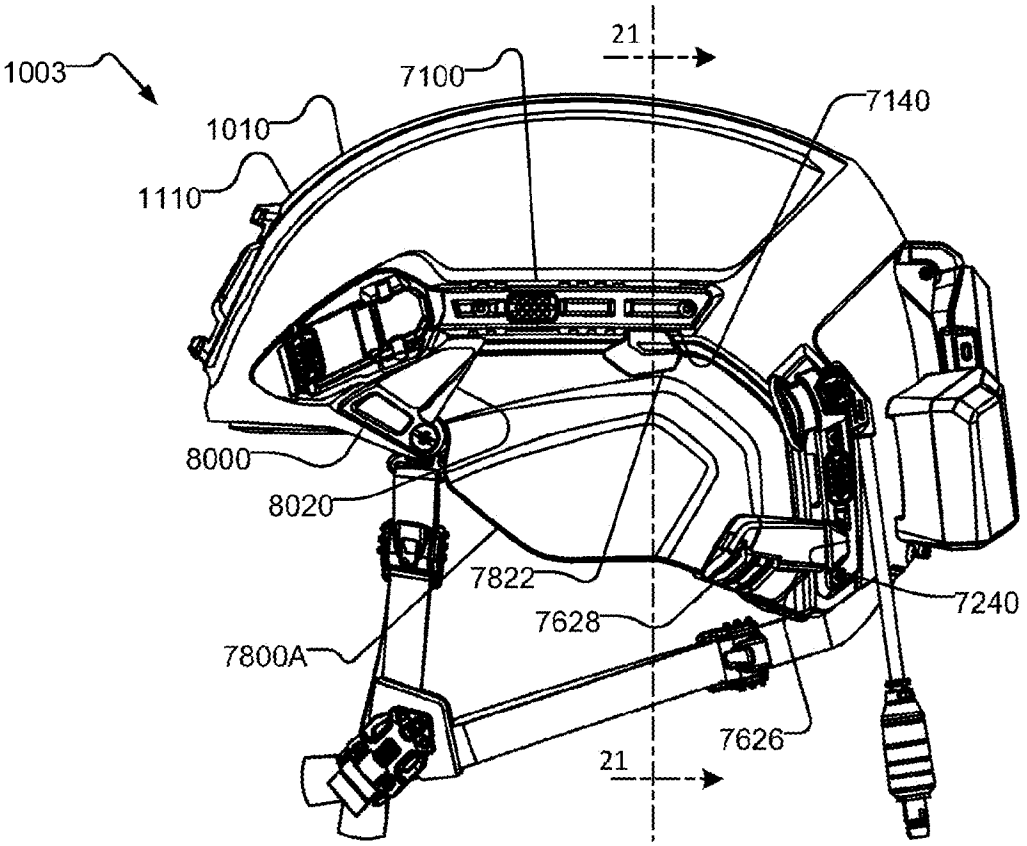

FIGS. 19A, 19B, and 19C depict an exemplary method for attaching a side guard to a helmet.

Figure 20:
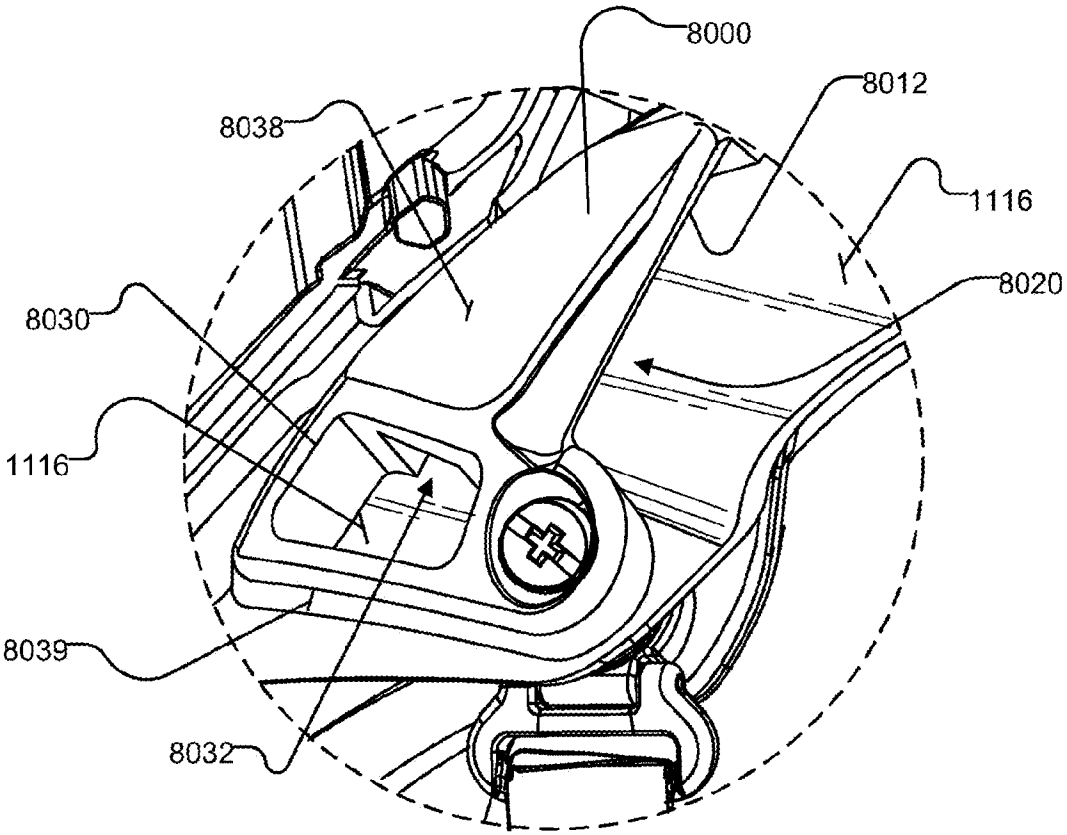

FIG. 20 depicts a detailed view of the front tab of the side guard and the accessory interface hub of the helmet system.

Figure 21:
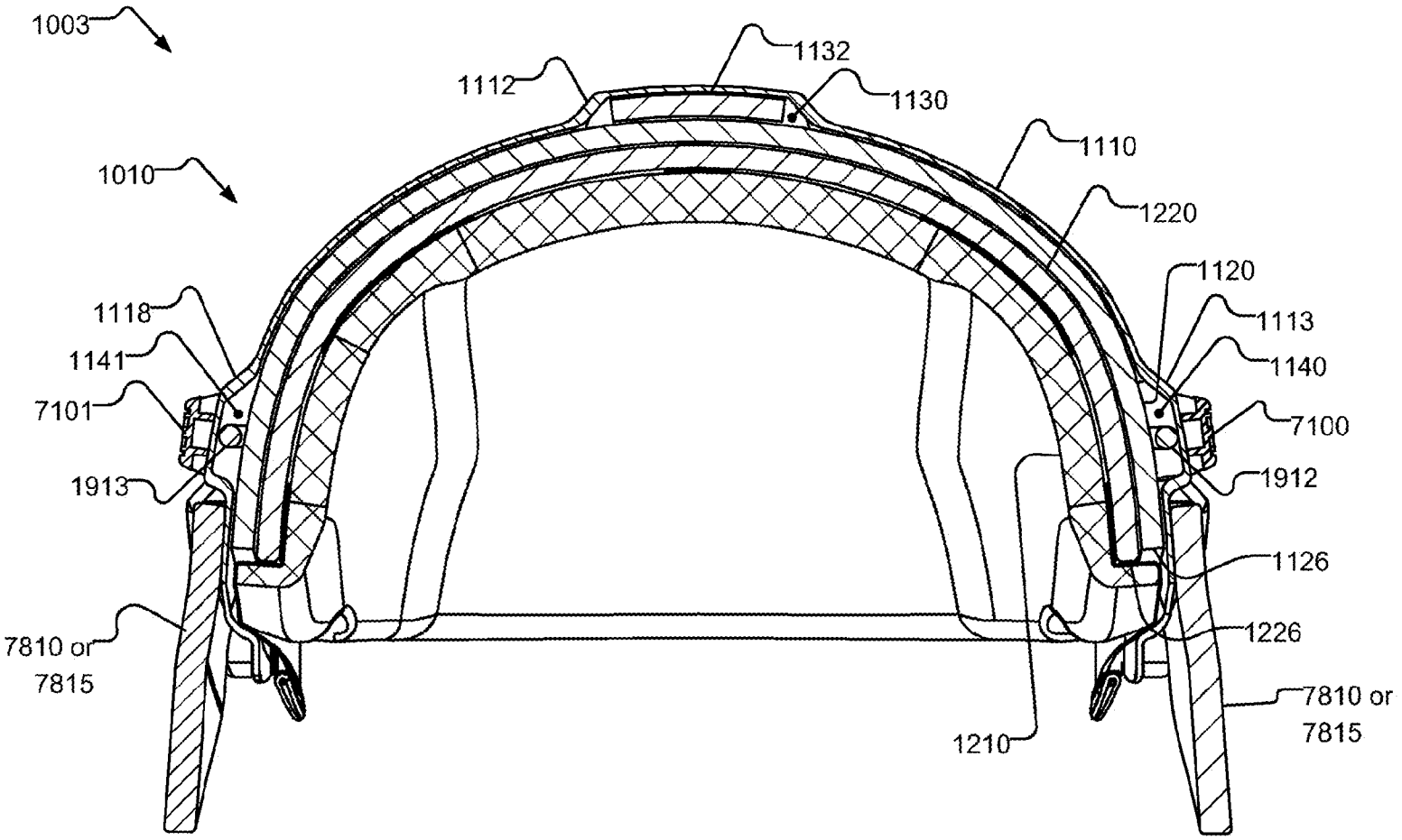

FIG. 21 depicts a cross section view of an exemplary helmet system including overlapping ballistic protection layers.

Figure 22:
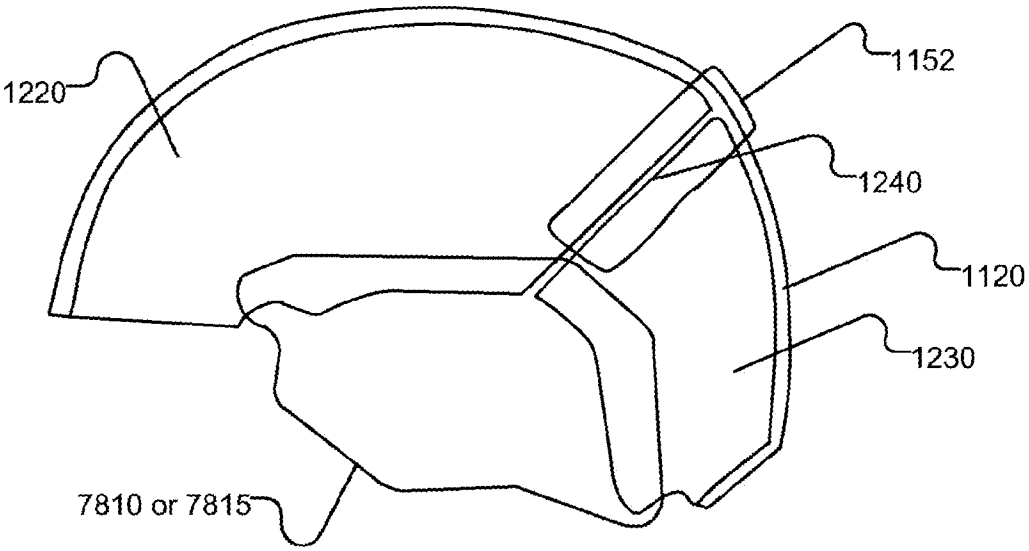

FIG. 22 depicts a side schematic view of layers of ballistic material that are included in an exemplary helmet system.

Figure 23A:
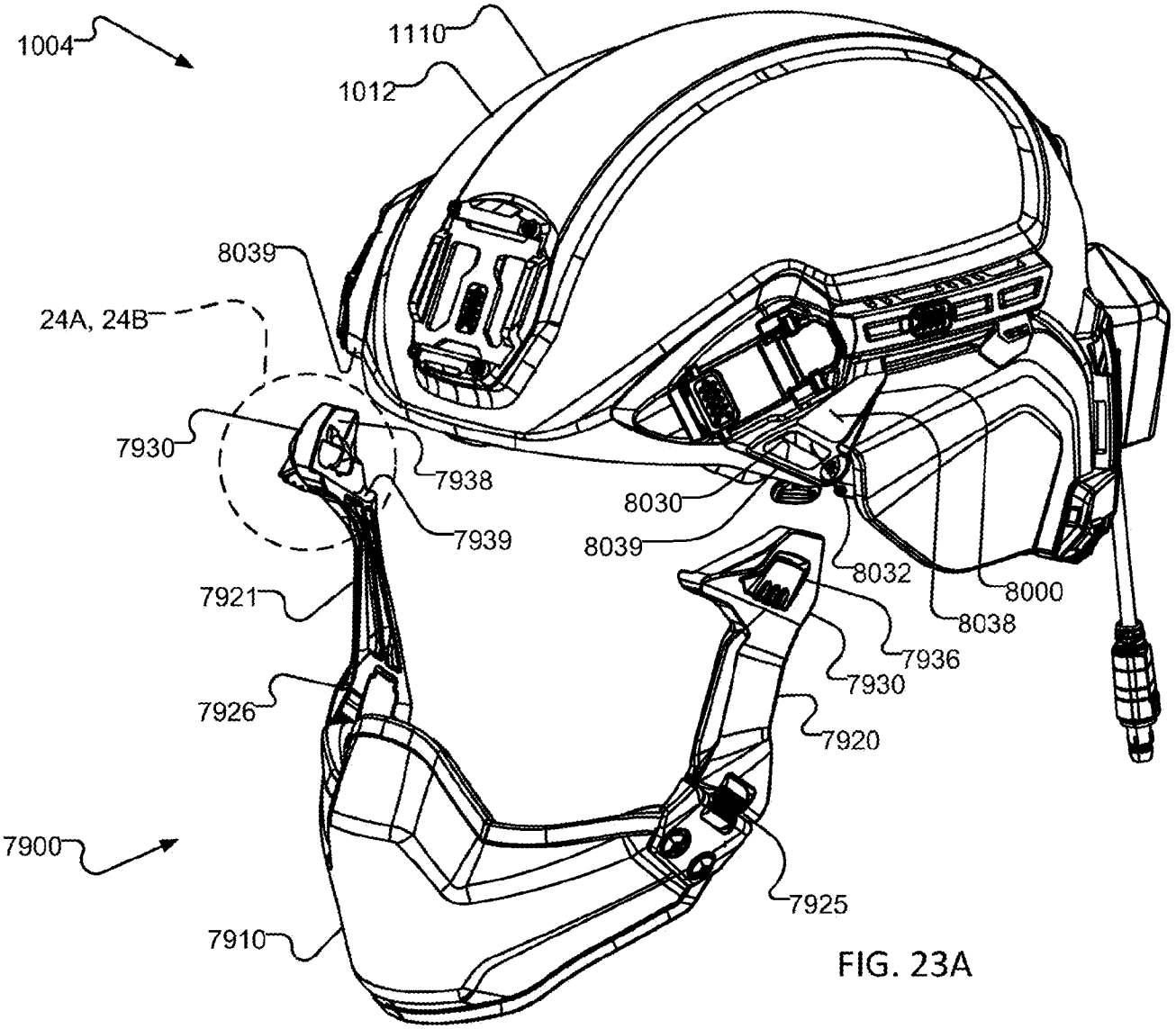

FIG. 23A depicts a front perspective view of an exemplary embodiment of a third helmet system including an exemplary embodiment of a mandible guard.

Figure 23B:
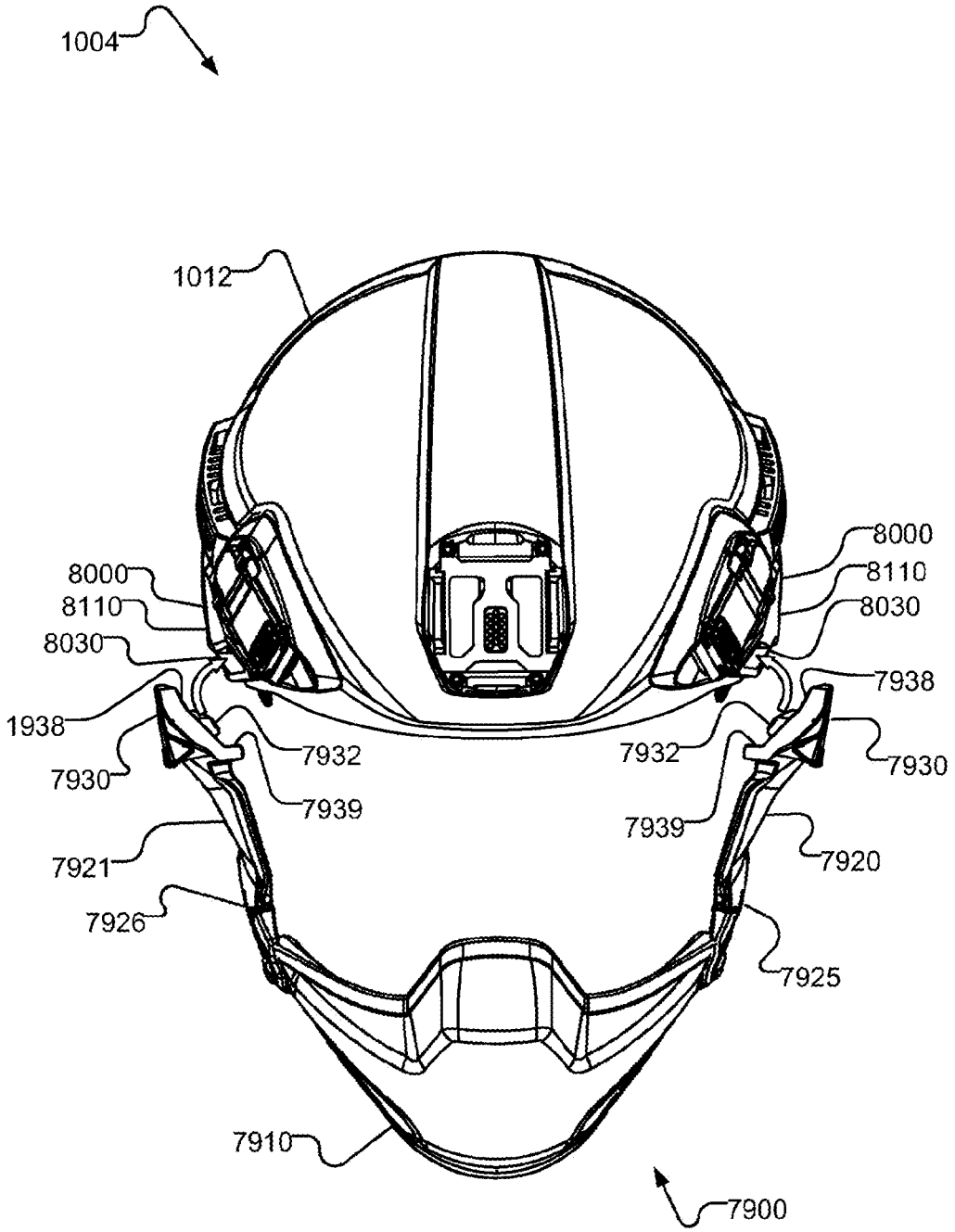

FIG. 23B depicts a front view of the third helmet system shown in FIG. 23A.

Figure 23C:
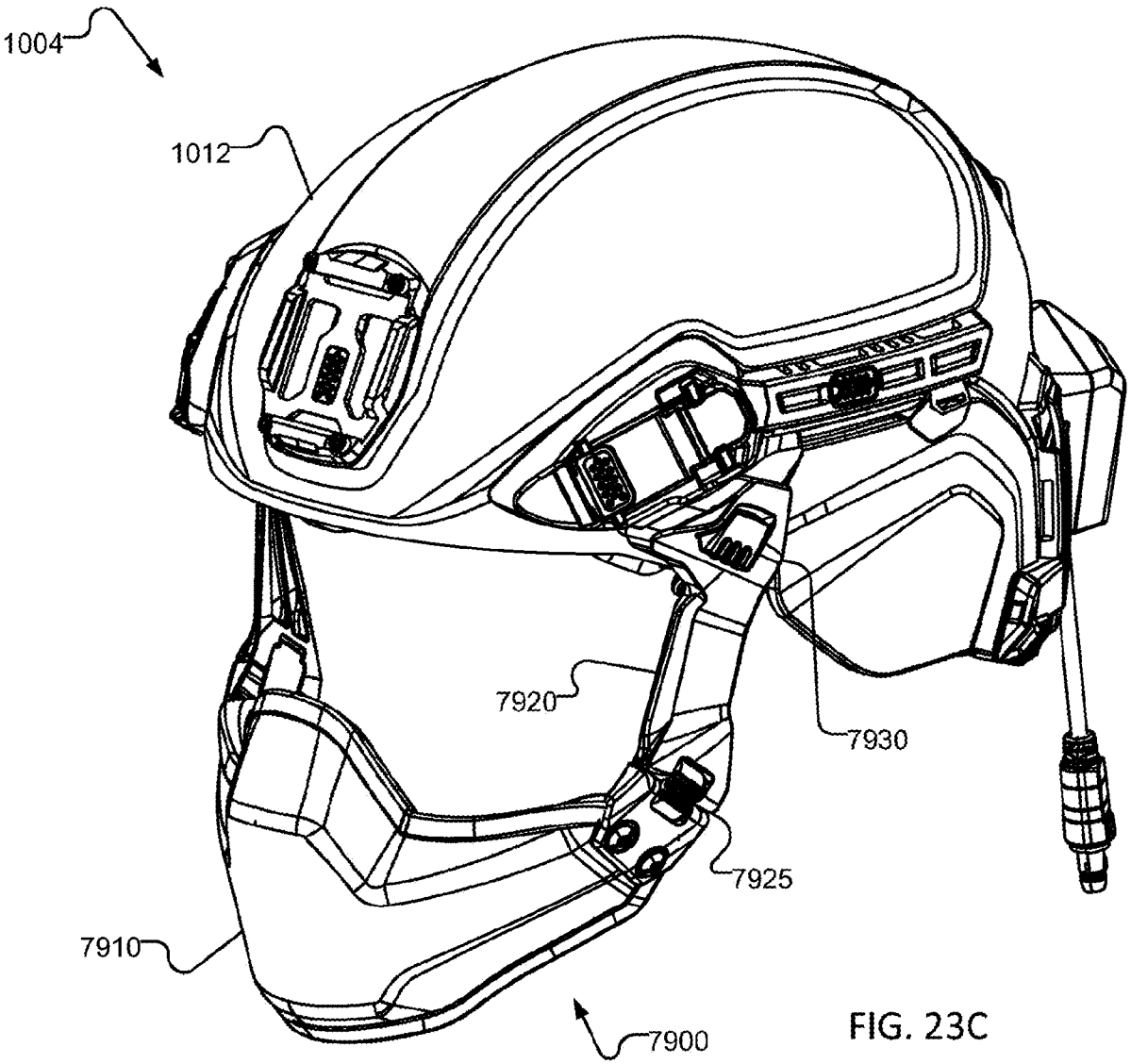

FIG. 23C depicts a front perspective view of the third helmet system shown in FIG. 23A.

Figure 24A:
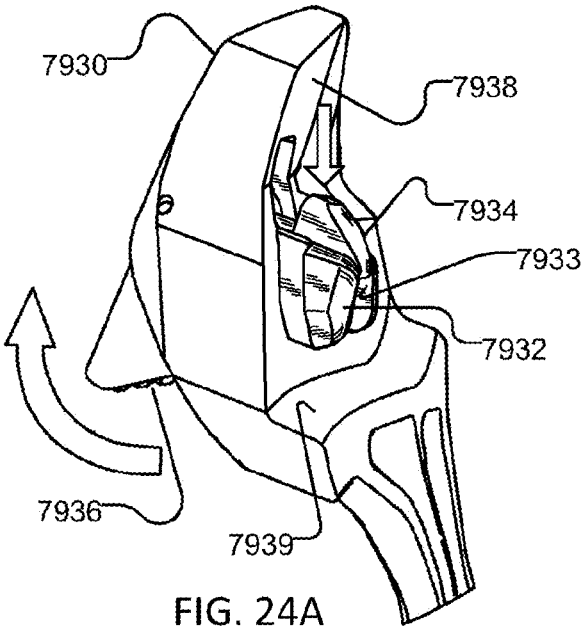
Figure 24B:
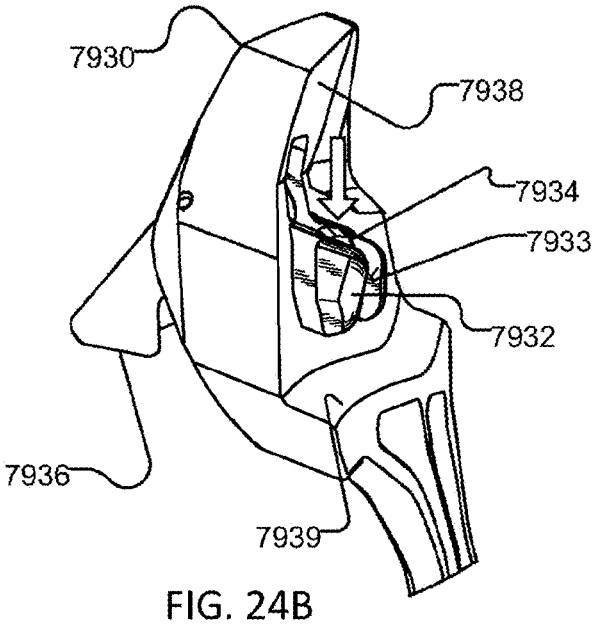

FIGS. 24A and 24B depict a detail perspective view of an exemplary right mandible attachment feature of the mandible guard shown in FIG. 23A.

Figure 25:
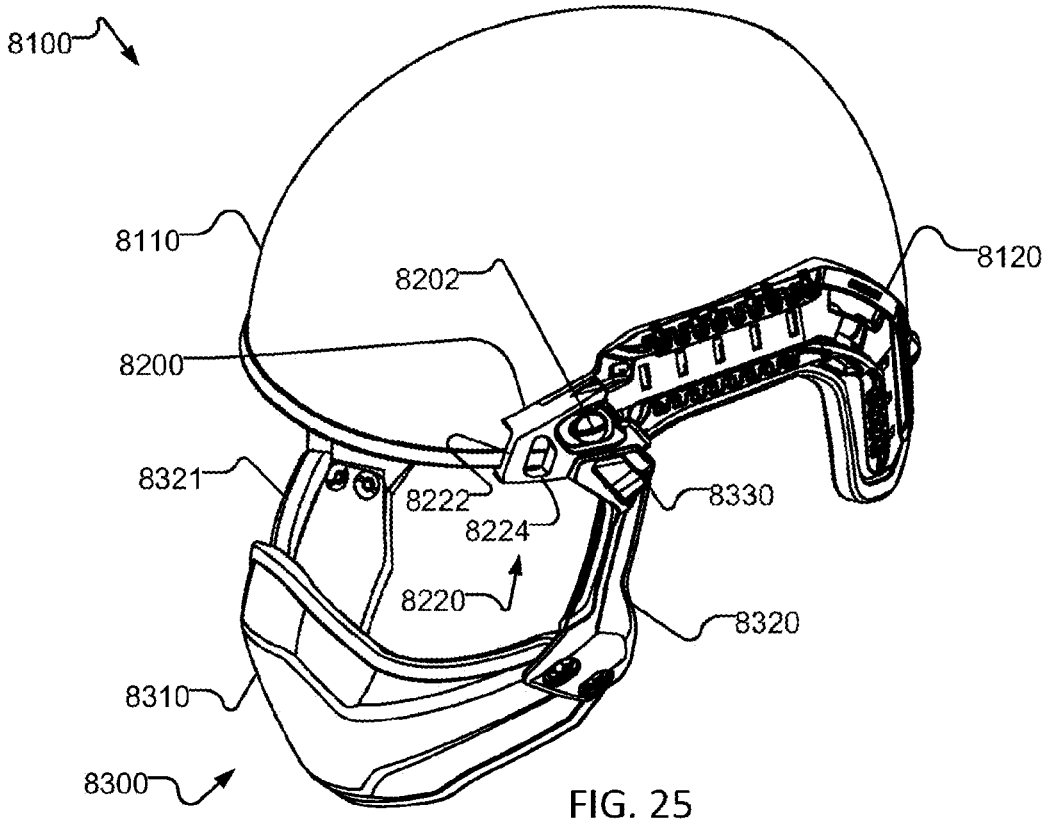
Figure 26:
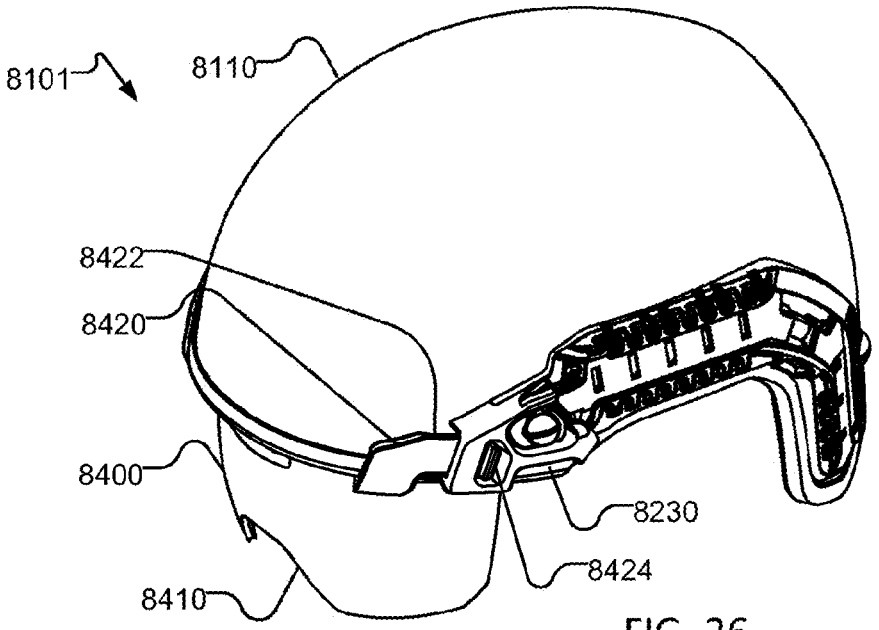

FIGS. 25 and 26 depict an alternate helmet system for attaching mandible guards.

FIGS. 27A, 27B, 27C, 28A, and 28B depict the assembly of a mandible guard connector onto the accessory attachment hub.

Figure 29A:
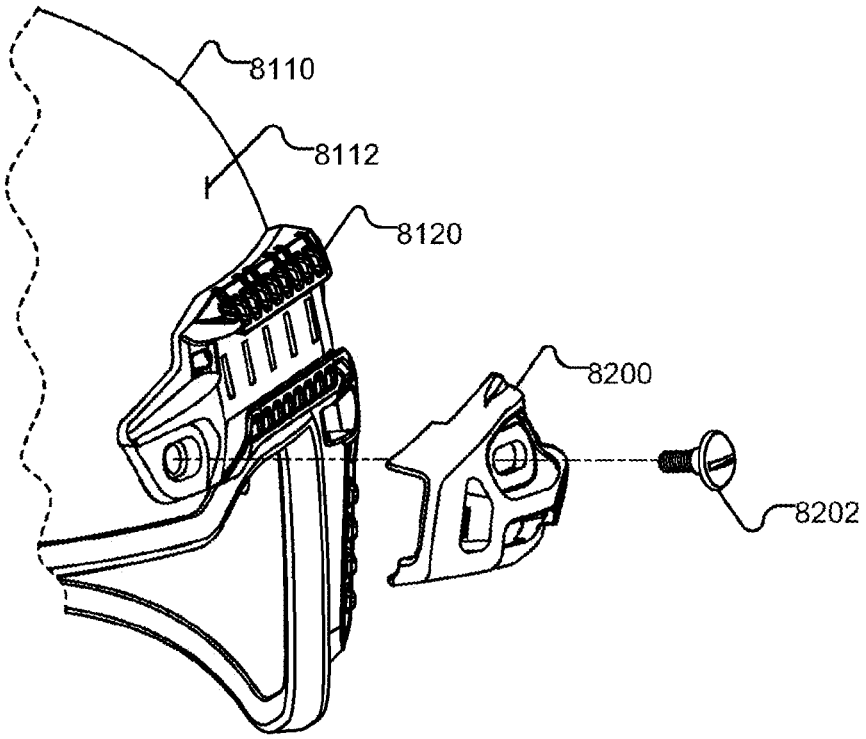
Figure 29B:
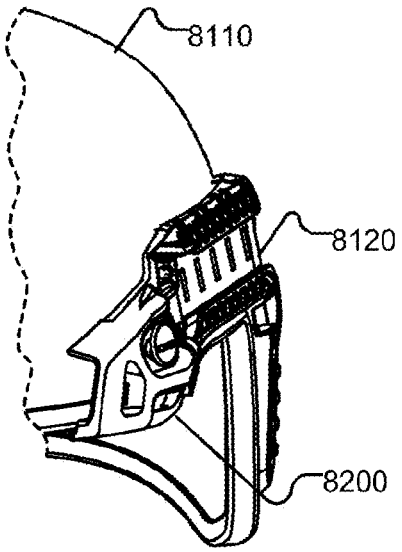
Figure 30:
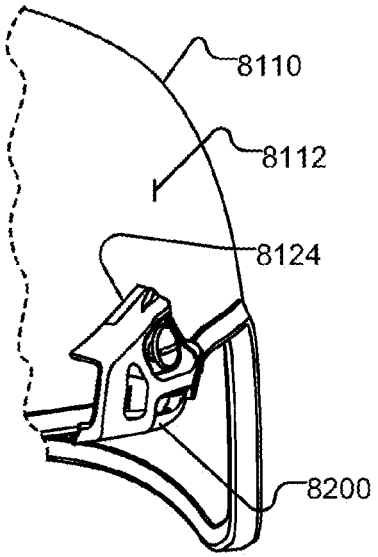

FIGS. 29A, 29B, and 30 depict the removable attachment of an accessory attachment hub to a helmet.

Figure 31:
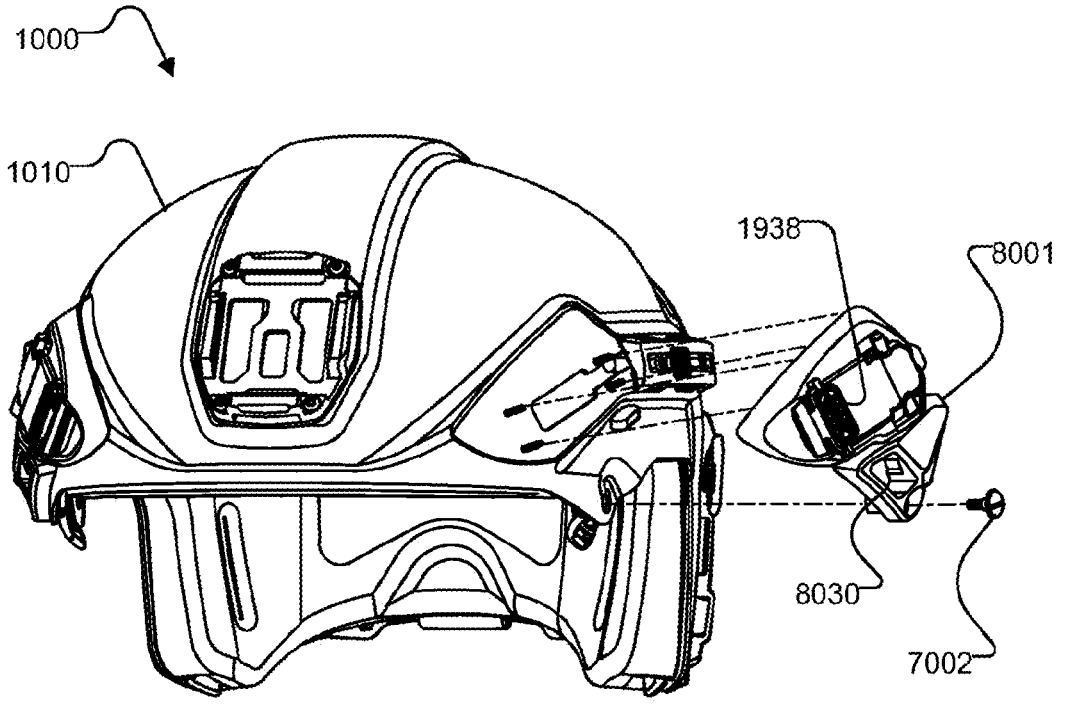

FIG. 31 depicts the removable attachment of an alternate accessory attachment hub to a helmet.

Figure 32A:
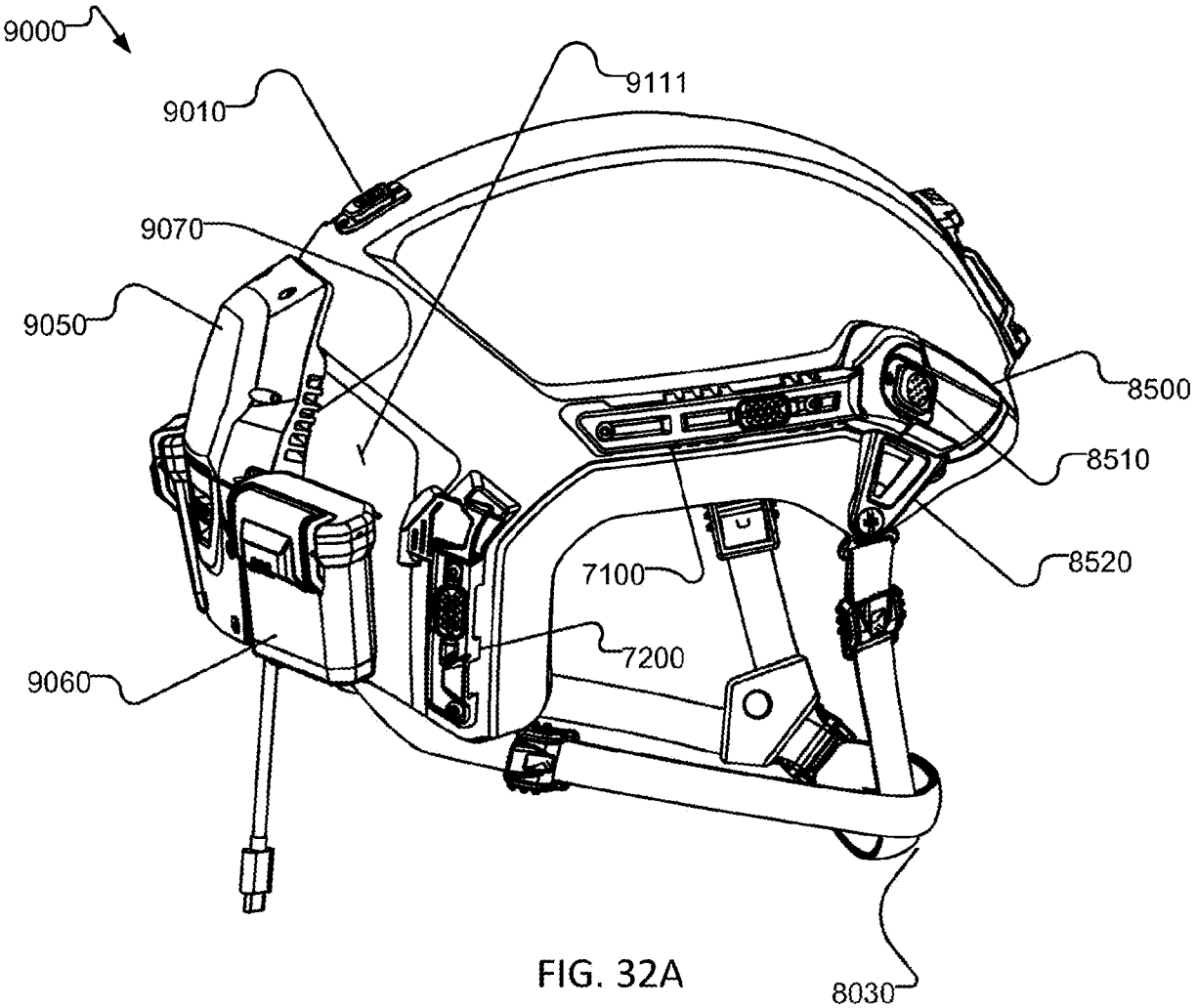
Figure 32B:
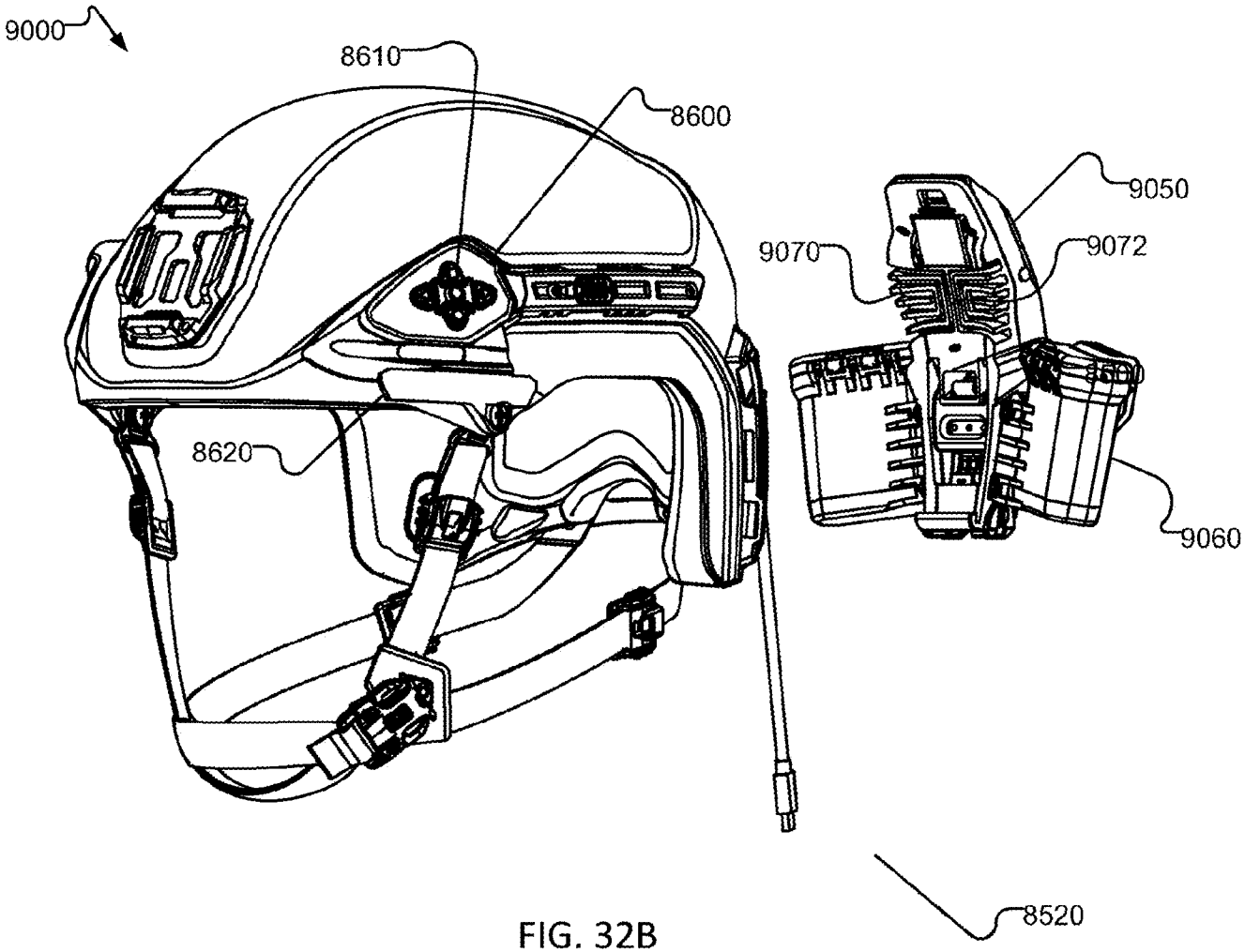

FIGS. 32A and 32B depict an example embodiment of another helmet system according to the technology disclosed herein.

FIGS. 33A-33D depict an arrangement and method for attaching a battery module to a rear control module of the helmet system.

6 DETAILED DESCRIPTION

6.1 Item Number List

| # | DESCRIPTION |
|---|---|
| 1001 | Second helmet system (cable variations) |
| 1000 | Helmet system |
| 1003 | Third helmet system (side guards) |
| 1004 | Fourth helmet system (mandible guards) |
| 1010 | Helmet |
| 1011 | Helmet |
| 1012 | Helmet |
| 1110 | Outer shell |
| 1112 | Top ridge |
| 1113 | Side ridge |
| 1114 | Rear ridge |
| 1115 | Front mount |

-continued

| # | DESCRIPTION |
|---|---|
| 1116 | Outer shell outer surface |
| 1117 | Outer shell inner surface |
| 1118 | Side ridge |
| 1120 | First ballistic layer |
| 1122 | First ballistic layer inner surface |
| 1124 | First ballistic layer outer surface |
| 1126 | Bottom edge of first ballistic layer |
| 1130 | Top ridge cavity |
| 1132 | Top fill layer |
| 1140 | Side ridge front cavity |
| 1141 | Side ridge rear cavity |
| 1142 | Side ridge fill layer |
| 1150 | Rear ridge cavity |
| 1152 | Rear ridge fill layer |
| 1210 | Liner layer |
| 1220 | Front functional layer |
| 1226 | Bottom edge of front functional layer |
| 1230 | Rear functional layer |
| 1240 | Gap between functional layers |
| 1710 | Harness |
| 1720 | Fit system |
| 1912 | Left side cable |
| 1913 | Right side cable |
| 1914 | Left rear cable |
| 1915 | Right rear cable |
| 1916 | Top cable |
| 1918 | Cable clip |
| 1919 | Rear control module interface aperture |
| 1930 | Left side electrical interface |
| 1931 | Right side electrical interface |
| 1932 | Left rear electrical interface |
| 1934 | Left cable electrical interface |
| 1935 | Right cable electrical interface |
| 1936 | First top electrical interface |
| 1937 | Second top electrical interface |
| 1938 | Vision system interface (left) |
| 1939 | Front mount electrical interface |
| 1940 | Cable |
| 1942 | Cable plug |
| 1943 | Vision system interface (right) |
| 1950 | Rear control module |
| 1952 | First locating interface feature |
| 1953 | Rear control module electrical interface |
| 1954 | Second interface feature |
| 1960 | Battery module |
| 1962 | Locating engagement feature |
| 1964 | Lockable engagement feature |
| 7002 | Fastener |
| 7003 | Outer surface (of side accessory attachment) |
| 7005 | Top surface |
| 7007 | Bottom surface |
| 7100 | Left side accessory attachment structure |
| 7101 | Right side accessory attachment structure |
| 7105 | Powered accessory interface |
| 7107 | Non- powered accessory interface |
| 7110 | First mechanical interface |
| 7112 | First side wall |
| 7114 | Second side wall |
| 7113 | Rear wall |
| 7116 | Top wall |
| 7200 | Rear accessory attachment structure |
| 7120 | Second mechanical interface |
| 7122 | First side wall |
| 7124 | Second side wall |
| 7123 | Rear wall |
| 7126 | Top wall |
| 7130 | First mechanical interface |
| 7140 | Second mechanical interface |
| 7150 | Divot |
| 7152 | Divot |

-continued

| # | DESCRIPTION |
|---|---|
| 7160 | Accessory interface cavity |
| 7200 | Left rear accessory attachment structure |
| 7201 | Right rear accessory attachment structure |
| 7203 | Outer surface |
| 7205 | Powered accessory interface |
| 7210 | First rear mechanical interface |
| 7220 | Second rear mechanical interface |
| 7240 | Accessory mechanical interface (cavity) |
| 7300 | Powered accessory device |
| 7301 | First alternative accessory |
| 7302 | Second alternative accessory |
| 7305 | Powered accessory connection features |
| 7310 | Fixed hook |
| 7311 | Fixed axis |
| 7313 | Engagement feature |
| 7320 | Clip |
| 7323 | Engagement feature |
| 7325 | Biasing element (spring) |
| 7326 | Clip actuator |
| 7340 | Rotating clip |
| 7341 | Fixed axis |
| 7343 | Engagement feature |
| 7350 | Rotating clip |
| 7351 | Fixed axis |
| 7353 | Engagement feature |
| 7360 | Sliding clip |
| 7363 | Engagement feature |
| 7366 | Actuator |
| 7370 | Sliding clip |
| 7373 | Engagement feature |
| 7376 | Actuator |
| 7400 | Accessory attachment structure |
| 7401 | Assembled accessory attachment structure and accessory |
| 7403 | Top surface |
| 7405 | Powered accessory attachment |
| 7407 | Non-powered accessory attachment |
| 7442 | Locating groove (for powered accessory) |
| 7443 | Locating groove (for powered accessory) |
| 7444 | Locating groove (for powered accessory) |
| 7445 | Locating groove (for powered accessory) |
| 7452 | Locating groove |
| 7453 | Locating groove |
| 7454 | Locating groove |
| 7455 | Locating groove |
| 7460 | Accessory interface cavity |
| 7462 | Electrical connector |
| 7500 | Push-on accessory |
| 7505 | Electrical interface |
| 7510 | Clip |
| 7511 | Fixed axis |
| 7513 | Interface feature |
| 7516 | Actuator |
| 7520 | Clip |
| 7521 | Fixed axis |
| 7523 | Interface feature |
| 7525 | Biasing member |
| 7526 | Actuator |
| 7535 | Contact pins |
| 7537 | Gasket |
| 7542 | Locating rib |
| 7543 | Locating rib |
| 7544 | Locating rib |
| 7545 | Locating rib |
| 7560 | Mounting and control box |
| 7562 | Control buttons |
| 7570 | Semi-rigid cable |
| 7580 | Illuminator housing |

-continued

| # | DESCRIPTION |
|---|---|
| 7582 | Lights |
| 7600 | Electrical interface structure |
| 7601 | Electrical connections |
| 7602 | Electrical connections |
| 7603 | Electrical connections |
| 7605 | Electrically conductive terminals (electrical contact) |
| 7610 | Helmet outer enclosure |
| 7611 | Ridge cavity |
| 7612 | Ridge |
| 7620 | Inner layer |
| 7650 | Electrical conductor (cable) |
| 7651 | Multiple conductive elements |
| 7660 | Electrical conductor (ribbon cable) |
| 7661 | Multiple conductive elements |
| 7670 | Circuit structure |
| 7700 | Accessory attachment structures |
| 7701 | First arrangement - attachment structure overmolded on a cable |
| 7702 | Second arrangement - attachment structure overmolded on a ribbon cable |
| 7703 | Third arrangement - attachment structure overmolded on a rigid flex circuit |
| 7705 | Electrical interface |
| 7706 | Accessory interface |
| 7708 | Accessory interface |
| 7710 | Outer enclosure |
| 7711 | Ridge cavity |
| 7712 | Ridge |
| 7715 | Cutout |
| 7716 | Outer surface |
| 7800A | Side guard (L2 ballistic protection) |
| 7800B | Side guard (L3 ballistic protection) |
| 7810 | Ballistic component (L2) |
| 7815 | Ballistic component (L3) |
| 7820 | Front tab |
| 7822 | Upper tab |
| 7824 | Rear locking tab |
| 7826 | Rear locking tab housing |
| 7828 | Rear locking tab actuator |
| 7900 | Mandible guard assembly |
| 7910 | Mandible guard |
| 7920 | Left arm |
| 7921 | Right arm |
| 7925 | Left hinge |
| 7926 | Right hinge |
| 7930 | Mandible connector |
| 7932 | Engagement boss |
| 7934 | Mandible locking tooth |
| 7936 | Mandible actuator |
| 7938 | First connector surface |
| 7939 | Second connector surface |
| 8000 | Accessory interface hub |
| 8001 | Accessory attachment hub |
| 8012 | Bottom surface (of accessory interface hub) |
| 8020 | Front tab interface |
| 8030 | Mandible interface |
| 8032 | Locking tooth receptacle |
| 8038 | First attachment hub surface |
| 8039 | Second attachment hub surface |
| 8100 | Helmet system |
| 8101 | Helmet system |
| 8110 | Helmet |
| 8114 | Bottom edge of helmet |
| 8120 | Rail |
| 8124 | Spacer |
| 8200 | Accessory attachment hub |
| 8202 | Fastener |
| 8220 | Front accessory attachment interface |
| 8222 | First interface receptable |

-continued

| # | DESCRIPTION |
|---|---|
| 8224 | Second interface receptable |
| 8230 | Mandible guard interface |
| 8232 | Top surface |
| 8233 | Cavity walls |
| 8237 | Attachment feature |
| 8300 | Mandible guard assembly |
| 8310 | Mandible guard |
| 8320 | Left attachment arm |
| 8321 | Right attachment arm |
| 8330 | Mandible guard connector |
| 8331 | Biasing element |
| 8335 | Clip |
| 8336 | Actuator |
| 8337 | Engagement feature |
| 8400 | Visor |
| 8410 | Visor lens |
| 8420 | Visor connector |
| 8422 | Rearward extending arm |
| 8424 | Visor engagement feature |
| 8500 | Accessory attachment hub |
| 8510 | Electro-mechanical interface |
| 8520 | Mechanical interface |
| 8600 | Accessory attachment hub |
| 8610 | Keypad |
| 8620 | Mounting interface |
| 9000 | Helmet system |
| 9050 | Rear control module |
| 9070 | Heat dissipating fins |
| 9111 | Helmet surface |

6.2 Definitions

The following definitions are used throughout, unless specifically indicated otherwise:

| TERM | DEFINITION |
|---|---|
| Ballistic layer | A ballistic layer is ballistic-resistant: for example, a layer that is resistant to penetration by ballistic bodies. Ballistic layers include a first ballistic layer, ballistic ridge fill materials, and functional layers that provide ballistic protection. Ballistic layers include one or more material(s) for providing protection from penetration by projectiles: for example, bullets, shrapnel, and other fragments. Non-limiting example ballistic layers materials include ultra-high molecular weight polyethylene (UHMWPE), Aramid, and, in some embodiments, UHMWPE combined with one or more of carbon fiber and Aramid. A ballistic layer can be manufactured using a known forming process. Non-limiting example ballistic layer manufacturing methods include match metal pressing, compression molding autoclave, and filament winding. |

The disclosure now will be described more fully hereinafter with reference to the accompanying drawings, in which illustrative embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art.

As used herein, the term "and/or" includes any and all combinations of one or more of the associated listed items. Further, the singular forms of the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence of addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

6.2.1 Accessory Attachment Structures

Figure 1:
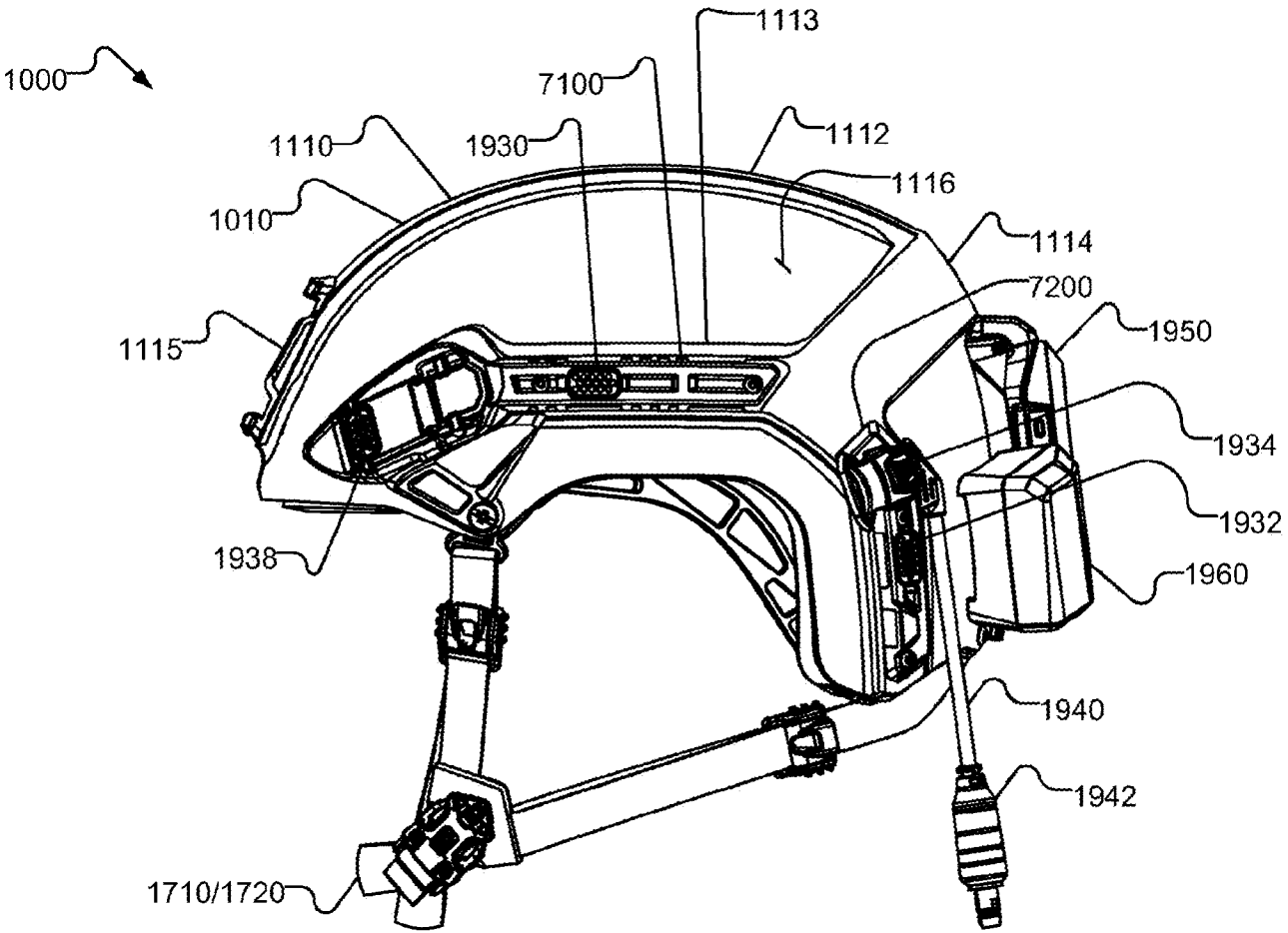
FIG. 1 depicts a perspective view of a first exemplary embodiment of a helmet system.

Referring now to FIG. 1, a first helmet system 1000 is shown. The helmet system 1000 includes an exemplary, non-limiting, helmet 1010. The helmet 1010 includes an outer structure, called herein an outer shell 1110. The outer shell 1110 includes a top ridge 1112, a side ridge 1113, a rear ridge 1114, and a front mount 1115 for attaching an accessory device such as a night vision viewing device. The helmet includes a harness system 1710 for holding the helmet system 1000 on a head of a user and a fit system 1720 for adjusting a fit of the helmet 1010 on the head of the user. Referring now to FIG. 13, embodiments of the helmet 1010 may include second side ridge 1118 disposed on a side of the helmet opposing the first side ridge 1113. Helmet 1010 may be configured and manufactured as disclosed in co-pending application International Application Serial Number PCT/2023/061745, filed on Feb. 1, 2023, entitled RECONFIGURABLE HELMET, the entirety of which is incorporated herein by reference for any purpose whatsoever.

The outer shell 1110 is formed from one or more rigid materials. In some embodiments, the outer shell 1110 is formed from one or more rigid composite materials. Some non-limiting examples of composite materials useful for forming the outer shell 1110 include carbon fiber, fiberglass, and Kevlar or Aramid. Some exemplary, non-limiting methods useful for forming embodiments of an outer shell 1110 comprising one or more composite materials include hand layup, vacuum bagging, autoclave, and resin transfer molding (RTM), although any suitable known composite material forming process may be used. An exemplary additional or alternative embodiment of an outer shell 1110 may be formed from one or more plastic materials. Some exemplary, non-limiting methods useful for forming embodiments of an outer shell 1110 comprising one or more plastics include injection molding, thermoforming, injection-blow molding, extrusion blow-molding, and roto-molding. Advantageously, the outer shell 1110 can be formed separately from other components of the helmet. Forming the outer shell 1110 separately allows molded-in or formed features to be created on the outer shell, unlike known helmets wherein a rigid outer shell is formed contemporaneously with other components such as one or more layers of ballistic protection material. Molded-in or formed features include the top ridge 1112, the rear ridge 1114, and each of the side ridges, e.g. 1113 and 1118, which are formed as protrusions from the outer shell 1110. The ridges provide extra rigidity to the outer shell 1110 which can increase its resistance to blunt impacts.

The helmet system 1000 includes a side accessory attachment structure 7100 and a rear accessory attachment structure 7200 for attaching one or more accessories to the helmet. The side and rear accessory attachment structures 7100, 7200 can include molded-in features or can be formed separately—for example, by an injection molding or other forming processes—and assembled onto the outer shell 1110—for example, with threaded fasteners such as screws or bolts, or by sonic welding, or adhesive bonding.

Accessory attachment structures 7100, 7200 can be formed by injection molding a plastic housing or machining a metal housing: for example, from an aluminum alloy or other suitable metal. Additional components—for example wires and electrical interfaces—can be assembled with the molded or machined housing. Alternatively, one of more components, e.g. electrical components, can be overmolded while forming an accessory attachment structure 7100 or 7200.

Accessory attachment structures 7100, 7200, according to embodiments disclosed herein, are not limited to the particular type of helmet shown in FIG. 1 and elsewhere herein. The accessory attachment structures 7100 and 7200 can be attached to other types of helmets: for example, to a helmet that does not include side, top, and/or rear ridges; to a bump or ballistic helmet, e.g., a Caiman helmet produced by Galvion LTD.; to a sporting, biking, or motorcycle helmet; or to other equipment, such as a torso-worn hub.

Side accessory and rear attachment structures 7100, 7200 can include mechanical interface features for attaching one or more active system accessories (not shown) to the helmet as well as one or more electrical interfaces. Electrical interfaces can be formed with receptacles for mounting electronic connectors to interface with the one or more accessories. Non-limiting examples of accessory components that can be attached to the accessory attachment structures include strobes, headsets, cameras, illumination systems, identification friend or foe (IFF) systems, and laser detection systems. Side accessory attachment structure 7100 includes a left side electrical interface 1930. Rear accessory attachment structure 7200 includes a left rear electrical interface 1932. The rear accessory attachment structure 7200 further includes a cable electrical interface 1934 which is shown connected to a cable 1940 that is terminated with a plug 1942 attached thereto. In embodiments, the cable 1940 includes a NETT Warrior cable terminated with a NETT Warrior plug, as is known in the art. The cable 1940 is useful for electrically connecting the helmet 1010 to an external device: for example, to a torso-worn data and/or power hub or to a vehicle power supply. A vision system interface 1938 is provided to enable electrical and communication connection to an accessory device—for example, to a night vision system—which may be attached to the front mount 1115.

The front mount 1115 can be molded in or can be formed separately and assembled onto the outer shell 1110. One or more active system components (not shown) can be attached to the front mount 1115. Example active system components that can be attached to the front mount 1115 include, but are not limited to, a night vision viewing device and an augmented reality display visor.

In embodiments, additional or alternative molded-in features can be formed in the outer shell 1110 including, for example, additional accessory attachment structure features for mechanical and electronic connectors and for electronic components on one or more of the ridges.

Embodiments can include more or fewer accessory interface structures than shown. For example, a helmet system 1000 can include 2 or more side interfaces 7100 on a side of a helmet 1010 and can include one or more accessory interface structures, e.g., 7100, disposed on a top surface of the helmet: for example, on an outer surface of the top ridge 1112.

The top ridge 1112 extends along a top surface of the outer shell 1110 and extends generally from a front portion of the outer shell to a rear portion of the outer shell. One side ridge 1113 is disposed on a left side of the outer shell 1110 and a second side ridge 1118 is disposed on a right side of the outer shell. The side ridges 1113, 1118 each extend from a front portion of the outer shell towards a rear portion of the outer shell. The rear ridge 1114 extends from left to right across a rear portion of the outer shell 1110. Each of the top ridge 1112, side ridges 1113, 1118, and rear ridge 1114 define a hollow cavity conforming to the shape of the ridge beneath an outer surface 1116 of the outer shell.

A rear control module 1950 is attached to a back portion of the helmet. The rear control module can include one or more batteries, including in some embodiments a detachable battery module 1960, or other power sources, and one or more processors. The rear control module 1950 can be configured to provide power to, or draw power from, one or more accessories attached to the helmet system and can exchange communication signals with some accessories. The rear control module 1950 can be configured to draw power from and exchange communications with an external device electrically interfaced with the cable plug 1942.

Figure 2C:
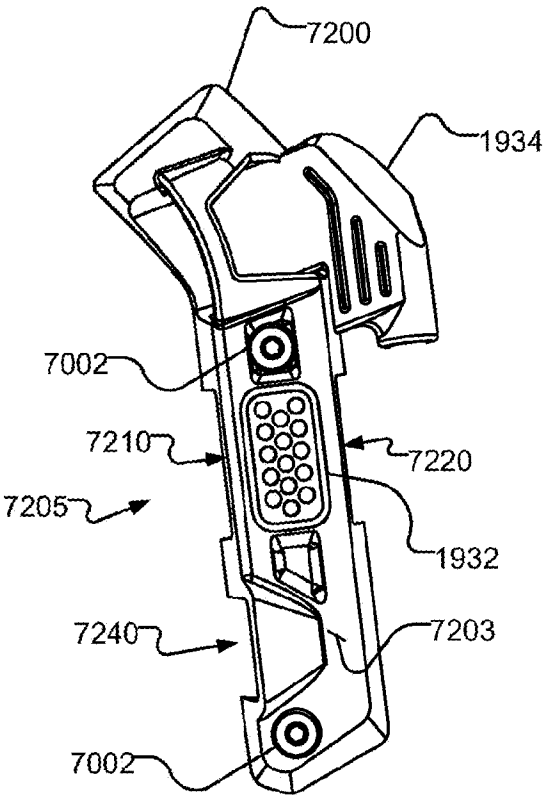
FIG. 2C depicts a rear accessory attachment structure.
Figure 2A:
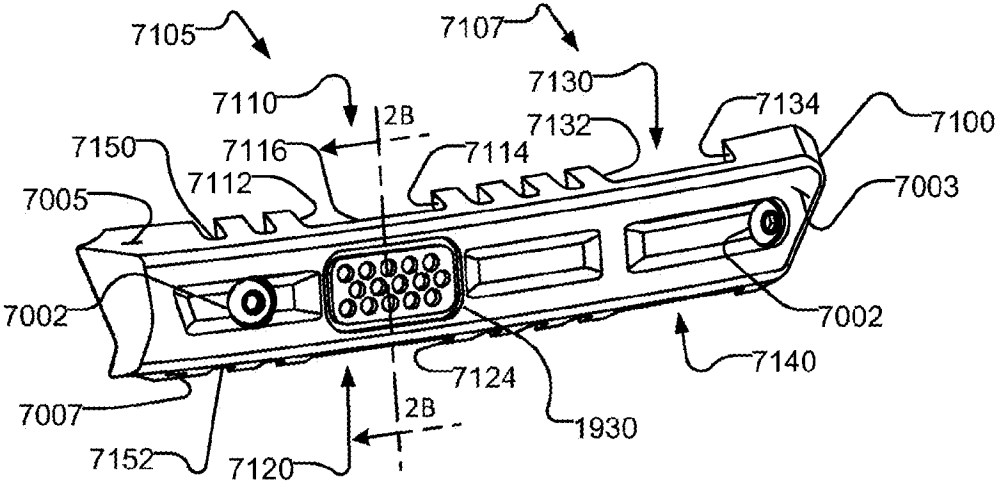
FIGS. 2A and 2B depict an exemplary embodiment of a side accessory attachment structure.
Figure 2B:
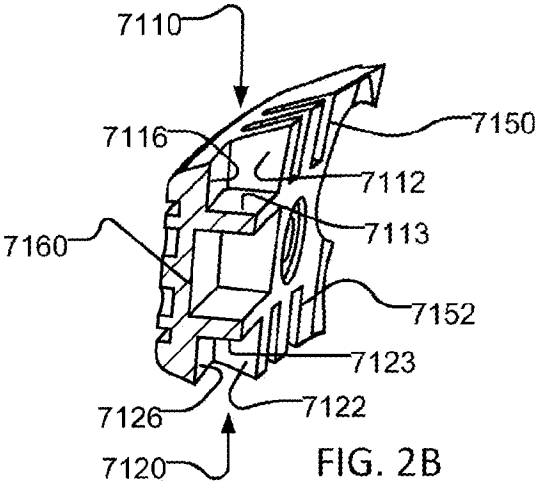

Referring to FIGS. 2A, 2B, and 2C, exemplary accessory interface structures 7100 and 7200 are shown. FIGS. 2A and 2B show an exemplary embodiment of a side accessory attachment structure 7100. FIG. 2B shows a section view through the side accessory attachment structure 7100 through section line 2B, shown in FIG. 2A. FIG. 2B shows a rear accessory attachment structure 7200.

The side accessory attachment structure 7100 includes an outer surface 7003, a powered accessory interface 7105 (i.e., an electro-mechanical accessory interface) that includes side electrical interface 1930 and a non-powered accessory interface 7107 that does not include an electrical interface. The outer surface 7003 functions as an accessory interface surface upon which an accessory is disposed when it is mechanically, and in some embodiments electrically, interfaced with the accessory attachment structure. An accessory attached to the powered accessory interface 7105 is mechanically interfaced with the outer, accessory interface, surface 7003 and may be electrically interfaced with the side electrical interface 1930. An accessory that is attached to the non-powered accessory interface 7107 is mechanically interfaced with the outer, accessory interface, surface 7003 but is not electrically interfaced with the accessory attachment structure 7100.

The powered accessory interface includes a side electrical interface 1930 disposed on the outer surface 7003, a side first mechanical interface 7110, and a side second mechanical interface 7120. Each of the side first and second mechanical interfaces 7110 and 7120 includes an opening on a top or bottom surface of the accessory attachment structure 7100 (e.g., on top surface 7005), which provides access to a cavity disposed under the outer surface 7003 (e.g., between the outer surface 7003 and an outer surface of a helmet 1116 to which the accessory interface 7100 is attached). For example, the first side mechanical interface 7110 includes an opening on the top surface 7005 which provides access to a cavity bounded by a first side wall 7112, a second side wall 7114, a rear wall 7113, and a top wall 7116. In a similar manner, the second side mechanical interface includes an opening on a bottom surface 7007 that provides access to a cavity defined by first side wall 7122, second side wall 7124, top wall 7126, and rear wall 7123. In embodiments, the side accessory attachment structure 7100 includes an accessory interface cavity 7160 formed within the T-shaped cross section formed at 7105 and 7107. Each of the top walls 7116 and 7126 are configured to provide an interface surface that can be engaged by a corresponding engagement feature of an accessory device to attach and lock the accessory device onto the accessory attachment structure 7100. Each of the side walls 7112, 7114, 7122, and 7124 are configured to provide motion limiting surfaces that are disposed and configured to limit motion of an accessory when it is attached to the accessory attachment structure 7100.

The side accessory interface structure 7100 includes a non-powered accessory interface 7107 (i.e. without an electronic interface), that includes a first mechanical interface 7130 and second mechanical interface 7140. Each of the non-powered accessory interface first and second mechanical interfaces 7130 and 7140 includes a cavity disposed under the outer surface 7003 with an opening substantially perpendicular to the outer surface 7003, similar to the cavities associated with the powered accessory interface 7105. The cavities are useful for accepting engagement features of accessory devices that may be attached to a non-powered accessory interface 7107. In some embodiments, one or more of the cavities are useful for accepting one or more portions of accessories or additional components that may be attached to the helmet system 1000. For example, a cavity associated with mechanical interface 7140 may accept a mounting portion of a side guard.

The rear accessory attachment structure 7200 includes an outer surface 7203 and a powered accessory interface 7205 that includes a rear electrical interface 1932 disposed on the outer surface 7203, a first rear mechanical interface 7210, and a second rear mechanical interface 7220. Each of the rear mechanical interfaces 7210 and 7220 includes a cavity disposed under the outer surface 7203 with an opening substantially perpendicular to the outer surface. The rear mechanical interfaces 7210 and 7220 may be substantially similar to front mechanical interfaces 7110 and 7120. The rear accessory interface structure 7200 includes an accessory mechanical interface 7240 forming a cavity which may be useful for accepting one or more portions of accessories or additional components that may be attached to the helmet system 1000. For example, the accessory mechanical interface 7240 may accept a mounting portion of a side guard.

Each of the electrical interfaces 1930 and 1932 is configured to electrically connect with a corresponding electrical interface on an accessory device for exchanging power and/or data signals with the accessory device. Each of the mechanical interfaces 7110, 7120, 7130, 7140, 7210, and 7220 are configured to mechanically connect with a corresponding accessory attachment feature on an accessory device to attach the accessory device to an accessory attachment structure 7100, 7200 and to the helmet system 1000.

The side accessory attachment structure 7100 optionally includes multiple pairs of divots 7150, 7152 located on opposing top and bottom faces 7105, 7107 of the accessory attachment structure 7100. The pairs of divots 7150, 7152 may aid in one or more of attachment and location for an accessory device in addition or alternatively to interfaces 7105 and 7107. In embodiments, a side accessory attachment structure 7100 may not include divots 7150 and 7152.

The side accessory attachment structure 7100 and rear accessory structure 7200 may include one or more fasteners 7002 for attaching the accessory attachment feature to a helmet (e.g., to helmet 1010). Exemplary fasteners include threaded fasteners, clips, rivets, or the like. In some embodiments, the accessory attachment structures 7100, 7200 may be bonded or otherwise attached to the helmet without use of fasteners 7002.

Referring to FIGS. 3, 4A, 4B, 4C, 5A, 5B, and 5C, an example powered accessory device 7300 is shown. The powered accessory device 7300 is configured to receive power and/or communication signals from the helmet system 1000. The powered accessory device 7300 includes powered accessory connection features 7305 (i.e., electro-mechanical connection features for mechanically and electrically engaging with corresponding accessory attachment features to attach the accessory 7300 to one or more powered accessory interfaces 7105 or 7205 of an accessory attachment structure 7100 or 7200).

The illustrated accessory 7300 can include, for example, a camera or a light. Other accessories can include similar connection features 7305. Non-limiting examples of powered accessory components that can be attached to an accessory attachment structure include strobes, headsets, cameras, illumination systems, identification friend or foe (IFF) systems, and laser detection systems. In other embodiments, a non-powered accessory can include mechanical accessory engagement features without an electrical attachment feature.

Although not shown, some accessories include multiple, for example two, sets of connection features 7305 and can be attached to two or more interface locations on one or more accessory attachment structures 7100 or 7200. For example, an accessory configured to attach to a side accessory attachment structure 7100 can include electro-mechanical accessory connection features configured to be connected with a powered accessory interface 7105 and mechanical connection features configured to be connected with a non-powered accessory interface 7107 at the same time. An embodiment of an accessory 7300 may also or alternatively include mechanical connection features configured to engage with one or more attachment divots 7150, 7152. In this manner, an accessory 7300 can include multiple points of mechanical connection with an accessory attachment structure 7100 and 7200, and one or more electrical connections with the accessory attachment structure. This may be advantageous for supporting larger or heavier accessories.

The attachment features 7305 include a fixed hook 7310, which can be rigid or which can elastically deform under load, and a clip 7320. The hook 7310 includes an engagement feature 7313 and the clip 7320 includes an engagement feature 7323. Each engagement feature 7313, 7323 is configured for interfacing with a corresponding accessory interface 7110 or 7120 of an accessory attachment structure 7100. The clip 7120 includes a clip actuator 7326—for example, a handle or lever—that enables a user to operate the actuator.

Figure 4A:
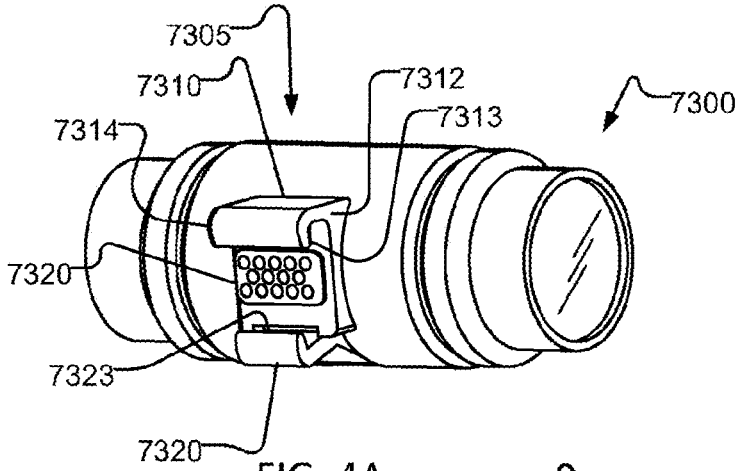
Figure 4B:
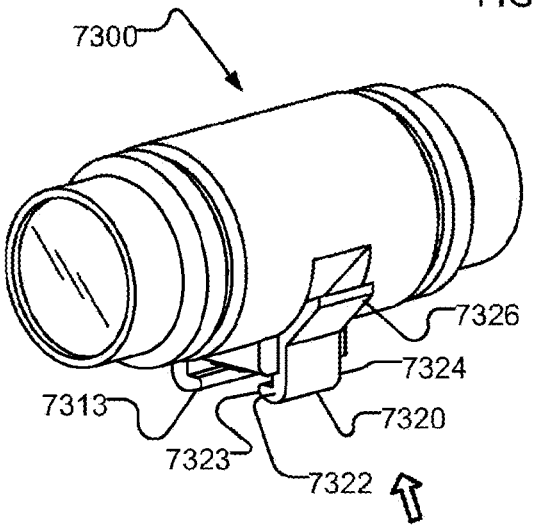
Figure 4C:
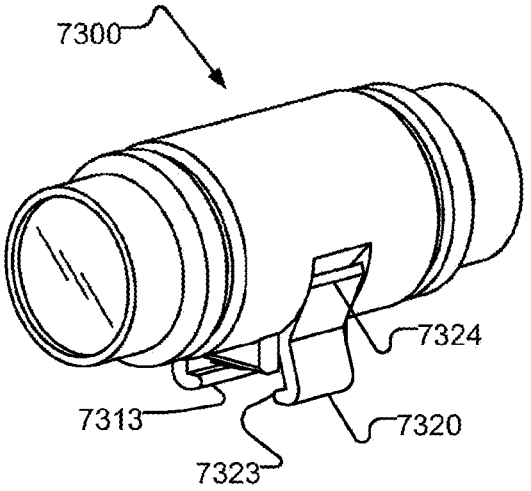
Figure 5A:
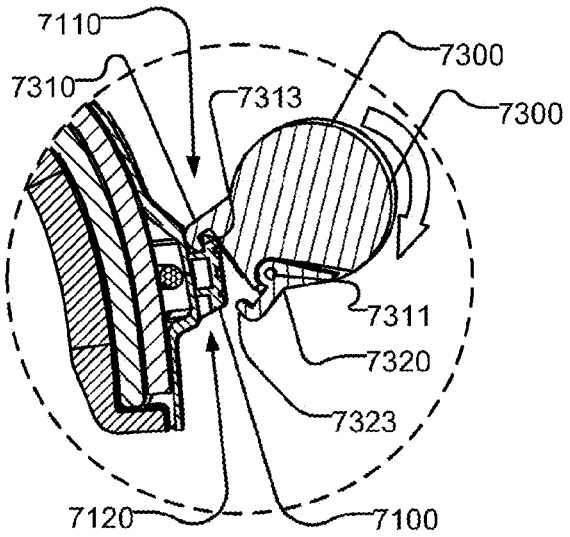
Figure 5B:
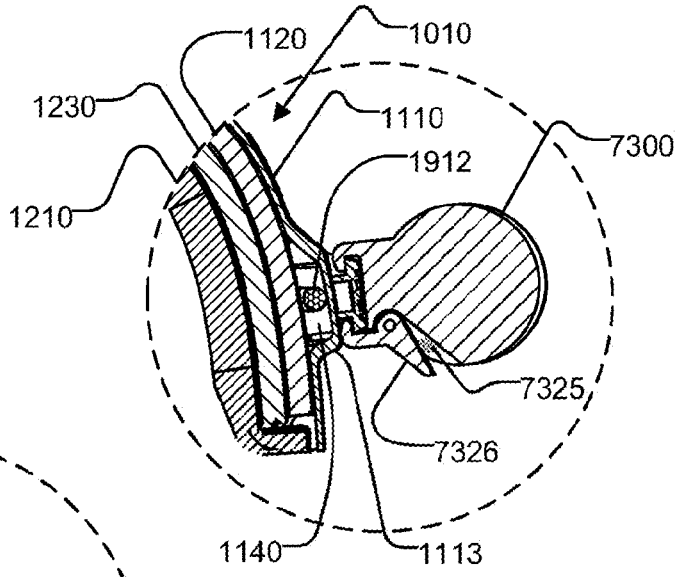
Figure 5C:
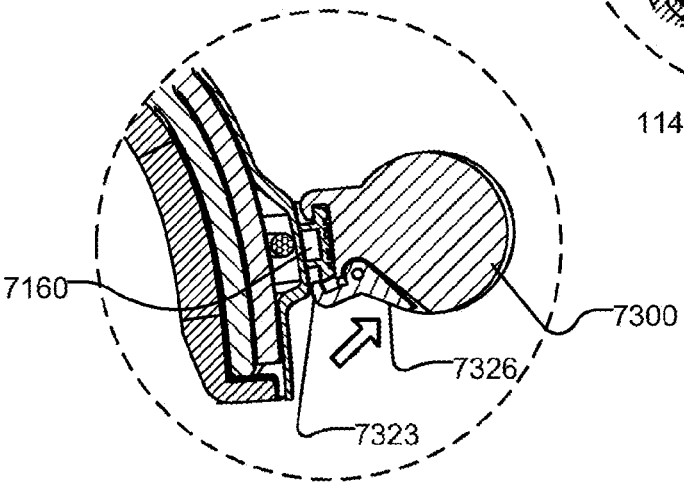

As best seen in FIGS. 5A through 5C, the clip 7320 is configured to rotate around a fixed axis 7311 to move between an engaged position, as shown for example in FIGS. 4B and 5B, and a disengaged position, as shown for example in FIGS. 4A, 4C, and 5C. The clip 7320 is biased by a spring 7325 or other suitable biasing component—for example, a structure fabricated from an elastically deformable material—to preferentially remain in the engaged position.

A user can press on the clip actuator 7326 to move the clip from the engaged position to the disengaged position to attach or remove the accessory 7300. In addition, the biasing component 7325 can be configured to hold the clip 7320 in the engaged position and to move into the disengaged position when a threshold amount of force is applied to the accessory: for example, by selecting the spring constant of a spring used as the biasing element 7325. This is advantageous for providing a releasable engagement between an accessory and the helmet system 1000 so that when an accessory is subjected to an undesirable amount of force, the force is not transferred to the helmet system 1000 through an accessory attachment structure 7100 or 7200. Instead, the accessory 7300 disengages from the accessory attachment structure 7100 or 7200, thereby protecting a wearer of the helmet system 1000 from the force and preventing entanglement of the wearer should the accessory become caught on an object such as a tree branch or netting.

Figure 3:
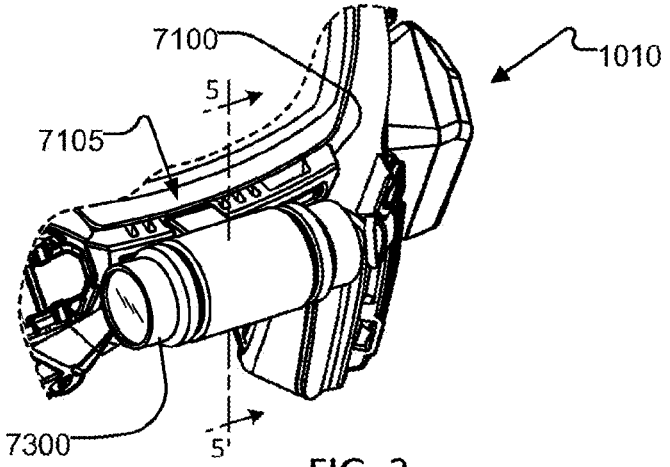

Referring now to FIG. 3, the accessory 7300 is shown attached to a side accessory attachment structure 7100 that is mounted on a helmet, for example 1010. Referring now to FIGS. 5A, 5B, and 5C, an exemplary method for attaching an accessory to an accessory attachment structure is shown. A partial section view through the accessory and a portion of the helmet, as indicated by the section line 5 in FIG. 3, is illustrated in each of FIGS. 5A, 5B, and 5C.

The exemplary helmet 1010 includes a ballistic layer 1120 and a functional layer 1230 (i.e., as shown in FIG. 5B). In some embodiments, the functional layer 1230 includes a second ballistic layer. The helmet 1010 includes an outer shell 1110 which forms a side ridge 1113. The side accessory attachment structure 7100 is attached to the side ridge 1113. An electric and/or communications cable 1912 runs through a cavity 1140 formed under the side ridge 1113. The cable 1912 is connected to an electrical interface 1930 of the side accessory attachment structure 7100 by one or more of wires, a harness, or other electrical connector (not shown) disposed between the cable and the electrical interface. The accessory interface structure 7100 includes an accessory interface cavity 7160 formed within the T-shaped cross section. In embodiments, the accessory interface cavity 7160 contains components of the electrical interface 1930 and provides a conduit for wires, leads, or the like that connect the cable 1912 disposed in the ridge cavity 1140 to the electrical interface.

To attach the accessory to the accessory attachment structure 7100, the hook 7310, and more particularly the hook engagement feature 7313, is interfaced with a first accessory interface 7110. The accessory 7300 is rotated downward (i.e., in a direction indicated by the curved arrow shown in FIG. 5A) to engage the engagement feature 7323 of the clip 7320 with a second accessory interface 7120 and to thereby secure the accessory 7300 in place on the accessory attachment structure 7100. A user can detach the accessory 7300 by applying compressive force to the clip actuator 7326 to disengage the engagement feature 7323 from the second accessory interface 7120 and then rotating the accessory 7300 upward (i.e., in a direction opposite that indicated by the curved arrow shown in FIG. 5A).

The illustrated accessory attachment structure 7100 includes a T-shaped cross-sectional profile which forms accessory interfaces 7100 and 7200. Other profile shapes can be used without departing from concepts disclosed herein: for example, a picatinny profile can be substituted for the T-shaped profile.

Additional exemplary configurations of attachment clips are illustrated in FIGS. 6A and 6B. A first alternative accessory 7301 can be configured with two rotating clips 7340 and 7350, as shown in FIG. 6A. Each clip 7340, 7350 is rotatable around a fixed axis 7341, 7351 respectively to move an engagement feature 7343, 7353 into and out of engagement with a corresponding mechanical interface (e.g., 7110, 7120). The clips 7340, 7350 are each urged into an engaged configuration by a biasing element 7325. Referring now to FIG. 6B, a second alternative accessory 7302 can be configured with two sliding clips 7360, 7370, which can be moved together or separately by a user interacting with actuators 7366, 7376 to move engagement features 7363 and 7373 into and out of mechanical engagement with corresponding mechanical interfaces (e.g., 7110 and 7120 or 7130 and 7140).

In embodiments, each powered and non-powered accessory interface can be configured differently to allow only a corresponding accessory type to be connected to the attachment. For example, a powered accessory device, 7300, can include mechanical interface features that are configured to only interface with corresponding engagement features of a powered accessory device and, in some embodiments, with a particular powered accessory device or a particular type of powered accessory device. In a similar manner, a non-powered accessory, e.g. 7301, can include attachment features that only interface with corresponding connection features of a non-powered accessory.

In an example embodiment, one or both mechanical interfaces 7110, 7120 of a powered accessory interface 7105 are sized to mate with connection features of a powered accessory device 7300. Referring to FIGS. 2A and 4A, a width of a mechanical interface 7100 associated with a powered accessory interface 7105 is greater than a width of a mechanical interface 7130 that is associated with a non-powered accessory interface 7107. In other words, a distance between the first wall 7112 and second wall 7114 of the powered mechanical interface 7110 is greater that a distance between the first wall 7132 and second side wall 7134 of the non-powered mechanical interface 7130. A distance between a first side surface 7312 and a second side surface 7314 of the hook 7310 of the powered accessory device 7300 is matched to the width of the powered mechanical interface 7110 and is greater than the width of the non-powered mechanical interface 7130. Therefore, the hook 7310 will fit into the powered mechanical interface 7110 and not into the non-powered mechanical interface 7130. Therefore, the powered accessory 7300 will only engage with the powered accessory interface 7105 and not with the non-powered accessory interface 7107. In a similar manner a powered or non-powered accessory can be configured to mate with a plurality of features of an accessory attachment structure, for example with a mechanical interface 7110 or 7130 and with one or more sets of divots 7150, 7152.

Figure 8:
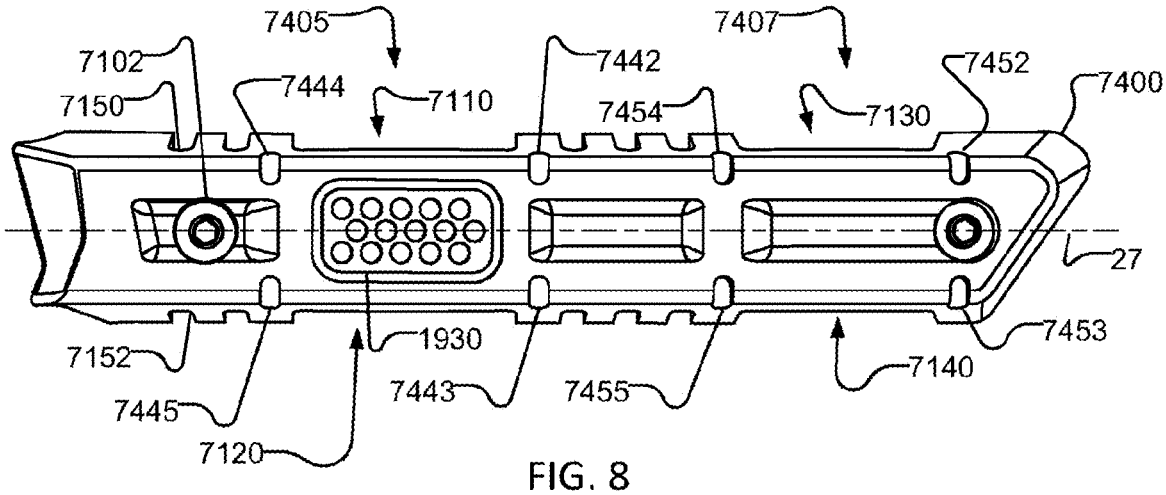
Figure 9:
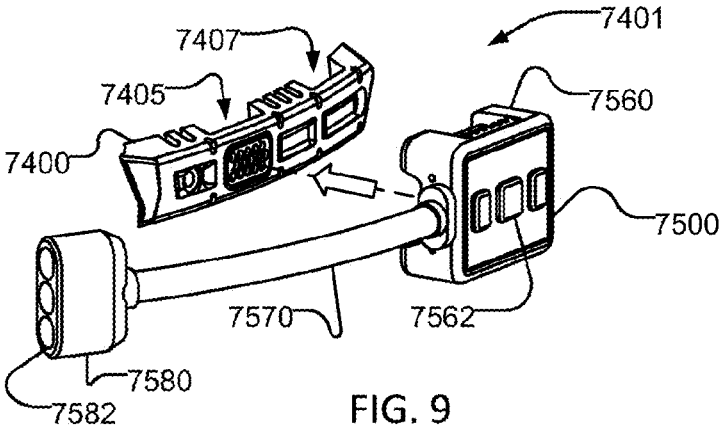

Referring now to FIGS. 2A, 4A, and 8, advantageously, the first wall 7112 and the second wall 7114 of the powered mechanical interface 7110 provide motion limiting surfaces that function to constrain motion of an accessory, for example accessory 7300, relative to an accessory attachment structure, for example in a direction parallel to axis 27 along a longitudinal length of an accessory attachment structure, e.g., 7400, shown in FIG. 8. In an example, when accessory 7300 is attached to a powered accessory interface, for example 7105, movement of the accessory along the longitudinal length of the accessory attachment structure 7100 is limited by an interface of the first side surface 7312 of the hook 7310 the first motion limiting surface, i.e. first wall 7112, of the powered mechanical interface 7110 and by an interface of the second side surface 7314 of the hook 7310 with the second motion limiting surface, i.e. second wall 7114, of the powered mechanical interface 7110.

The accessory attachment structures 7100 and 7200 advantageously enable a user to attach and remove accessories (e.g., accessory 7300), by feel (i.e., without needing to observe placement of the accessory on an accessory attachment structure). This functionality is provided at least in part by providing powered accessory interface features that engage only with corresponding connection features of powered accessory devices and by providing non-powered accessory interface features that engage only with corresponding non-powered device connection features. A user can thus press an accessory device against an accessory attachment feature and move it forwards and backwards until its connection features engage with corresponding accessory attachment features of an accessory attachment that is suitable for the accessory.

Referring to FIGS. 7, 8, 9, and 10A though 10C, another arrangement for selectively mounting accessories of different device types on accessory attachments that correspond to the device types is shown. An accessory attachment structure 7400 is configured in a manner similar to that of the previously disclosed accessory attachment structure 7100 and like elements are labeled with like identifiers. The accessory attachment structure 7400 may be attached to a helmet: for example, to previously disclosed helmet 1010.

Referring to FIGS. 7, 9, and 10A through 10C, a push-on accessory 7500 includes an illuminator housing 7580 including a plurality of lights 7582, a mounting and control box 7560, having a plurality of control buttons 7562 for controlling operation of the lights 7582, and a semi-rigid cable 7570 connecting the control box 7560 to the illuminator housing 7580. The accessory 7500 is termed a push-on connector because it is attached to the accessory attachment structure 7400 by moving it laterally, as indicated by the arrow in FIG. 9, in contrast to the hook-and-rotate attachment shown, for example, in FIGS. 5A through 5C.

Figure 10B:
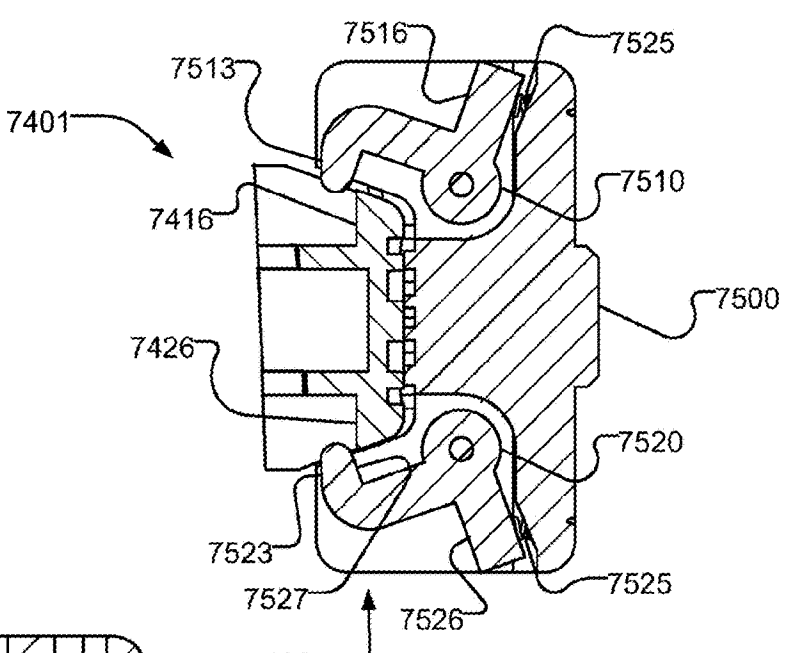
Figure 10A:
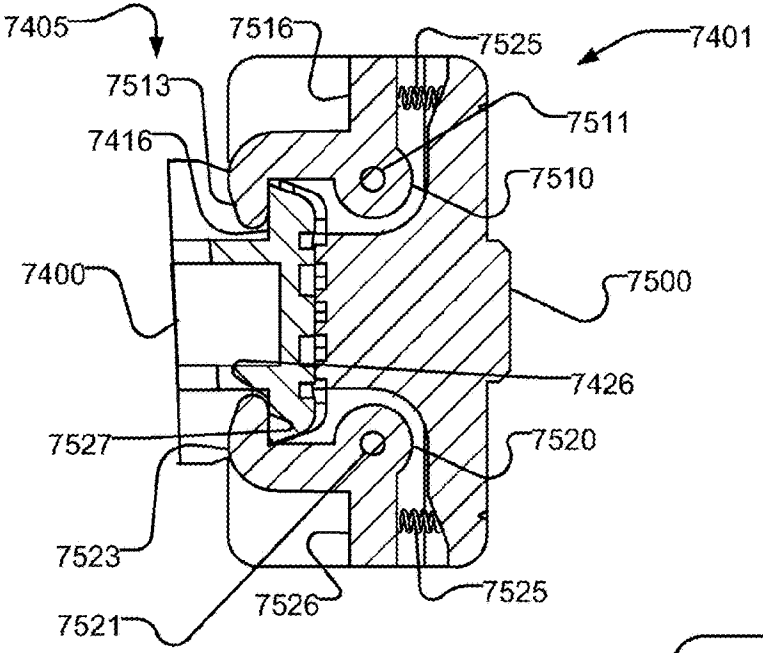

The accessory 7500 includes powered connection features 7505 which include an electrical interface made up of multiple contact pins 7535, which may include spring loaded contact pins, and a gasket 7537 for providing an environmental seal when the accessory 7500 is mounted on the accessory attachment structure 7400. The connection features include a pair of clips, 7510 and 7520, which are each disposed on opposing sides of the electrical interface. Each clip 7510, 7520 includes an actuator, 7516, 7526 respectively, and an interface feature, 7513, 7523, respectively. As best seen in FIG. 10A, the clips 7510, 7520 are each rotatable around a fixed axis 7511, 7521, respectively. Each clip is urged into an attached configuration, as shown for example in FIG. 10A, by a biasing element 7525. Biasing elements 7525 may be substantially similar to previously disclosed biasing elements 7325.

Figure 7:
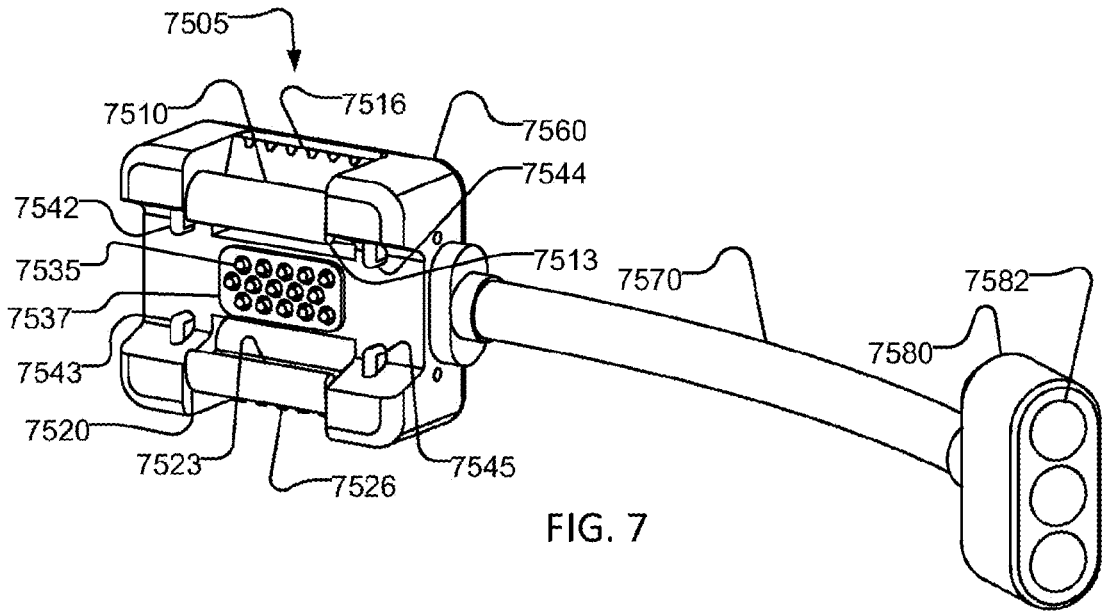

As best seen in FIG. 7, the connection features 7505 include a plurality of locating ribs, arranged in pairs 7542, 7544 and 7543, 7545. Each pair of locating ribs (e.g., 7542 and 7544), is separated by a pre-determined horizontal distance. As shown, both pairs of ribs are separated by the same horizontal distance, but in other embodiments, a first pair of ribs may be separated by a first horizontal distance and a second pair of ribs may be separated by a second horizontal distance. The pre-determined horizontal distance may correspond with a type of accessory device 7400: for example, a distance between pairs of locating ribs of a powered accessory device may be different from (e.g. greater than), a distance between pairs of locating ribs of a non-powered accessory device.

Accessory attachment structure 7400 includes multiple locating grooves (e.g., 7444) that are each configured to interface with a corresponding locating rib (e.g., 7544) of an accessory device. The locating grooves are disposed on a top surface 7403 of the accessory attachment structure 7400. The locating grooves are arranged in pairs: a first set of pairs of locating grooves 7442, 7444 and 7443, 7445 is associated with a powered accessory interface 7405; and a second set of pairs of locating grooves 7452, 7454 and 7453, 7455 is associated with a non-powered accessory interface 7407. A first groove of a pair of locating grooves (e.g. 7442) is disposed on a first side of a mechanical interface (e.g., 7110), and a second groove of the pair of locating grooves (e.g. 7444) is disposed on an opposing side of the mechanical interface.

Powered accessory interface 7405 includes a first pair of locating grooves 7442 and 7444, located on the top surface 7403 on opposing sides of the powered attachment first mechanical interface 7110 and a second pair of locating grooves 7443 and 7445 located on the top surface 7403 on opposing sides of the powered attachment second mechanical interface 7120.

Non-powered accessory interface 7407 includes a first pair of locating grooves 7452 and 7454, located on the top surface 7403 on opposing sides of the non-powered attachment first mechanical interface 7130 and a second pair of locating grooves 7453 and 7455 located on the top surface 7403 on opposing sides of the non-powered attachment second mechanical interface 7140. A horizontal distance (i.e., a distance along axis 27), between pairs of locating grooves of a powered accessory interface (e.g., 7405) is different from a horizontal distance between pairs of locating grooves of a non-powered accessory interface (e.g., 7407). In an example embodiment, a distance between locating grooves 7442 and 7444 of the powered accessory interface 7405 is greater than a horizontal distance between locating grooves 7452 and 7454 of the non-powered accessory interface 7407.

Locating ribs 7542, 7544, 7543, and 7545 are arranged so that they interface with corresponding locating grooves 7442, 7444, 7443, and 7445 of the powered accessory interface 7405. In other words, a pattern of distribution of the locating ribs (i.e., a horizontal and a vertical distance between pairs of ribs) is matched to a pattern of distribution of the locating grooves so that corresponding locating ribs engage with corresponding locating grooves when the powered accessory 7500 is located on the powered accessory interface 7405. The pattern of distribution of the powered accessory locating ribs 7542, 7544, 7543, and 7545 is different from the pattern of distribution of the locating grooves 7452, 7454, 7453, and 7455 of the non-powered accessory interface 7407. Therefore the powered accessory interface locating ribs (e.g., 7542, 7544) will not engage with the locating ribs of the non-powered accessory device. Advantageously, a user can use the mating locating ribs and grooves to position an accessory on a correctly corresponding accessory attachment. The user may position the accessory on an accessory attachment structure 7400 and slide the accessory along the accessory attachment structure until the locating ribs engage with the locating grooves of the powered accessory interface 7405. The user may then push the accessory toward the helmet 1010 to lock the accessory 7300 onto the accessory attachment structure 7400.

Figure 10C:
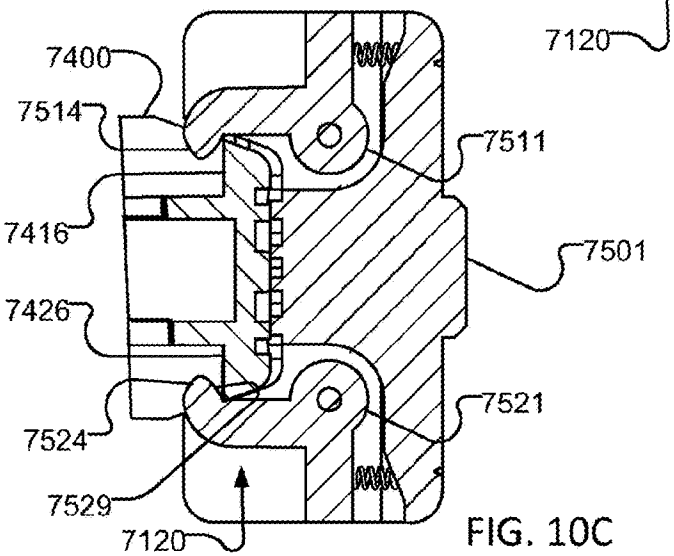

In examples, accessories can include connecting features that enable a strong attachment to an accessory attachment structure: for example, an attachment that will not release until a user operates one or more actuators to remove the accessory. In alternative examples, accessories can include connecting features that enable a break away connection: for example, an attachment that will release the accessory from an accessory attachment structure when greater than a threshold amount of force is applied to the accessory. Referring to FIGS. 10A, 10B, and 10C, attachment and disengagement of a powered accessory (e.g., 7500) to and from an accessory attachment structure 7400 is shown. Accessory 7500 and accessory attachment structure 7400 are shown in simplified cross section view. The engagement and disengagement is enabled in a manner similar to that described previously in relation to accessory 7301 (See FIG. 6A). Engagement features 7513 and 7523 are urged into engagement with the accessory attachment structure 7400 by biasing elements 7525. A user can disengage the engagement features 7513, 7523 by operating actuators 7516 and 7526, as shown in FIG. 10B.

As shown in FIG. 10A, a top surface 7527 of an engagement feature 7523 is in contact with a top surface 7426 of a cavity of mechanical interface 7120 when the clip 7526 is in an engaged position. This enables a strong connection between the accessory 7500 and the accessory attachment structure 7400. Referring now to FIG. 10C, an accessory 7501 includes clips 7511 and 7521 configured to enable a break away connection. The break away clips 7511 and 7521 each include an engagement feature 7514, 7524 that does not fully engage with the accessory attachment. For example, a top surface 7529 of engagement feature 7524 is only in partial contact with the top surface 7426 when the clip is in the engaged position. This partial contact enables the clip to release at a particular load, thereby providing a connection that can be disengaged when a greater than threshold amount of force is applied to the accessory 7501, as previously disclosed herein. Other shapes and configurations of break away connectors, as are known in the art, can be used without departing from the inventive concepts disclosed herein.

Figure 10D:
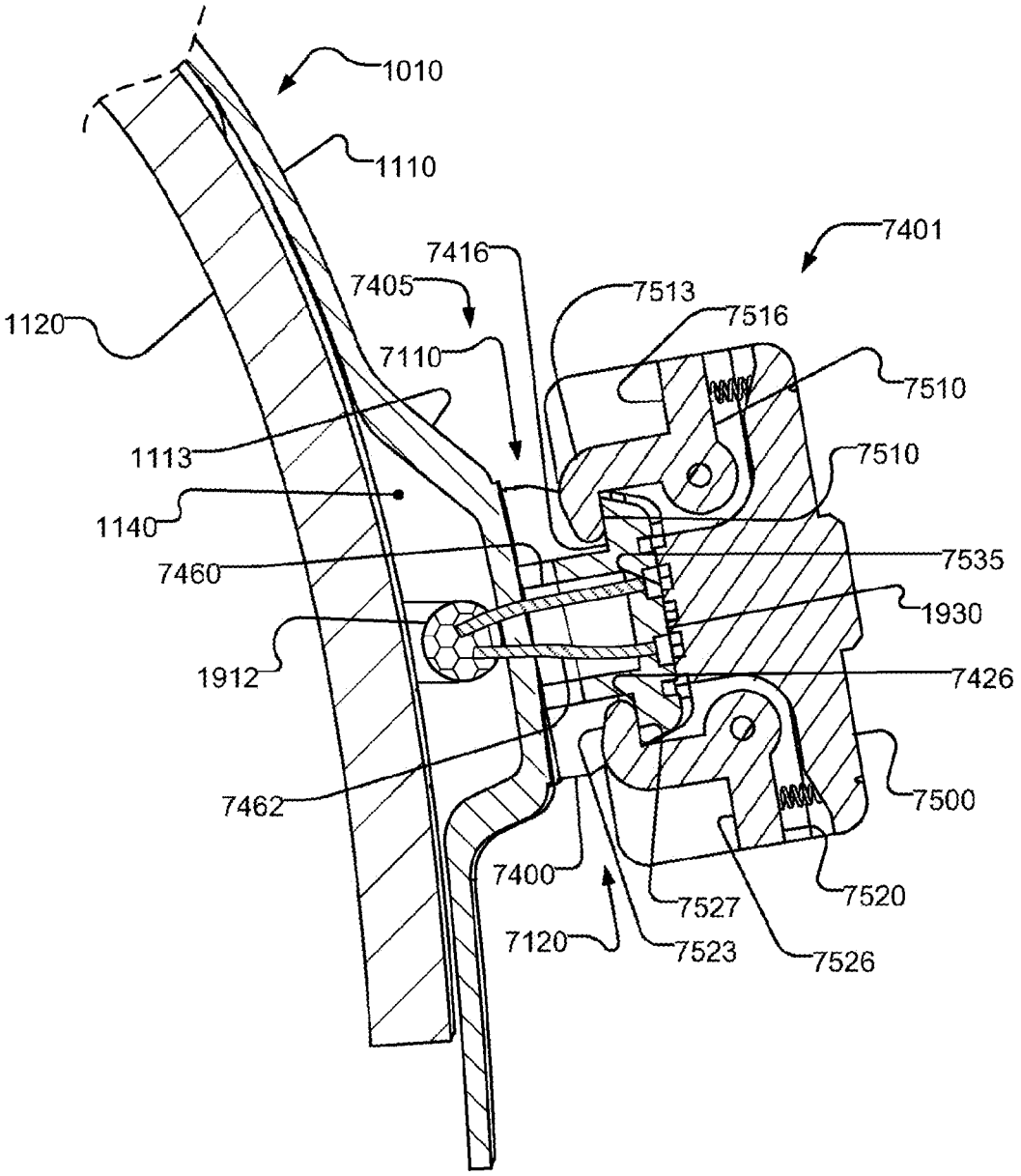

Referring now to FIG. 10D, a cross sectional view of assembly 7501, including the accessory 7500 mounted on the side accessory attachment structure 7400, is shown with the accessory attachment structure 7400 attached to an embodiment of a helmet 1010.

The helmet 1010 includes outer shell 1110 having outer surface 1116 and an inner portion of the helmet disposed interior to the outer shell, e.g. a ballistic layer 1120. The outer shell includes a ridge 1113. A ridge cavity 1140 is between the outer shell and the ballistic layer 1120. A cable 1912 is disposed within the ridge cavity 1140. The side accessory attachment structure 7400 includes an electrical interface 1930 and an accessory interface cavity 7460 bounded by the outer surface 1116 of the helmet and the electrical interface 1930. Electrical connectors 7462, e.g. lead wires or portions of wires bundled in the cable 1912, pass from the cable 1912, through the outer shell 1110, e.g. through one or more openings formed in the outer shell, and through the, accessory interface cavity 7460 to the electrical interface 1930. The electrical connectors 7462 electrically connect the cable 1912 to the electrical interface 1930 and can form communication and electric power connections therebetween. It is noted that the cable 1912 does not pass through the accessory interface cavity 7460 but instead is enclosed by, and contained within, the ridge cavity 1140 of the helmet 1010.

The accessory 7500 is shown attached to the powered accessory interface 7405 of the accessory attachment structure 7400. The powered accessory interface 7405 includes the first mechanical interface 7110 and the second mechanical interface 7120. Each mechanical interface includes an interface surface, i.e. top surface 7416 of the first mechanical interface 7110 and top surface 7426 of the second mechanical interface 7120. Each interface surface is configured to be engaged by a corresponding engagement surface of an engagement feature, e.g. engagement features 7513, 7523, to attach and lock the accessory 7500 onto the accessory attachment structure 7400.

The accessory 7500 includes two clips, 7510 and 7520. Each clip includes an engagement feature, 7513 and 7523 respectively, and each engagement feature includes an engagement surface, i.e. top surfaces 7517 and 7527, respectively. As shown in FIG. 10D, the engagement surface 7517 of the first clip 7510 is engaged with the interface surface 7416 of the first mechanical interface 7110 and the engagement surface 7527 of the second clip 7520 is engaged with the interface surface 7426 of the second mechanical interface 7210. As previously discussed, a user can operate an actuator to disengage an engagement surface of an engagement feature from a corresponding interface surface to enable removal of an accessory from an accessory interface, e.g. from the powered accessory interface 7405 or from the non-powered accessory interface 7407. For example, a user can operate the actuator 7516 of the clip 7510 to disengage the engagement surface 7517 of the engagement feature 7513 the interface surface 7416 of the first mechanical interface 7110 of the powered accessory interface 7405. Otherwise, a biasing element, e.g. 7525, maintains interface and engagement surface in contact to keep an accessory, e.g. 7500, locked onto an accessory attachment structure, e.g. 7400.

6.2.2 Power and Data Cables

Referring now to FIGS. 11 and 12, a second helmet system 1001, including second helmet 1011 is shown. The second helmet system 1001 is configured similarly to the helmet system 1000 and like elements are identified with like reference numbers. In embodiments, one or more cables can be used to connect a rear control module 1950 with one or more accessory interfaces. The second helmet system 1001 include a left accessory attachment structure 7100 and a corresponding right side accessory attachment structure (not shown), each with a side electrical interface (e.g. left side electrical interface 1930), and left rear accessory attachment structure 7200 and right rear accessory attachment structure 7201. The left rear accessory attachment structure 7200 includes a left rear electrical interface 1932 and a cable electrical interface 1934 for providing electrical and communication connection to a cable 1940, which is terminated with a plug 1942. The right rear accessory attachment structure includes an electrical connection interface (not shown) and a cable interface (not shown). In addition, the second helmet system 1001 includes a first top interface 1936 and second top interface 1937, each of which can include an electro-mechanical interface as described previously herein or any other suitable electro-mechanical interface, for example, a catch-and-lock type electrical adapters provided by ODU-USA, Inc. of Camarillo, CA. The second helmet system also includes a vision system interface 1938 and a front mount 1115 that includes an electrical interface 1939.

The helmet system 1001 includes a number of cables, each of which is routed through one or more cavities formed under ridges (e.g., 1112, 1114, 1116 of the outer structure 1010). The cables include a left rear cable 1914, a left side cable 1912, a right rear cable 1915, a right side cable 1913, and a top cable 1916. The cables can include any flexible or semi-flexible electrical and/or communication signal conductors: for example, one or more of bundled wire cables, wires, ribbon cables, and rigid-flex circuits. The cables are shown in dashed line font to indicate that they are located below the outer surface 1116 of the outer shell 1110. The cables can be assembled into the cavities and attached to the outer shell 1110. The cables provide electronic and communication connections. In other embodiments, cables can provide one or the other of electronic and communication connections.

The left rear cable 1914 connects the electrical interface 1932 and cable interface 1940 of the left rear accessory attachment structure 7200 to the rear control module 1950. The right rear cable 1915 connects an electrical interface (not shown) and a cable interface (not shown) of the right rear accessory attachment structure 7201 to the rear control module 1950. The left side cable 1912 connects the rear control module 1950 to the left side electrical interface 1930 of the left side accessory attachment structure 7100 and to the vision system interface 1938. The right side cable 1913 connects the rear control module 1950 to a right side electrical interface (not shown) of a right side accessory attachment structure (not shown) and to a right side vision system interface (not shown). The top cable 1916 connects the rear control module 1950 to the first and second top interfaces 1936 and 1937 and to the electrical interface 1939 of the front mount 1115. Each of electrical interfaces can include data and/or electric power connections and each of the cables can carry one or both of power and data signals.

The rear control module 1950 can include one or more of a processor and associated memory, a communication router, and a power supply device. The rear control module can provide power to one or more accessory devices and can route communications between accessory devices and one or more devices or systems located remotely from the helmet: for example, the rear control module and/or one or more other accessory devices. In some embodiments, the rear control module includes one or more program modules for processing data received from or provided to one or more active system components.

Referring to FIG. 13, an exemplary method of assembling electronic components, including wires, accessory attachments, and a rear control module, of a helmet system according to the technology disclosed herein is shown. A portion of an embodiment of the helmet 1010 of the first helmet system 1000 is shown in an exploded perspective view. The portion of the helmet includes an outer shell 1110 and a ballistic layer 1120, disposed within a concave cavity formed in the interior of the outer shell 1110. Referring now to FIGS. 1 and 13, the outer shell 1110 includes a rear ridge cavity 1150 formed under the rear ridge 1114 and a front left side ridge cavity 1140 and rear left side ridge cavity 1141, both of which are formed under the left side ridge 1113. The helmet system 1000 includes the rear control module 1950 and associated battery module 1960 which can be attached to the outer shell 1110 using one or more fasteners (not shown).

Referring once more to FIG. 13, the outer shell includes a rear control module aperture 1919 which includes an opening passing between the outer surface 1116 and inner surface 1117 of the outer shell 1110. The rear control module 1950 includes a rear control module electrical interface 1953 which includes one or more data and electrical connectors (not shown). When the rear control module 1950 is assembled onto the outer shell 1110, a rear control module electrical interface 1953 is aligned with the rear control module aperture 1919 to enable creation of electrical and communication connections between the rear control module data and electrical connectors and the cables 1912 and 1914.

The helmet system 1010 includes a left vision system interface 1938, a right vision system interface 1943, a left side accessory attachment structure 7100, a right side accessory attachment structure 7101 including a right side electrical interface 1931, a right rear accessory attachment structure 7201 including a right side cable interface 1935, and a left rear accessory attachment structure (not shown), each of which may be attached to the outer surface 1116 of the outer shell 1110 using one or more fasteners 7002 or other attachment methods, as previously disclosed herein.

The left side cable 1912 is assembled into the rear ridge cavity 1150 and the front left side ridge cavity 1140. The left rear cable 1914 is assembled into the rear ridge cavity 1150 and the rear left side ridge cavity 1141. The cables 1912 and 1914 may each be held in place by one or cable clips 1918. The cable clips 1918 may be attached to the inner surface 1117 of the outer shell 1110, for example by adhesive bonding. The cable clips 1918 may include any suitable structures for securing a cable: for example, a plastic open loop, a zip-tie, or a hook and loop fastener. In other exemplary embodiments, one or more cable management features may be molded onto the outer shell 1110 during the forming process. In still further examples, embodiments of the cables 1912 and 1914 may be bonded to the inner surface 1117 of the outer shell. For example, a ribbon cable or rigid-flex circuit cable embodiment may be adhesive or thermally bonded to the inner surface 1117.

The cables are electrically connected to the rear control module 1950 and to the electrical interfaces: for example, to electrical interfaces of the accessory attachment structures 7100, 7101, and 7201, and vision system interfaces 1938 and 1943.

One or more ridge fill materials may be assembled into the ridge cavities along with the cables. For example, a rear ridge fill layer 1152 may be assembled into the rear ridge cavity 1150. In examples, the ridge fill materials may include ballistic materials to provide additional protection from ballistic projectiles.

When the cables (e.g., 1912 and 1914) and ridge fill materials (e.g., 1152) are assembled in ridge cavities (e.g. 1150, 1140, 1141 of the outer shell), the ballistic layer 1120 is assembled into the interior of the outer shell 1110. In embodiments the ballistic layer 1120 is bonded to at least a portion of the inner surface 1117 of the outer shell, with an outer surface 1124 of the ballistic layer 1120 in physical contact with at least a portion of the inner surface 1117, in particular with a portion of the of the inner surface of the outer shell 1110 that does not include a ridge cavity (e.g., 1140, 1141, and 1150). In embodiments, the ballistic layer 1120 may be removable from the outer shell 1110: for example, by de-adhesion or by cutting. Such removability of the ballistic layer is advantageous in that it enables repair and reconfiguration of the electronic components of the helmet 1010. It is noted that embodiments of the second helmet system 1001, including second helmet 1011 can be assembled in a manner similar to that described in relation to FIG. 13.

The cables, e.g. one or more of 1912, 1913, 1914, 1915, and 1916, and electronic connections, e.g. one or more of 1930, 1932, 1934, 1936, 1938, and 1939, of the first and second helmet systems 1000 and 1001 are reconfigurable. A user can remove and replace one or more of cables, accessory attachment structures (7100 or 7200), vision system interfaces (1938 or 1943), front mount 1115, and rear control module 1950. The user also can add additional cabling and additional accessory attachment structures. The user can access the cavities (e.g., side ridge cavity 1140) (see, for example, FIG. 5B) under the ridges (e.g. under side ridge 1113) to add, remove, and replace cables and accessory attachment structures. Routing cables through the ridges to interconnect active system components has a number of advantages. For example, the cabling is protected from the environment outside the helmet which allows more lightweight cables to be used as compared to cables located on the outside of the helmet. The cabling on the helmet is also neater and more organized than cabling disposed on the outside of a known helmet system. Because the cabling and accessory interfaces are reconfigurable, a data and communications network on the helmet can be changed, repaired, and upgraded when required or desired. Routing the cables under helmet ridges provides a number of additional advantages, including avoiding assembling cabling, or other electrical/communication signal conductors onto an outer surface of another helmet component (for example, onto a ballistic layer of a helmet or onto an outer surface of a ballistic shell). In alternative embodiments, one or more of the cables can be routed, entirely or in part, on the surface of a helmet or through a cable run comprising a feature attached to an outer surface of the helmet.

6.2.2.1 Electrical Connections

Referring to FIGS. 14A, 14B, and 14C, three arrangements 7601, 7602, and 7603 are shown, each illustrating, in a schematic view, an example of electrical connections between electrical conductors 7650, 7660, 7670, e.g. cables 1912 and 1914 (see FIG. 11) and an electrical interface 7600, for example left side electrical interface 1930 of left side accessory attachment structure 7100 (see, for example, FIG. 11). In embodiments, 7601 includes a cable electrical conductor 7650 with multiple individual conductive elements 7651, 7602 includes a flat wire bundle or ribbon cable electrical conductor 7660 having multiple individual conductive elements 7661, and 7603 includes electrical conductor 7670, representing a circuit structure (for example, a rigid-flex circuit), as is known in the art.

Arrangements 7601, 7601, and 7603 each include a partial section view of helmet structural components 7610 and 7620. In examples, component 7610 represents an outer shell, including a ridge 7612 formed in the outer shell 7610 and a ridge cavity 7611 disposed under the ridge, between the outer shell 7610 and an inner layer 7620, which in embodiments can include a ballistic layer.

Referring now to FIGS. 14A through 14C and 5A through 5C, in embodiments the outer shell 7610 represents outer shell 1110, inner layer 7620 represents ballistic layer 1120, ridge 7612 represents side ridge 1113, or any other ridge of a helmet according to the disclosed technology, and the ridge cavity 7611 represents a cavity formed under any ridge of a helmet according to the disclosed technology. The arrangements each include an electrical interface structure 7600 including a plurality of electrically conductive terminals 7605. In embodiments, the interface structure represents one or more of a side accessory attachment structure 7100, a rear accessory attachment structure 7200, a vision system interface 1938 or 1943, a top accessory interface 1936 or 1937, and a front mount electrical interface 1939.

Referring once again to FIGS. 14A through 14C, arrangement 7601 includes a cable 7650 disposed within the ridge cavity 7611. The cable 7650 includes a plurality of bundled electrical conductors 7651. Two of the electrical conductors 7651 are each attached to an electrical contact 7605 of the interface structure 7600. The electrical conductors 7651 may be attached to the electrical contacts 7605 using any suitable method for creating an electrical connection therebetween, for example, by clamping or soldering.

The arrangement 7602 includes a flat wire bundle or ribbon cable 7660 that includes a plurality of electrical conductors 7661. Two of the electrical conductors 7661 are each attached to an electrical contact 7605 of the interface structure 7600. The electrical conductors 7651 may be attached to the electrical contacts 7605 using any suitable method for creating an electrical connection therebetween, for example, by clamping or soldering.

The arrangement 7603 includes a circuit structure 7670 that includes a plurality of electrical conductors and electrical contacts (not shown) etched or otherwise formed on the circuit structure. The circuit structure 7670 is attached to the interface structure 7600 and two electrical contacts 7605 are electrically coupled to the circuit structure 7670 using any suitable method for creating an electrical connection therebetween, for example, by clamping or soldering.

It is noted that in embodiments, more than two electrical contacts 7605 are typically electrically connected to electrical conductors of a cabling system of a helmet according to the technology disclosed herein.

Figure 15A:
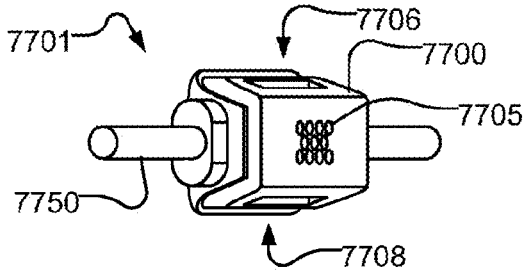
Figure 15B:
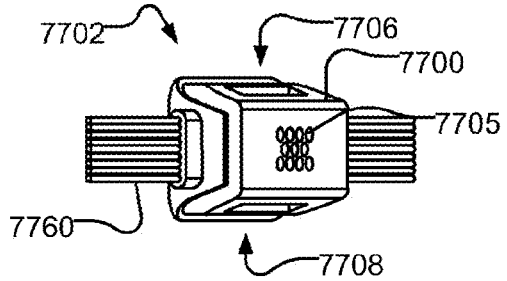
Figure 15C:
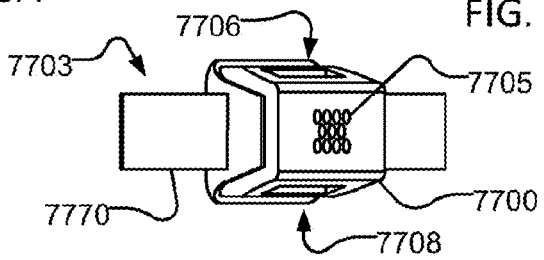

In an alternative embodiment of a helmet according to the technology disclosed herein, one or more electro-mechanical interfaces may be formed on cabling of the helmet: for example, by electrically interfacing each of a plurality of electrical conductors included in a cable, or in an alternative conductor, with one of a plurality of electrical contacts, and overmolding mechanical interface features over the electrical contacts and interfaces. Referring now to FIGS. 15A through 15C, example embodiments of overmolded accessory attachment structures 7700 are shown.

The accessory attachment structures 7700 each include opposing accessory interfaces 7706 and 7708 and an electrical interface made up of a plurality of electrical contacts 7705. A first arrangement 7701 shows an accessory attachment structure 7700 overmolded on a cable 7750. A second arrangement 7702 shows an accessory attachment structure 7700 overmolded on a ribbon cable 7760. A third arrangement 7703 shows an accessory attachment structure 7700 overmolded on a circuit structure 7770, for example, on a rigid-flex circuit. The electrical contacts 7705 can be electrical interfaced with the electrical conductors 7750, 7760, and 7770 as described herein in relation to FIGS. 14A through 14C.

Figure 15D:
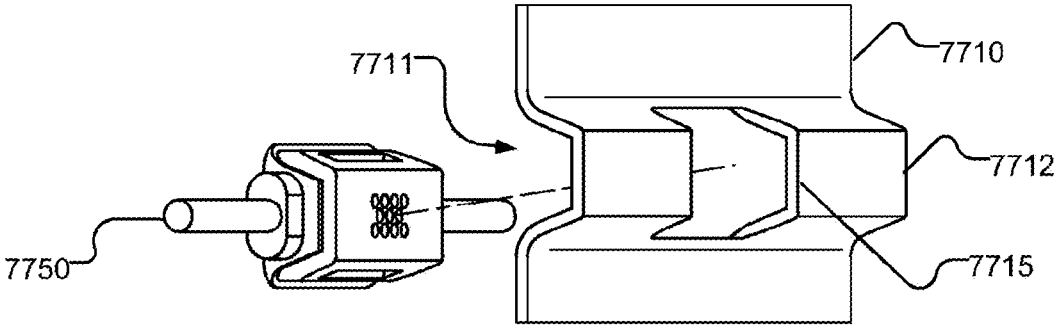
Figure 15E:
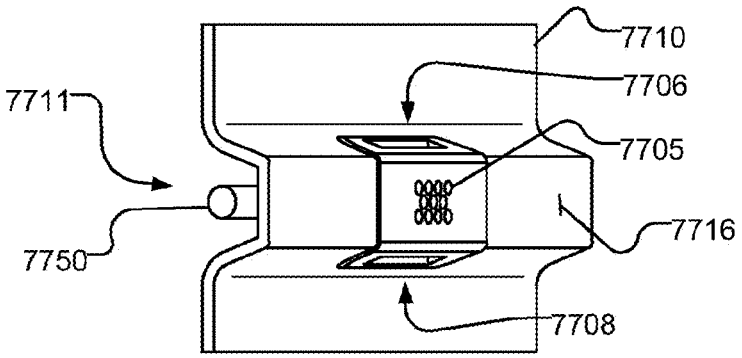

As shown in FIGS. 15D and 15E, an outer shell 7710, which may represent outer helmet enclosure 1110, includes a ridge 7712 defining a ridge cavity 7711 disposed below the ridge. The ridge includes a cutout 7715 that defines an opening providing access to the ridge cavity and configured to house and overmolded accessory attachment feature 7700.

An overmolded accessory attachment structure 7700 of arrangement 7701 is assembled into the cutout 7715, thereby exposing the accessory interfaces 7706 and 7608 and the electrical contacts 7705 on an outer surface 7716 of the outer shell 7710. The cable 7750 is disposed within the ridge cavity 7711. Accessory attachments according to arrangements 7702 and 7703 can be assembled into outer shell 7710 in a similar manner.

The overmolded accessory attachments structures 7700 disclosed herein provide a number of advantages. The overmolded structures form a sealed unit which can protect electrical components and interfaces from potentially harmful environmental conditions. A wiring arrangement, or wiring harness, of a helmet according to the technology disclosed herein can be manufactured with integrated (i.e., overmolded) accessory attachment structures 7700. The wiring arrangement can be assembled onto a pre-made outer shell in a simplified assembly process that does not require the creation of further electrical connections between the wiring arrangement and the accessory attachment structures. The wiring arrangement may be assembled with the outer shell by an operator who does not require knowledge or skills related to forming electrical connections.

6.2.3 Side Guards

Referring to FIGS. 16A, 16B, 17A, and 17B, side guards 7800A and 7800B are shown. FIG. 16A shows a first side guard 7800A configured to provide L2 ballistic protection. FIG. 16B shows a section view of side guard 7800A, taken through line 16B of FIG. 16A. FIG. 17A shows a second side guard 7800B configured to provide L3 ballistic protection. FIG. 17B shows section view of side guard 7900, taken through line 17B of FIG. 17A.

Each side guard includes a front tab 7820 for mechanically interfacing with a first corresponding attachment feature of a helmet, an upper tab 7822 for mechanically interfacing with a second corresponding attachment feature of the helmet, and a rear locking tab 7824 for interfacing with a third corresponding interface feature of the helmet. The rear locking tab 7824 is at least partially housed in a rear locking tab housing 7826. The tabs 7820, 7822, and 7824 are used to attach a side guard 7800 or 7900 to a helmet system.

The side guards each include at least one ballistic component, for example one or more layers of ballistic material as disclosed herein. The first, L2, sideguard 7800A includes a first sideguard plate 7810 that includes a ballistic component having a first thickness, as shown in FIG. 16B. The second, L3, sideguard 7800B includes a second sideguard plate 7815 that includes a second ballistic component having a second thickness as shown in FIG. 17B. The second sideguard plate 7815 is thicker than the first sideguard plate 7810. The increased thickness provides increased ballistic protection, as is known in the art. Size, shape, and location of the tabs 7820, 7822, and 7824 on side guards 7800A and 7800B are maintained constant between side guards of different thickness by using a stepped design, wherein extra thickness of sideguard 7800B is displaced outward relative to the tabs (for example, relative to the upper tab 7822 as illustrated in FIGS. 16B and 17B). This arrangement is advantageous in that it enables a same attachment mechanism, to be used for multiple different side guard embodiments, each including a different level of ballistic protection and each having a different thickness. The stepped design enables use of a common mounting interface among a diverse set of side guards.

The front tabs 7820 and upper tabs 7822 may be attached to or may be at least partially formed as parts of the ballistic component comprising the side guard plates 7810 and 7815. In some embodiments, at least some tabs are formed as overmolded features formed in an overmolded enclosure that at least partially encloses the ballistic component. In other embodiments, a ballistic component is enclosed, partially or entirely, by a non-ballistic structure and one or more tabs 7820, 7822, and 7824 are attached to the non-ballistic structure. The non-ballistic structure may be formed by overmolding a rigid plastic over a ballistic component.

Referring to FIGS. 18A and 18B, operation of the rear locking tab 7824 is shown. The rear locking tab is configured to move relative to the rear locking tab housing 7826, as indicated by the arrow in FIG. 18A. A user may control movement of the rear locking tab 7824 by moving the rear locking tab actuator 7828 towards the front tab 7820, as indicated by the arrow in FIG. 18B. The rear locking tab housing 7826 includes a biasing element (not shown)—for example, a compression spring—which applies a biasing force on the rear guard locking tab 7826 to urge it into the extended position shown in FIG. 18A. The user can operate the actuator 7828 to overcome the biasing force to pull the rear locking tab into the rear locking tab housing in the retracted position illustrated in FIG. 18B. The user may operate the actuator 7828 to pull the rear locking tab 7824 into the retracted position to assemble a side guard 7800A or 7800B onto a helmet.

Referring to FIGS. 19A, 19B, 19C and 20, an exemplary method for attaching a side guard 7800A to a helmet 1010 is shown. A third exemplary helmet system 1003 includes the helmet 1010 and a side guard 7800A disposed on the left side of the helmet. The helmet system may also include a second side guard disposed on the right side of the helmet. The front tab 7820 of the side guard 7800 is engaged with a front tab interface 8020 of the helmet system as indicated in FIG. 19A by a filled arrow. The front tab interface 8020 is a cavity defined in part by an accessory interface hub 8000 that is formed separately and attached to the outer shell 1110 of the helmet. As best seen in FIG. 20, the front tab interface 8020 is formed as a cavity between a bottom surface 8012 of the accessory interface hub 8000 and an outer surface 1116 of the outer shell 1110. In alternative embodiments, the front tab interface may be formed as a cavity in the outer shell. In some embodiments, the accessory interface hub 8000 includes a front tab interface 8020 for attaching a side guard and a mandible interface 8030 for attaching a mandible guard.

When the front tab 7820 is seated in the front tab interface 8020, the side guard 7800A is rotated upwardly around the front tab 7820, as shown in FIG. 19B. Upward rotation of the side guard 7800A brings the upper tab 7822 into mating contact with the second mechanical interface 7140 of the side accessory interface 7100. The second mechanical interface 7140 can thus function as an attachment point for the side armor 7800A as well as a portion of an attachment location for an accessory device.

Upward rotation of the side guard 7800A around the seated front tab 7820 also brings the rear locking tab 7824 into proximity of the accessory mechanical interface 7240 of the rear accessory attachment structure 7200. In the illustrated, non-limiting, embodiment, the accessory mechanical interface 7240 is specifically configured to accept the side guard rear locking tab 7824. In some embodiments, a user pulls the rear locking tab actuator 7628 toward the front tab 7820 to withdraw the rear locking tab 7824 into the rear locking tab housing 7826 while rotating the side guard 7800 into place.

When the side guard 7800A is seated in its engaged position, as shown in FIG. 19C, the user releases the rear locking tab actuator 7628. One or more springs, or other elastically compressible biasing elements contained in the rear locking tab housing 7626, urge the rear locking tab 7824 into the accessory mechanical interface 7240 to lock the side guard 7800A in place. In an alternative embodiment, the user moves the rear locking guard actuator 7628 towards the back of the helmet to lock the side guard 7800A in place.

In some embodiments, the rear locking tab 7824 and accessory mechanical interface 7240 include features that tend to push the rear locking tab 7824 into the rear locking tab housing 7826 as the side guard is rotated into place so that a user does not need to pull the rear locking tab actuator 7828 forward to assemble the side guard 7800A onto the helmet 1010. The features can include, for example, interfacing ramp surfaces that bias the rear lock tab 7824 into the rear locking tab housing 7826 during assembly of the side guard 7800A onto the helmet 1010 and that come out of contact with each other when the side guard 7800A is positioned as shown in FIG. 19C, thus allowing the rear locking tab 7824 to lock into the accessory mechanical interface 7240.

A user can remove the side guard 7800A by operating the rear side guard actuator 7628 to disengage the rear locking tab 7824 from the accessory mechanical interface 7240, rotating the side guard 7800A to disengage the upper tab 7822 from the second mechanical interface 7140 of the side accessory interface 7100, and removing the front tab 2020 from the front tab interface 8020.

Referring to FIGS. 21 and 22, overlap of a ballistic protection layer of an exemplary side guard 7800A with ballistic layer protection components of a helmet is shown.

Referring to FIG. 21, a cross section view of the helmet 1010 of the third exemplary helmet system 1003 is shown. The cross section is taken through cut line 21 of FIG. 19C.

The helmet 1010 includes features that have been disclosed elsewhere herein. Side guard ballistic layers 7810 or 7815 partially overlap the first ballistic layer 1120 and the front functional layer 1220 which, in the illustrated exemplary embodiment, is a ballistic layer. The overlay advantageously provides added ballistic protection over the bottom edges 1126, 1226 of the first ballistic layer 1120 and first functional layer 1220, respectively.

The helmet also includes a top ridge cavity 1130 disposed under the top ridge 1112. A top ridge fill layer 1132, which in embodiments includes a ballistic layer, is disposed within the top ridge cavity.

The left side ridge cavity 1140, formed under the left ridge 1113, houses the left front cable 1912. A right side ridge cavity 1141 formed under the right side ridge 1118 houses a right front cable 1913. Also shown are left side accessory attachment structure 7100 and right side accessory attachment structure 7101. In embodiments, the right front cable 1913 is electrically connected to an electrical interface of the right side accessory attachment structure 7101.

FIG. 22 is a side schematic view of layers of ballistic material that are included in an exemplary helmet system (e.g., 1000 or 1001), with other components of the helmet system hidden. A front ballistic layer 1220 and rear ballistic layer 1230 of the helmet are shown. Referring, for example, to FIGS. 5B, 13, and 21, the front and rear ballistic layers 1220 and 1230 may be included in addition to or instead of a first ballistic layer 1120 disposed internal to the outer shell 1110. In an example embodiment, the front and rear ballistic layers are removable functional layers that provide ballistic protection. A ballistic fill layer 1152, which may be placed in a rear ridge cavity 1150 of an exemplary helmet, overlaps a gap 1240 between the front and rear ballistic layers 1220 and 1230. The side guard ballistic layer (e.g., a side guard plate 7810 or 7815) also overlaps the gap and overlaps a portion of each of the first and second ballistic layers 1220 and 1230. The overlapping ballistic layers are advantageous in that they ensure that there are no gaps or breaks in ballistic protection on the helmet.

6.2.3.1 Mandible Guard

Referring to FIGS. 20, 23A, 23B, 23C, 24A, and 14B, a fourth helmet system 1004 that includes a helmet 1012 a mandible guard 7900 assembly is shown and an exemplary method of attaching the mandible guard assembly to the helmet 1012 is illustrated. The mandible guard 7900 assembly includes a mandible guard 7910, a left arm 7920 and a right arm 7921, each of which are attached to the mandible guard 7910 by a hinge (7925, 7926 respectively). The left arm 7920 and right arm 7921 are each terminated by a mandible connector 7930. The mandible connectors 7930 are configured for attaching the mandible guard assembly 7900 to the helmet 1012. The helmet includes a left and right mandible interfaces 8030 to which the mandible connectors 7930 are removably attachable.

In some embodiments, the mandible interfaces 8030 include open cavities for receiving mating features on the mandible connectors 7930. The open cavities are disposed with openings that each face outward from a side of the helmet, near a front portion of the helmet. In at least one embodiment, the open cavities are substantially perpendicular to an outer surface of the helmet.

In some embodiments, a mandible interface 8030 is formed in at least in part by an accessory interface hub 8000, which also includes a side guard front tab interface 8020, as previously described herein. In other embodiments, a mandible interface 8030 is formed as a feature molded into or separately attached to an outer shell 1110 of a helmet (e.g., 1012).

As best appreciated in reference to FIG. 23B, the right and left mandible connectors 7930 are assembled onto the helmet 1012 from the left and right sides of the helmet, as illustrated by bolded arrows. An engagement boss 7932 of each mandible connector 7930 is assembled into a mandible interface 8030.

The left and right arms 7920, 7921 may rotate relative to the mandible guard 7910 around left and right hinges 7925, 7926 to help facilitate assembly from the left and right sides of the helmet. This is different from conventional mandible guard attachments which are typically assembled onto a helmet using a front to back motion relative to the helmet. In an example known mandible guard method, engagement features of a mandible guard may slide into cavities or grooves on rails disposed on left and right sides of a helmet.

FIGS. 24A and 24B are detail views of a mandible connector 1930, as indicated by a dashed circle labeled 24A. 24B in FIG. 23A.

The mandible connector 7930 includes at least one fixed engagement boss 7932, which is configured to mate with a mandible interface 7830 of the helmet 1012. The fixed boss 7932 provides a firm connection with the mandible interface 7830 which helps keep the mandible guard assembly 7900 in place and helps prevent deflection of the mandible guard 7910 relative to the helmet 1012, despite force being applied to the mandible guard 7900.

The mandible connector 7930 also includes a mandible locking tooth 7934. Referring now to FIGS. 20, 24A, and 24B, the right mandible locking tooth 7934 is configured to engage with a locking tooth receptacle 8032 of the mandible interface 8030 to interlock the mandible connector 7930 with the mandible interface 8030. A user can pull up on a mandible actuator 7936 to withdraw the locking tooth 7934, thus allowing the mandible connector 7930 to be removed from the mandible interface 8030, thereby enabling removal of the mandible guard assembly 7900 from the helmet 1012, or for one of the right or left arms 7920 or 7921 to be disengaged from the helmet 1012 while the other mandible arm remains attached. A spring or other compressible elastic member (not shown) tends to bias to the locking tooth 7934 in its deployed position illustrated in FIG. 24A.

The mandible connector 7930 and mandible accessory attachment hub 8000 include additional features that are configured to aid attachment of the mandible guard assembly 7900 to the helmet 1012. The mandible connector 7930 includes a first connector surface 7938 which is configured to interface with a first attachment hub surface 8038. The mandible connector 7930 includes a second connector surface 7939 which is configured to interface with a second attachment hub surface 8039. When a user is assembling a mandible connector 7930 onto an accessory attachment hub 8000 (i.e., moving the mandible connector toward the hub from a side of the helmet), the first connector surface 7938 may come into contact with the first attachment hub surface 8038. The user may then slide the mandible connector 7930 upward relative to the attachment hub 8000 until the second connector surface 7939 interfaces with the second attachment hub surface 8039. The accessory connector is configured such that when the second connector surface 7939 is interfaces with the second attachment hub surface 8039, the fixed connection boss 7932 is aligned with the mandible interface 8032 thereby enabling assembly of the fixed connection boss into the mandible interface. This arrangement is advantageous in that it provide a guiding mechanism that aids in assembling the mandible guard assembly 7900 onto the helmet 1012 by feel. Interfaces between the surfaces also provides additional stability for the assembled mandible guard assembly.

6.2.3.2 Second Mandible Guard and Visor

Referring to FIGS. 25 and 26, a helmet system 8100 and helmet system 8101 are shown. The helmet systems 8100 and 8101 include a helmet 8110, at least one rail 8120 attached to a side of the helmet, an accessory attachment hub 8200 attached to the helmet 8110 and a mandible assembly 8300 attached to the accessory attachment hub.

The helmet 8110 can include a standard military bump or ballistic helmet, for example, a Caiman ballistic helmet marketed by Galvion LTD. The rail 8120 can include any standard helmet rail, as is known in the art.

The accessory attachment hub 8200 is attached to the helmet with at least one fastener 8202. The fastener 8202 can include a threaded fastener or any other suitable fastening device, for example fastener 7002 as disclosed previously herein. In some example embodiments, the accessory attachment hub 8200 is attached to the helmet 8110 using a fastener that is also used to at least partially attach the rail 8120 to the helmet 8110.

The accessory attachment hub 8200 includes a front accessory attachment interface 8220 for attaching a front mounted accessory, for example a visor (e.g., visor 8400), to the helmet 8110. The accessory attachment hub 8200 includes a mandible guard interface 8230 for attaching a mandible guard assembly (e.g., mandible guard assembly 8300), to the helmet 8110. The helmet systems 8100 and 8101 include a second accessory attachment hub (not shown), disposed on the right side of the helmet.

The mandible guard assembly 8300 includes a mandible guard 8310, a left attachment arm 8320, and a right attachment arm 8321. The attachment arms 8320 and 8321 each includes a mandible guard connector 8330 for connecting the mandible guard assembly 8300 to the accessory attachment hubs 8200.

The visor 8400 includes a visor lens 8410 and a visor connector 8420 for connecting the visor to the accessory attachment hub 8200. The visor connector 8420 includes a rearward extending arm 8422 and a visor engagement feature 8424 disposed at an end of the arm 8422 opposing an interface of the arm with the visor lens 8410. The visor interface 8220 may include a first interface receptacle for 8222 for receiving the arm 8422 and a second interface receptacle 8224 for receiving and releasably retaining the visor engagement feature 8424. In examples, the visor 8400 can include any one of a standard clear or tinted visor, a ballistic visor, a heads-up-display visor, or a heated visor. Embodiments of the front accessory attachment interface 8220 can be configured for attaching other types of accessories to a front portion of the helmet, for example an attachment arm for a waveguide device or a monocular, binocular, or multi-ocular night vision device.

Turning now to FIGS. 27A through 27C, 28A, and 28B, assembly of a mandible guard connector 8330 onto the accessory attachment hub 8200 is shown. It is noted that in some exemplary embodiments, the accessory attachment hub 8200 extends over a bottom edge 8114 of the helmet.

The mandible guard interface 8230 includes a receptacle cavity having top surface 8232 and cavity walls 8233 for interfacing with interface surface 8332 of the mandible guard connector 8330 and an attachment feature 8237 for interfacing with an engagement feature 8337 of the mandible guard connector 8330.

Figure 27A:
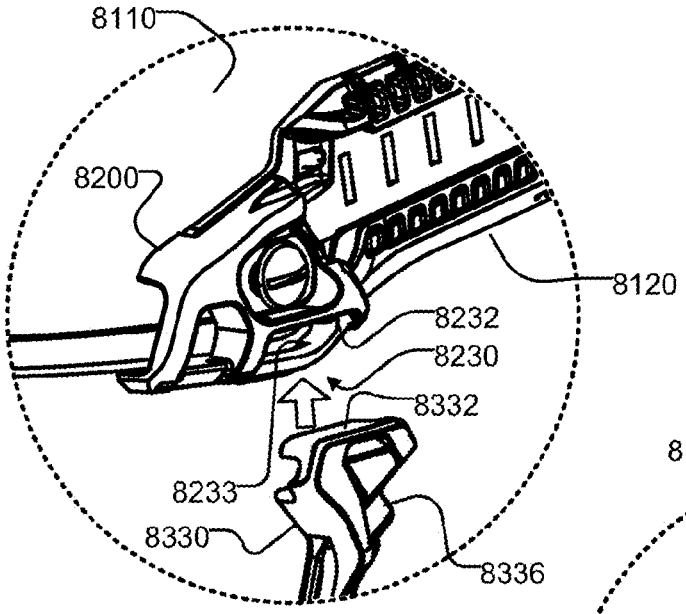
Figure 27B:
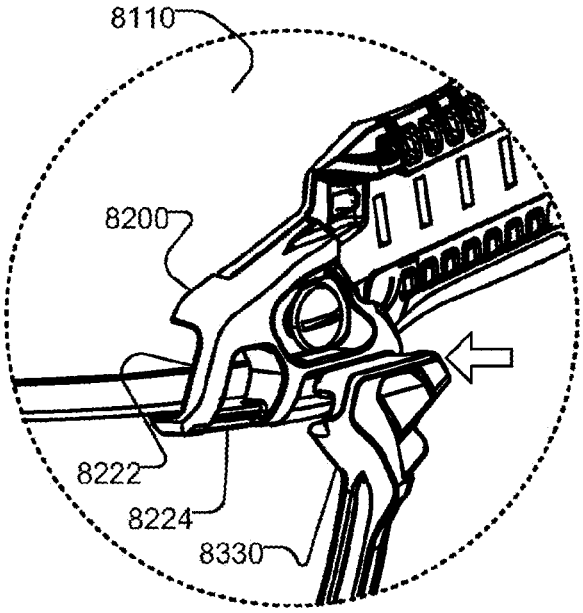
Figure 27C:
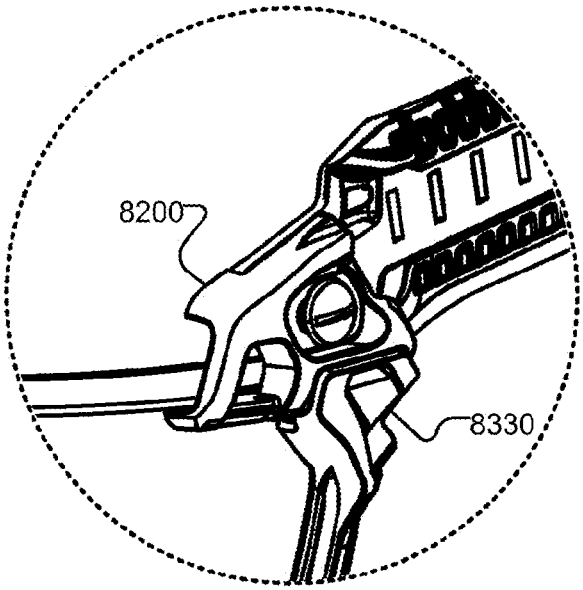

As shown in FIG. 27A, a user can move the mandible guard connector 8330 upwards until its interface surface 8332 comes into contact with the top surface 8232 of receptacle cavity of the mandible guard interface 8230. Once the user senses the contact, the user can push the mandible guard connector 8330 inward, toward the helmet, to releasably lock it on the mandible guard interface 8230. An outer shape of the mandible heard connector interface surface 8332 conforms to an inner shape of the mandible guard receptacle cavity, as defined by top surface 8232 and cavity walls 8233, thereby providing a tight fit between the mandible guard connector 8330 and the mandible guard interface 8230 when they are assembled together. This tight fit is advantageous for prevent movement of the mandible guard 8310 relative to the helmet 8110. In this manner, the mandible guard connection methods of the disclosed technology may provide superior performance as compared to standard, rail-mounted, mandible guards by, for example, resisting rearward deflection of the mandible guard 8310.

Figure 28A:
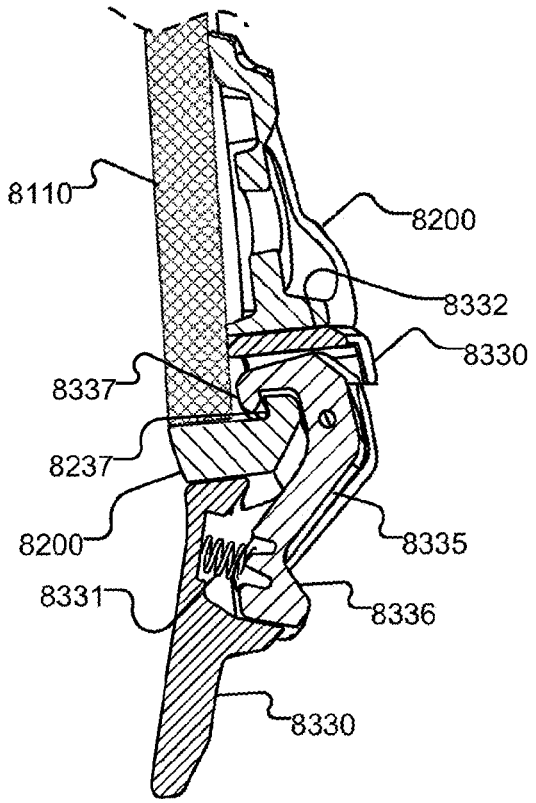
Figure 28B:
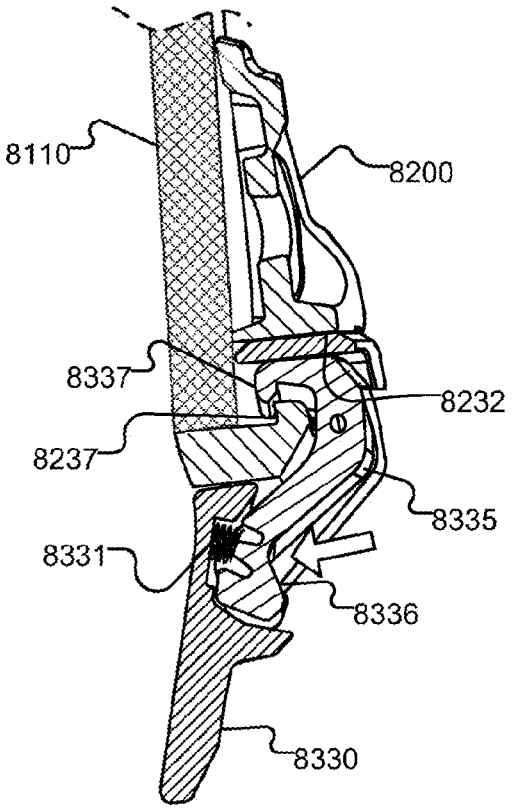

As best seen in FIGS. 28A and 28B, the mandible guard connector 8330 includes a clip 8335 configured to releasably lock the mandible guard connector 8330 onto the accessory attachment hub 8200. A biasing element 8331, which is substantially similar to biasing element 7325 and 7525 disclosed previously herein, urges the clip 8335 into a locked position, shown in FIG. 28A, wherein an engagement feature 8337 of the clip interfaces with an attachment feature 8237 of the mandible attachment interface 8230. A user can interact with an actuator portion 8336 of the clip 8335 to disengage the engagement feature 8337 from the attachment feature 8237, thereby releasing the mandible connector 8330 from the accessory attachment hub 8200, as shown in FIG. 28B.

6.2.3.3 Accessory Attachment Hub Embodiments

Referring to FIGS. 29A, 29B, and 30, an accessory attachment hub, for example accessory attachment hub 8200, can be removably attached to a helmet, (e.g., to helmet 8110). As shown in FIGS. 29A and 29B, the attachment hub 8200 can be assembled onto the helmet 8110 over a portion of a side rail 8120, for example using a fastener 8202. As shown in FIG. 30, the accessory attachment hub 8200 can be assembled directly onto a helmet 8110, including an embodiment of the helmet that does not include a side rail. In some embodiments, a spacer 8124 may be disposed between the accessory attachment hub 8200 and the helmet surface 8112. In some embodiments, the spacer 8124 is formed as a portion of a rail (e.g., rail 8120) that the accessory attachment hub is designed to be assembled over, as shown in FIG. 29A. Use of a spacer may be advantageous to enable a user to install an accessory attachment hub (e.g., 8200) that is designed for use with a rail rather than requiring an accessory attachment hub designed specifically for installation on a helmet without a rail. In other embodiments, a spacer 8124 may be designed for use with a specific helmet having a particular surface contour that may not match a contour of a helmet interface surface of the accessory attachment hub 8200. The configuration illustrated in FIGS. 29A, 29B, and 30 provides a number of advantages including enabling a user to configure a large variety of helmets with capabilities provided by an accessory attachment hub 8200 and by other accessory attachment hubs according to the technology disclosed herein. The capabilities include, for example, attachment of a mandible guard and/or front accessory (for example, a visor) to a helmet that includes an accessory attachment hub.

Referring now to FIG. 31, other types of helmets (for example helmet 1010 of helmet system 1000) can be configured with a removable and replaceable accessory attachment hub 8001. The accessory attachment hub 8001 is similar to the accessory attachment hub previously disclosed herein and includes a mandible guard interface 8030. The accessory attachment hub 8001 also includes a vision system interface 1938. Advantageously, the accessory attachment hub 8001, and other accessory attachment hubs according to the disclosed technology can be added to and removed from a helmet to provide the helmet with configurable capabilities including for attachment of accessory device and electronic capabilities: for example, one or more electrical connection interfaces.

Referring now to FIGS. 32A and 32B, an example embodiment of another helmet system 9000 according to the technology disclosed here is shown. The helmet system 9000 includes a first accessory attachment hub 8500 that includes an electro-mechanical interface 8510 for attaching one or more powered accessory devices and a mechanical interface 8520 for mechanically attaching an accessory. The helmet system 9000 includes a second accessory attachment hub 8600 that includes a keypad 8610 for controlling operation of one or more accessory devices and a mounting interface 8620 for mounting an accessory device or a mounting feature associated with an accessory device. Each of the accessory attachment hubs 8500 and 8600 may be removed and replaced: for example' with a different accessory attachment hub (e.g., 8000) that provides different or additional functionality. In this manner, the accessory attachment hubs enable a user to configure and reconfigure aspects of a helmet as desired.

6.2.3.4 Heat Dissipating Fins

Also referring to FIGS. 32A and 32B, an embodiment of a rear control module 9050 includes a plurality of heat dissipating fins 9070 for dissipating thermal energy: for example, thermal energy generated by the operation of one or more processors included in the rear control module. When the rear control module 9050 is installed on the helmet, the heat dissipating fins 9070 provide passageways between the rear control module and a helmet surface 9111 through which thermal energy can be dissipated: for example, through convection provided by the movement of air through the passages. This is advantageous for dissipating thermal energy at multiple locations (i.e., at outlets of each of the passages) to reduce an intensity of a heat signature produced by operation of the rear control module 9050. The heat dissipating fins 9070 may be formed from a plastic material or from a metal (for example aluminum). In some embodiments, the rear control module 9050 may optionally include an air moving device 9072 (for example, a fan or air pump), to increase a flow of air through the heat dissipating fins 9070 and thereby increase extraction of thermal energy from the rear control module 9050.

6.2.3.5 Battery Module Attachment

Referring now to FIGS. 33A through 33D, an arrangement and method for attaching a battery module 1960 to a rear control module 1950 is shown.

Figure 33A:
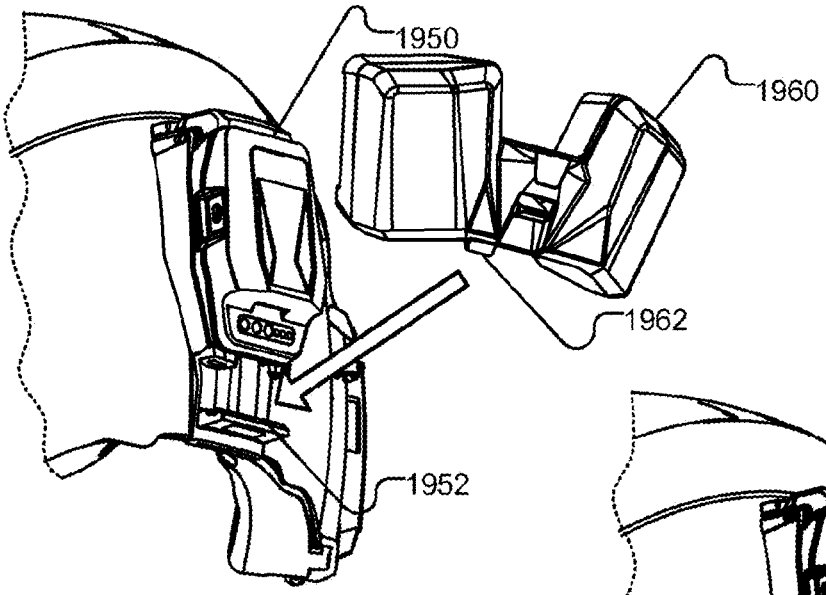
Figure 33B:
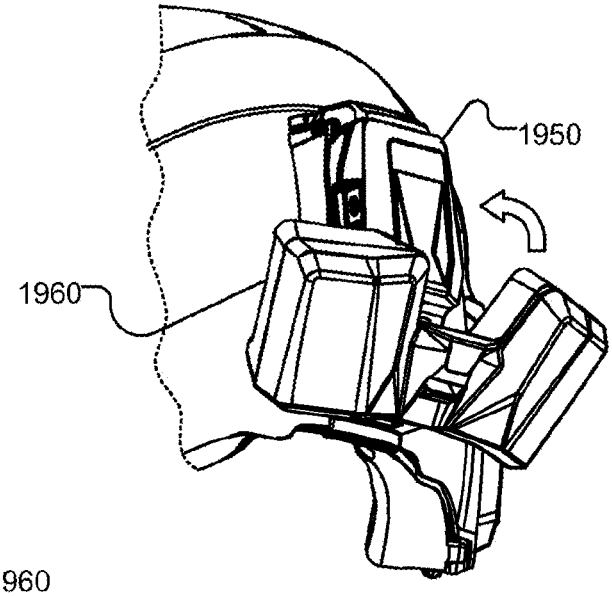
Figure 33C:
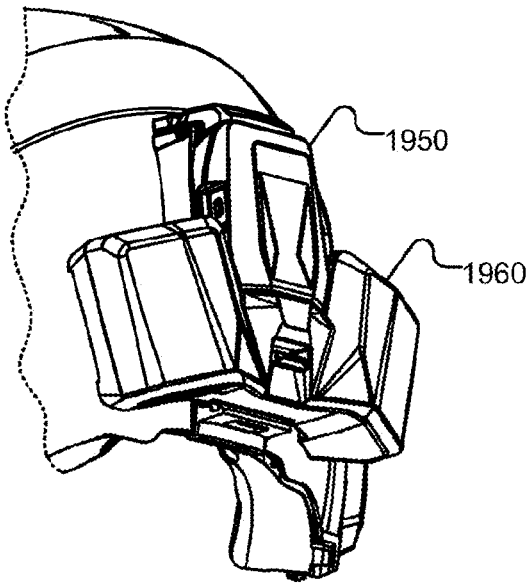
Figure 33D:
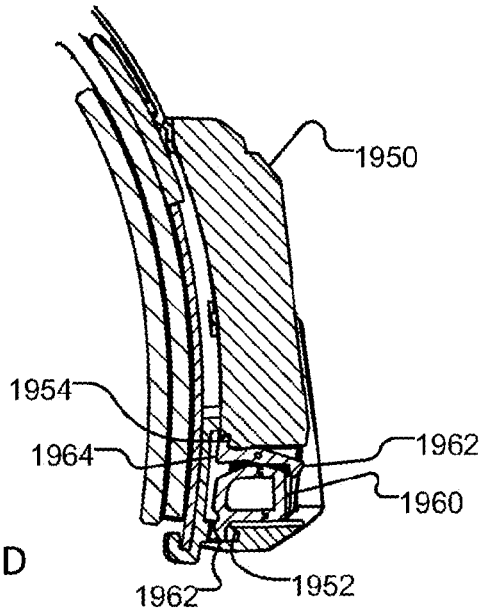

The battery module 1960 includes a locating engagement feature 1962, best seen in FIGS. 33A and 33D, and a lockable engagement feature 1964, best seen in FIG. 33D. The rear control module 1950 includes a locating interface feature 1952 which is configured to interface with the locating engagement feature 1962.

The rear control module also includes a second interface feature 1954, best seen in FIG. 33D, which is configured to be releasably interfaced with the lockable engagement feature 1964.

A user may releasably attach the battery module 1960 to the rear control module by maneuvering the rear control module, as shown in FIG. 33A, so that the locating engagement feature 1962 interfaces with the locating interface feature 1952 of the rear control module. This readies the battery module 1960 for attachment to the rear control module 1950 including aligning mating electronic contacts of both.

The user then rotates the battery module 1960 upwards toward the rear control module 1950, as shown in FIG. 33B. When the battery module 1960 is rotated into place on the rear control module 1950, as shown in FIG. 33C, electrical and communication contact therebetween is established and the lockable engagement feature 1964 engages with the lockable interface feature 1954 of the rear control module. In embodiments, the lockable engagement feature 1964 includes a clip that a user can operate to unlock and remove the battery module 1960 from the rear control module 1950.

It will also be recognized by those skilled in the art that, while the disclosure has been described above in terms of exemplary embodiments of the inventive technology, it is not limited thereto. Various features and aspects of the above-described exemplary embodiments may be used individually or jointly. Further, although the exemplary embodiments have been described in the context of their implementation in particular environments, and for particular applications (e.g. for bump helmets and ballistic protection helmets which may be used in military applications) those skilled in the art will recognize that its usefulness is not limited thereto and that the present embodiments of the inventive technology can be beneficially utilized in any number of environments and implementations where it is desirable to provide a reconfigurable helmet system wherein one or more of protection levels, protection types, functional components, and active systems can be easily added, removed, or modified by a user to meet the need of particular use case. Accordingly, the claims set forth below should be construed in view of the full breadth and spirit of the exemplary embodiments as disclosed herein.

What is claimed is:

1. An accessory attachment system, comprising:

a helmet comprising an outer shell having an outer surface and an inner surface, a concave cavity formed within an interior of the outer shell, and a ballistic layer disposed interior to the outer shell within the concave cavity;

a helmet electrical conductor disposed between the outer shell and the ballistic layer; and a structure for attaching an accessory to the helmet, the structure mounted on or accessible through the outer surface, the structure comprising a first accessory interface for attaching a first accessory to the structure, the first accessory interface comprising;

an accessory engagement surface for interfacing with the first accessory;

at least one mechanical interface for interfacing with a corresponding engagement feature of the first accessory;

a first electrical interface disposed on the accessory engagement surface for electrically connecting with a second electrical interface of the first accessory; and one or more electrical connectors passing from the electrical conductor, through the outer shell, and through the structure, the one or more electrical connectors for electrically connecting the helmet electrical conductor to the first electrical interface.

2. The accessory attachment system of claim 1, wherein the helmet electrical conductor is attached to the inner surface of the outer shell and is not attached to the ballistic layer.

3. The accessory attachment system of claim 1, wherein the outer shell forms at least one ridge comprising a ridge cavity disposed between the inner surface of the outer shell and the ballistic layer, wherein the structure is disposed on a portion of the outer surface comprising the ridge, and the helmet electrical conductor is disposed within the ridge cavity.

4. The accessory attachment system of claim 1, the structure further comprising a cavity enclosed by the structure between the outer surface of the outer shell and the first electrical interface, wherein the one or more electrical connectors extend from the helmet electrical conductor, through the cavity, and to the first electrical interface to provide electrical power to the first electrical interface.

5. The accessory attachment system of claim 1, wherein:

the accessory engagement surface faces outward from the helmet outer surface, the structure further comprising:

a first side wall depending from the accessory engagement surface toward the helmet outer surface;

a second side wall depending from the accessory engagement surface toward the helmet outer surface, the second side wall opposing the first side wall across a width of the structure;

wherein:

the at least one mechanical interface comprises a first interface cavity disposed on the first side wall and a second interface cavity disposed on the second side wall;

the first interface cavity comprises a first interface surface for interfacing with a first engagement feature of the first accessory, the first interface surface opposing the structure outer surface; and the second interface cavity comprising a second interface surface for interfacing with a second engagement feature of the first accessory, the second interface surface opposing the structure outer surface.

6. The accessory attachment system of claim 1, wherein:

the first accessory interface comprises first accessory attachment features; and the first accessory comprises first connection features for engaging with corresponding first accessory attachment features of an accessory attachment that is suitable for the first accessory.

7. The accessory attachment system of claim 1, wherein the helmet electrical conductor comprises a flexible circuit structure.

8. The accessory attachment system of claim 1, wherein:

the helmet further comprises a control module, the control module comprising a control module electrical interface and one or more of a power source and a processor;

the outer shell comprises a control module aperture passing between the outer surface and the inner surface, and the helmet electrical conductor is electrically interfaced with the control module electrical interface through the control module aperture;

wherein the helmet electrical conductor is configured to exchange one or more of power and communication signals between the control module and first electrical interface.

9. The accessory attachment system of claim 1, wherein:

the structure comprises a second accessory interface for attaching a second accessory to the structure;

the first accessory interface is adapted to exclusively interface with the first accessory; and the second accessory interface is adapted to exclusively interface with the second accessory.

10. The accessory attachment system of claim 1, wherein the outer shell comprises a cutout opening between the inner surface and the outer surface and the first accessory attachment structure is assembled into the cutout opening to expose the at least one mechanical interface and the first electrical interface on the outer surface of the outer shell.

11. The accessory attachment system of claim 1, wherein the structure is overmolded on the helmet electrical conductor.

12. An accessory attachment system, comprising:

a helmet comprising:

an outer shell having an outer surface and an inner surface, a concave cavity formed within an interior of the outer shell and a ballistic layer disposed within the concave cavity in contact with inner surface;

the outer shell comprising a ridge formed thereupon, the ridge defining a ridge cavity disposed between the inner surface and the ballistic layer;

a helmet electrical conductor disposed within the ridge cavity; and an accessory attachment structure mounted on or accessible through the outer surface, the accessory attachment structure comprising a first accessory interface, the first accessory interface comprising:

a first electrical interface for electrically connecting with a first powered accessory device, the first electrical interface electrically connected to the helmet electrical conductor through the outer shell and through the accessory attachment structure; and a first mechanical interface configured to interface with the first powered accessory device.

13. The accessory attachment system of claim 12, wherein the first mechanical interface is configured to exclusively interface with the first powered accessory device.

14. The accessory attachment system of claim 13, wherein the accessory attachment structure further comprises a second electrical interface for providing electrical and communication connections.

15. The accessory attachment system of claim 13, the accessory attachment structure further comprising a second accessory interface, wherein the second accessory interface comprises a second mechanical interface configured to interface with a second accessory device.

16. The accessory attachment system of claim 15, wherein the second mechanical interface is configured to exclusively interface with the second accessory device.

17. The accessory attachment system of claim 15, wherein:

the first accessory interface comprises first and second accessory interface locating features having a first distance therebetween;

the second accessory interface comprises third and fourth accessory interface locating features having a second distance therebetween; wherein the first distance is different from the second distance;

the first powered accessory device comprises first and second accessory device locating features having a third distance therebetween; and the third distance corresponds to the first distance.

18. The accessory attachment system of claim 12, wherein the first mechanical interface comprises locating grooves disposed on an outer surface of the accessory attachment structure, the locating grooves adapted to interface with corresponding locating ribs of the first powered accessory device.

19. The accessory attachment system of claim 12, wherein the accessory attachment structure further comprises:

an accessory attachment outer surface facing outward from the helmet outer surface for interfacing with an accessory device;

a first sidewall depending from the accessory attachment outer surface toward the helmet outer surface;

a second wall depending from the accessory attachment outer surface toward the helmet outer surface, the second sidewall opposing the first sidewall across a width of the accessory attachment structure;

wherein the first mechanical interface includes two or more first openings in the first sidewall and two or more second opening in the second sidewall, the first and second openings for engaging with mechanical connection features of the first powered accessory device to locate and attach the first powered accessory to the accessory attachment structure.

20. The accessory attachment system of claim 12 wherein the outer shell is formed from a material including carbon fiber.

21. An accessory attachment system comprising:

a helmet comprising an outer shell and a ballistic layer disposed interior to the outer shell;

a helmet electrical conductor disposed between the outer shell and the ballistic layer; and an accessory attachment structure for attaching an accessory to the helmet, the accessory attachment structure comprising a first accessory interface for attaching a first accessory to the structure, the first accessory interface comprising;

an accessory engagement surface for interfacing with the first accessory; and a first electrical interface disposed on the accessory engagement surface, wherein the first electrical interface is electrically connected by one or more electrical connectors passing from the helmet electrical conductor, through the outer shell, and through the accessory attachment structure.

* * * * *